US008944708B2

(12) United States Patent
Watase et al.

(10) Patent No.: US 8,944,708 B2
(45) Date of Patent: Feb. 3, 2015

(54) SHEET CONVEYING DEVICE, AND IMAGE FORMING APPARATUS INCLUDING SAME

(75) Inventors: Hiroyuki Watase, Kanagawa (JP); Yasuhiro Sagawa, Kanagawa (JP); Kenji Ueda, Kanagawa (JP); Masayuki Ueda, Tokyo (JP); Naoyuki Okamoto, Tokyo (JP); Hiroshi Kajiyama, Kanagawa (JP); Yoshikuni Ishikawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 1309 days.

(21) Appl. No.: 11/889,257

(22) Filed: Aug. 10, 2007

(65) Prior Publication Data

US 2008/0038039 A1 Feb. 14, 2008

(30) Foreign Application Priority Data

Aug. 11, 2006 (JP) ..... 2006-220457

(51) Int. Cl.
*B41J 13/08* (2006.01)
*B41J 11/00* (2006.01)
(Continued)

(52) U.S. Cl.
CPC ..... *B41J 11/007* (2013.01); *B41J 13/103* (2013.01); *B41J 29/38* (2013.01); *B65H 5/025* (2013.01); *B65H 2301/4454* (2013.01)
USPC ..... 400/629; 399/391; 400/642

(58) Field of Classification Search
CPC ..... B65H 2404/269; B65H 5/025; B65H 2404/1532; B65H 2404/2693; B65H 2404/262
USPC ..... 271/10.02, 10.09, 10.1, 12, 10.01, 271/10.07, 225, 9.13; 399/393, 394, 391; 400/629, 624, 625, 642
See application file for complete search history.

(56) References Cited

U.S. PATENT DOCUMENTS 5,267,729 A * 12/1993 Hirota et al. ..... 271/297
5,599,117 A * 2/1997 Faes et al. ..... 400/605
(Continued)

FOREIGN PATENT DOCUMENTS

JP 02-119467 9/1990
JP 04-055268 2/1992
(Continued)

OTHER PUBLICATIONS

Office Communication issued by the Japanese Patent Office for corresponding Japanese Patent Application No. 2006-220457 dated Jul. 30, 2010.

*Primary Examiner* — Judy Nguyen
*Assistant Examiner* — Jennifer Simmons
(74) *Attorney, Agent, or Firm* — Harness, Dickey & Pierce P.L.C.

(57) ABSTRACT

A sheet conveying device, that can be included in an image forming apparatus, includes a first conveying unit to convey a sheet in a first direction, a second conveying unit disposed on a downstream side of the first conveying unit to convey the sheet in a second direction, and a first path formed between the first and second conveying units. At least the second conveying unit has a holding section to hold and convey the sheet. The sheet conveying device further includes a belt conveying unit disposed along an outer side of the first path and includes a belt to convey the sheet toward the holding section. The belt is stretched around a first belt holding and rotating member and a second belt holding and rotating member disposed on an upstream side of the second conveying unit in the second direction.

21 Claims, 24 Drawing Sheets

(51) Int. Cl.

| | |
|---|---|
| ***B41J 13/10*** | (2006.01) |
| ***B41J 29/38*** | (2006.01) |
| ***B65H 5/02*** | (2006.01) |

(56) References Cited

U.S. PATENT DOCUMENTS

| | | | | |
|---|---|---|---|---|
| 5,921,544 | A * | 7/1999 | Benedict | 271/226 |
| 6,325,369 | B1 * | 12/2001 | Strutt | 271/9.02 |
| 6,538,680 | B2 * | 3/2003 | Sato | 347/197 |
| 6,666,603 | B1 * | 12/2003 | Suzuki et al. | 400/625 |
| 2001/0017439 | A1 * | 8/2001 | Hiramatsu | 271/10.11 |
| 2005/0185996 | A1 * | 8/2005 | Oishi et al. | 399/329 |
| 2006/0153607 | A1 * | 7/2006 | Mori | 399/361 |
| 2007/0057444 | A1 * | 3/2007 | Sagawa et al. | 271/225 |

FOREIGN PATENT DOCUMENTS

| | | |
|---|---|---|
| JP | 05-221547 | 8/1993 |
| JP | 07-247034 | 9/1995 |
| JP | 10-129883 | 5/1998 |
| JP | 10-265070 | 10/1998 |
| JP | 2002-274702 | 9/2002 |
| JP | 2004-338923 | 12/2004 |
| JP | 2005-001771 | 1/2005 |
| JP | 2005-089008 | 4/2005 |
| JP | 2007-127675 | 5/2007 |

* cited by examiner

SHEET CONVEYING DEVICE, AND IMAGE FORMING APPARATUS INCLUDING SAME

PRIORITY STATEMENT

The present patent application claims priority under 35 U.S.C. §119 from Japanese Patent Application No. 2006-220457 filed on Aug. 11, 2006 in the Japan Patent Office, the entire contents and disclosure of which are hereby incorporated by reference herein in their entirety.

BACKGROUND

1. Field

Example embodiments of the present invention generally relate to a sheet conveying device effectively conveying various types of sheets, an image forming apparatus such as a copier, a facsimile machine, a printer, a printing machine, an inkjet recording device, a scanner provided with the sheet conveying device, and a multifunctional machine combining functions of at least two of the above.

2. Discussion of the Related Art

In order to reduce the overall sizes of related-art image forming apparatuses including copiers such as a PPC (plain paper copier) and an electrophotographic copier, facsimile machines, printers, printing machines, and inkjet recording devices, the sizes of conveying units provided therein also tend to be reduced.

Specifically, a conveying unit is used for conveying a recording medium or a sheet-type recording medium onto which an image is formed (hereinafter, referred to as "sheet"). The sheet is fed from a sheet storing unit or a sheet stacking unit in which sheets are stacked and is conveyed to a main body of an image forming apparatus. In the following description, example operations of the sheet storing unit are described.

Furthermore, the related-art image forming apparatuses generally accommodate various sheet sizes and sheet types. For example, sheets of different sizes and different types are previously stored in multiple sheet storage units. A sheet is fed from the sheet storage unit selected by a user or automatically selected by the image forming apparatus. In such a configuration, each sheet storage unit occupies a large space in the related-art image forming apparatus, and therefore, it is particularly necessary to reduce the size of the related-art conveying unit.

One approach is to have a conveying path between the sheet storage unit and a main body of the related-art image forming apparatus that considerably bends or changes its direction midway depending on the relative positions of the sheet storage unit and the main body, so as to reduce the space occupied by the conveying path. Thus, in order to change the conveying direction in a continuous and smooth manner in the conveying path, the conveying path is provided with a curved section. The curved section is given a relatively small curvature radius so that a regular-sized recording sheet normally used in the related-art image forming apparatus can be conveyed.

In one technique (a first technique) used in a sheet feeding device of a related-art image forming apparatus, sheet feed trays serving as sheet storage units are arranged beneath the main body of the image forming apparatus. Given numbers of sheets of given sheet sizes and sheet types are stacked in the sheet feed trays. In between the sheet feed trays and the main body of the related-art image forming apparatus, a sheet conveying unit is provided for extracting a sheet of paper in a substantially horizontal direction from the selected sheet feed tray and feeding the extracted sheet in an upward direction toward the main body of the image forming apparatus disposed above.

A sheet in a sheet feed tray is separated from the stack of sheets by a related-art FRR (Feed Reverse Roller) separating method, and is sent to a main body of an image forming unit through a conveying path provided with a curved section including an upper guide plate and a lower guide plate, each of which serves as a guiding member for fixing a curved section. As the sheet is conveyed further on, the sheet is pressed from above by the upper guide plate. The sheet is conveyed by an elastically deformable guide piece positioned at the outlet end of the lower guide plate and reaches a pair of conveying rollers. Hereinafter, the upper guide plate and the lower guide plate are referred to as the "guiding member for fixing a curved section."

However, in the sheet conveying device with the above-described configuration, the following problem arises when conveying a specific type of sheet with high rigidity, such as a cardboard recording paper or an envelope. That is, when the sheet bends and moves along the curve, such a highly rigid recording paper or special paper receives a much greater resistance compared to a regular sheet such as a plain paper used for copying. This is because the curved section in the conveying path has a small radius. As a result, the highly rigid sheet cannot move along the conveying path, causing a paper jam or a conveyance failure. Thus, the sheet feeding operation cannot be reliably performed.

In order to facilitate the understanding of the related art and its problems, a description is now given of further details of the above-described conveyance operation.

When the leading edge of the sheet in the sheet conveying direction reaches the guiding member for fixing a curved section configured with the upper guide plate and the lower guide plate, the front half of the sheet including the leading edge of the sheet curves or bends in its thickness direction. Accordingly, when a highly rigid sheet is conveyed, a large force resists this bending action, in such a manner that a large resistance obstructs the sheet conveying operation. As a result, the leading edge of the highly rigid sheet may not reach the pair of conveying rollers at the downstream side of the sheet conveying direction, with the result that the sheet may be conveyed only by a pair of rollers on the upstream side thereof. However, when the sheet is bent by the guiding member, the conveying force of the pair of rollers alone may be insufficient for conveying the highly rigid sheet to counter to the resistance caused by the bending action. As a result, the following conveyance failures may be caused: Specifically, the sheet is caused to move in an oblique manner because the center-line of the highly rigid sheet does not match the center-line of the conveying path, or a paper jam occurs because the highly rigid sheet is caught inside the guiding member and stops moving.

Accordingly, the above-described sheet feeding device with the first technique has been proposed. In the sheet feeding device, a sheet is sent out from a first conveying member then conveyed to a second conveying member dos@psed at a position downstream in the conveying direction and substantially vertically above the first conveying member. A pair of linear guiding members is provided between the first conveying member and the second conveying member, and the sheet is conveyed by being guided by these linear guiding members. In this sheet feeding device, the guiding members do not have curved shapes but have linear shapes, and therefore, the conveyance load can be maintained at a low level. That is, the load can be prevented from rising abruptly so that conveyance failures such as a paper jam or oblique movements can be prevented.

That is, according to the above-described sheet feeding device, the conveyed sheet is not deformed or bent only at one position, but is deformed at two positions, i.e., near the front and the back ends of the linear guiding members in the sheet conveying direction. Furthermore, the linear guiding members are disposed obliquely at substantially intermediate angles, so that the sheet may bend by the same amount at the above-described two positions. Therefore, the conveyance load is prevented from rising abruptly. Specifically, the sheet changes its traveling direction by bending at the two positions, namely, when the sheet is passed from the pair of rollers located at the upstream side of the traveling direction to the linear guiding member, and when the sheet is passed from the linear guiding member to the pair of rollers located at the downstream side of the traveling direction. Thus, the sheet bends by smaller extents at these two positions than when the sheet abruptly bends at one position only. Thus, the resistance caused by the bending action of the sheet can be reduced at each of the two positions, thereby preventing the conveyance load from rising abruptly.

Another type of sheet feeding device with a first conveying member and a second conveying member having substantially the same configurations as the above-described sheet feeding device employing the first technique is described as follows.

This sheet feeding device employing another technique (or a second technique) includes a reverse guiding member provided at an incline between the first conveying member and the second conveying member. This reverse guiding member is configured to move toward the second conveying member.

In this sheet feeding device, when the trailing edge of the sheet contacts the reverse guiding member, the reverse guiding member shifts its position in a direction substantially according to the trailing edge of the sheet. This shift makes it possible to absorb the shock or impact caused when the trailing edge of the sheet contacts the reverse guiding member. Hence, a flipping noise can be reduced.

Yet another type of sheet feeding device with a technique (or a third technique) different from the first and second techniques has been proposed. This sheet feeding device employing the third technique includes multiple sheet storage units for storing sheets, and each of the sheet storage units is provided with a conveying path and a sheet conveying unit. The ends of the conveying paths merge into a common conveying path. Each of the conveying paths has a curved section at the end thereof, at which each conveying path merges with the common conveying path. At least one of the conveying paths provided for a sheet storage unit that stores or accommodates highly rigid sheets has a first curved section with a larger curvature radius than those of the other conveying paths.

Therefore, in this sheet feeding device, highly rigid sheets are caused to bend more moderately compared to plain paper sheets. A highly rigid sheet moves along the conveying path and passes via the first curved section having a large curvature radius, so that the sheet may not bend as much as a plain paper sheet passing via a curved section having a smaller curvature radius. Accordingly, it is possible to reduce the resistance while conveying a highly rigid sheet, so that the sheet can be conveyed to the common conveying path without being suspended or stopped.

Now, a sheet reversing unit employing another technique is described. The sheet reversing unit is provided in a related-art image forming apparatus. This sheet reversing unit includes a pair of reverse rollers and a reverse conveying path for conveying and guiding a sheet received from the pair of reverse rollers. The reverse conveying path includes a redirection section for changing the direction of conveying a sheet. Rotatable members or rollers are arranged inside the redirection section in a direction orthogonal or perpendicular to the sheet conveying direction, so that a sheet sent into the reverse conveying path can be sent out while abutting the rollers.

According to this sheet reversing unit, when a sheet is sent inside, it is ensured that the portion of the sheet inside the redirection section contacts the rollers, and the rollers are caused to rotate by or following the movement of the sheet in the conveying direction. Thus, compared to a related-art guiding plate, the conveying resistance can be reduced. Specifically, it is possible to eliminate a frictional resistance occurring between a fixed guiding member and the moving sheet while changing the conveying direction of the sheet at the redirection section.

However, the sheet conveying device of the sheet feeding device using the first technique merely provides a fixed member for guiding a conveyed sheet, and thus does not eliminate the speed difference between the conveyed sheet, which is moving, and the fixed guiding member. Accordingly, regardless of the shape or position of the guiding member, resistance occurs in such a direction as to obstruct the sheet from being conveyed, which generating a conveyance load.

That is, this related-art configuration is insufficient for preventing conveyance failures or paper jams. Although the linear guiding member can reduce the conveyance load from rising abruptly, a conveyance load is generated nonetheless. Particularly when conveying a highly rigid sheet, such as a cardboard recording paper or an envelope, conveyance failures and paper jams frequently occur and flipping noises made by the trailing edge of the sheet increase considerably.

Furthermore, as described in reference to the sheet feeding device with the second technique, the reverse guiding member can shift its position in a direction according to the trailing edge of the sheet contacting the reverse guiding member. However, the reverse guiding member merely functions as a fixed guiding member in terms of changing the direction of the sheet. Accordingly, as with the related-art configuration described above, this related-art technique does not eliminate the relative speed difference between the sheet and the reverse guiding member when changing the direction of the sheet and guiding the sheet, thus generating a conveyance load. Particularly when conveying a highly rigid sheet, such as a cardboard recording paper or an envelope, conveyance failures and paper jams frequently occur and flipping noises caused by the trailing edge of the sheet increase considerably.

Furthermore, as described in reference to the sheet feeding device with the third technique, the conveying path with a large curvature radius dedicated to highly rigid sheets makes it possible for sheets traveling therethrough to bend moderately so as to reduce the conveyance resistance applied by the conveying path to the sheet. However, a conveyance load is still generated nonetheless, and therefore, particularly when conveying a highly rigid sheet, such as a cardboard recording paper or an envelope, conveyance failures and paper jams frequently occur.

Furthermore, as described in reference to the sheet reversing unit with the fourth technique, movable members such as rollers are provided at given positions inside the redirection section of the conveying path. Therefore, in the process of conveying the sheet, the frictional resistance between the sheet and the guiding member can be effectively reduced while the internal rollers are supporting the middle portion of the sheet between the leading edge and the trailing edge.

However, there are no measures provided for reducing the conveyance load before and after the sheet is supported by the internal rollers, i.e., when the sheet is in contact with the conveying path outside the redirection section. Furthermore, no particular mention is made of movements of the leading edge and the trailing edge of the sheet while being conveyed. Particularly when conveying a highly rigid sheet such as a cardboard recording paper or an envelope, conveyance failures and paper jams frequently occur and flipping noises caused by the trailing edge of the sheet increase considerably.

In light of the foregoing, the inventors of the present invention previously propose to provide a sheet conveying device and an image forming apparatus including a sheet conveying device that can eliminate the drawbacks of the above-described techniques, specifically, by providing a sheet conveying device that is compact and space-saving, that includes a simple configuration achieved at low cost, and that can handle various types of sheets, and an image forming apparatus that includes such sheet conveying device.

However, the inventors of the present invention have found it difficult in practice to use the technique of this previously provided invention as is.

Specifically, the related-art separating method causes a sheet to be separated from a stack of sheets, turned at a conveying path provided with a curved section immediately after the separation, and conveyed to a grip roller. The above-described method can provide a space-saving structure having a shorter interval between the separation section and the grip roller, and at low cost.

By contrast, when a highly rigid sheet is conveyed, the sheet and a guide member of the conveying path may contact each other, thereby increasing the conveyance load.

To eliminate the above-described drawback, a belt conveying unit for supporting the conveyance of the sheet may be provided at the curved section of the conveying path. With this structure, a highly rigid sheet can be smoothly conveyed.

On the other hand, the conveying path is generally provided with a curved section having a relatively small curvature radius for providing an apparatus with a space-saving structure. In addition, when a paper jam occurs, the conveying path needs to be opened. Therefore, in most cases, the conveying path may be divided into two or more conveying paths with a branched or merged section. In a case in which a highly rigid sheet passes such a branched or merged section with a relatively small curvature radius, when the trailing edge of the highly rigid sheet moves from an upstream guide member to a downstream guide member, a sudden noise offensive to the ear or a flipping noise generated when the trailing edge of the sheet collides with or taps against the downstream guide member is produced.

The flipping noise is caused by the trailing edge of the highly rigid sheet tapping against the downstream guide member. When the trailing edge of the highly rigid sheet passes a gap provided between the upstream guide member and the downstream guide member, the trailing edge of the sheet may be released from a restrictive force of the upstream guide member and tap against the downstream guide member. This phenomenon can be eliminated when the related-art conveying roller is replaced by a moving unit with a belt.

However, to reduce the above-described flipping noise with the moving unit, it is necessary to adjust a height of the belt protruding from a conveying guide member so as to obtain reliable performance for sheets of various thicknesses.

SUMMARY

In light of the foregoing, the inventors of the present invention previously propose to provide a sheet conveying device and an image forming apparatus including a sheet conveying device that can eliminate the drawbacks of the above-described techniques, specifically, by providing a sheet conveying device that is compact and space-saving, that includes a simple configuration achieved at low cost, and that can handle various types of sheets, and an image forming apparatus that includes such sheet conveying device.

One or more embodiments of the present invention has been made, taking the above-described circumstances into consideration.

An embodiment of the present invention provides a sheet conveying device including a first conveying unit, a second conveying unit, a first conveying path, and a belt conveying unit. The first conveying unit is configured to convey a sheet in a first sheet conveying direction, and the second conveying unit is disposed on a downstream side of the first conveying unit in the first sheet conveying direction and is configured to convey the sheet conveyed by the first conveying unit in a second sheet conveying direction different from the first sheet conveying direction. At least the second conveying unit of the first and second conveying units includes a holding and conveying unit with a holding section to hold and convey the sheet. The first sheet conveying path is formed between the first conveying unit and the second conveying unit. The belt conveying unit is disposed along an outer side of the first sheet conveying path and is configured to include a belt to convey the sheet toward the holding section of the second conveying unit. The belt conveying unit includes a first belt holding and rotating member arranged facing the holding section and a second belt holding and rotating member disposed facing the first belt holding and rotating member, and is disposed on an upstream side of the second conveying unit in the second sheet conveying direction. The belt is wound between the first and second belt holding and rotating members.

The sheet conveying device may further include a first guide member disposed in the vicinity of the belt on a downstream side of the first sheet conveying path and configured to guide the conveyed sheet to the belt, the first guide member having a downstream end. Accordingly, a center of a shaft of the second belt holding and rotating member is disposed on an upstream side in the second sheet conveying direction of the second conveying unit from the downstream end of the first guide member.

The sheet conveying device may further include a second sheet conveying path formed from an upstream side of the second conveying unit to the second conveying unit and different from the first sheet conveying path, and a third sheet conveying path formed between the first and second sheet conveying paths to merge at an upstream side of the second conveying unit. Accordingly, the center of the shaft of the second belt holding and rotating member is disposed on the upstream side in the second sheet conveying direction of the second conveying unit from the downstream end of the first guide member.

The belt conveying unit may further include at least one pressing member configured to press at least one second belt holding and rotating member, and the at least one second belt holding and rotating member may be disposed to swingably rotate about the first belt holding and rotating member and is pressed at a given pressing force in a direction toward the first conveying path.

The sheet conveying device may further include a second sheet conveying path formed from an upstream side of the second conveying unit to the second conveying unit and different from the first sheet conveying path, and a third sheet conveying path formed between the first and second sheet conveying paths to merge at an upstream side of the second conveying unit. Accordingly, at least one second belt holding and rotating member may be disposed to swingably rotate about the first belt holding and rotating member and may be pressed at a given force in a direction toward the first conveying path.

The sheet conveying device may further include a belt supporting member configured to rotatably support the first belt holding and rotating member and the at least one second belt holding and rotating member and include a positioning section to position the belt at a given position, and a second guide member disposed so that the conveying surface of the belt faces an outer side of one of the first and third conveying paths. Accordingly, the pressing member may include an elastic member, and the positioning section of the belt supporting member may be pressed against the second guide member by a pressing force of the elastic member so as to position the belt at a given position protruding inward from a guide surface of the conveying guide member.

At least one embodiment of the present invention provides an image forming apparatus that includes the above-described sheet conveying device.

BRIEF DESCRIPTION OF THE DRAWINGS

The accompanying drawings are intended to depict example embodiments of the present invention and should not be interpreted to limit the scope thereof. The accompanying drawings are not to be considered as drawn to scale unless explicitly noted.

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF EXAMPLE EMBODIMENTS

Figure 1:
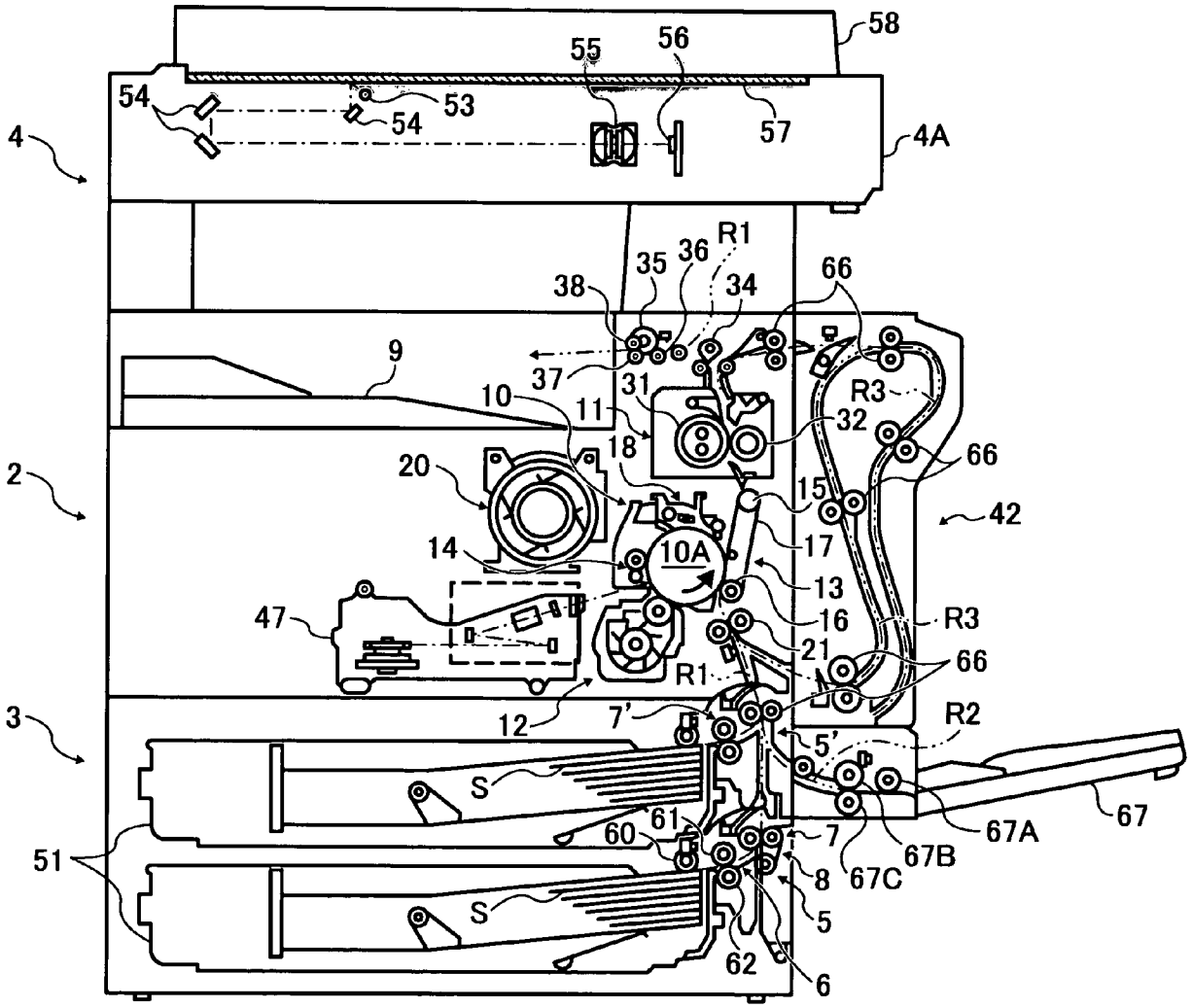
FIG. 1 is an elevation view of a schematic entire configuration of an image forming apparatus, according to an example embodiment of the prevent invention.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used only to distinguish one element, component, region, layer or section from another region, layer or section. Thus, a first element, component, region, layer or section discussed below could be termed a second element, component, region, layer or section without departing from the teachings of the present invention.

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, example embodiments of the present invention are described.

Now, example embodiments of the present invention are described in detail below with reference to the accompanying drawings.

Descriptions are given, with reference to the accompanying drawings, of examples, example embodiments, modified example embodiments, etc., of a sheet conveying device according to the present invention, and an image forming apparatus including the same. Elements having the same functions and shapes are denoted by the same reference numerals throughout the specification and redundant descriptions are omitted. Elements that do not require descriptions may be omitted from the drawings as a matter of convenience. Reference numerals of elements extracted from the patent publications are in parentheses so as to be distinguished from those of example embodiments of the present invention.

FIGS. 1 through 5 and FIGS. 8 through 10 show schematic structures and functions of sheet conveying devices to which the present invention is applied, and an image forming apparatus including the same.

Referring to FIG. 1, an overall configuration of a copier 1 serving as an image forming apparatus is described according to an example embodiment of the present invention.

The copier 1 is a monochrome copier that scans an image from a face of an original document and forms a copied image onto various sheet-type recording media (hereinafter, referred to as "sheet") such as recording paper, transfer paper, paper sheets, and OHP (overhead projector) transparencies.

The copier 1 includes a main body 2 thereof, a sheet feeding device 3 on which the main body 2 of the copier 1 is mounted, and an image scanning device 4 attached on the main body 2 of the copier 1.

The main body 2 of the copier 1 includes an image forming section for performing a given image forming process based on a scanned original image.

The sheet feeding device 3 supplies one sheet S at a time to the main body 2 of the copier 1.

The image scanning device 4 scans an original image and sends information of the original image to the main body 2 of the copier 1.

A sheet eject tray 9 is provided at the upper portion of the main body 2 of the copier 1, forming a space beneath the image scanning device 4. Sheets that have passed through the main body 2 of the copier 1 are ejected to and stacked on the sheet eject tray 9.

A sheet conveying path R1 extends from the sheet feeding device 3 to the sheet eject tray 9. A large proportion of the sheet conveying path R1 may extend between the sheet feeding device 3 and the upper portion of the main body 2 in a substantially vertical direction with respect to a substantially horizontal direction.

Sheet conveying units including pairs of conveying rollers and pairs of subordinate rollers may be provided along the sheet conveying path R1 with given intervals therebetween determined according to the smallest size of sheet S. Some of these sheet conveying units may be configured to sandwich or hold the sheet S to ensure that the sheet S continues to be conveyed along the sheet conveying path R1.

Furthermore, the sheet feeding device 3 includes a sheet conveying device 5 configured to feed and convey the sheets S stored in paper trays of the sheet feeding device 3.

Inside the main body 2 of the copier 1, a photoconductor unit 10 and a fixing device 11, serving as the image forming section for forming images, are disposed in this order from the upstream side toward the downstream side of the sheet conveying path R1. As the sheet S is conveyed from the upstream side toward the downstream side of the sheet conveying path R1, the photoconductor unit 10 may transfer a toner image that is generated onto the sheet S and the fixing device 11 may fix the transferred toner image onto the sheet S. The sheet S on which the toner image is fixed may be ejected onto the eject tray 9 that is disposed at the end of the sheet conveying path R1.

The photoconductor unit 10 includes a single drum-type photoconductor 10A serving as an image carrier. The photoconductor 10A is supported by a side panel, not shown, inside the main body 2 of the copier 1 so as to rotate around a substantially horizontal axis.

The photoconductor 10A has a cylindrical shape of a given diameter and a generally known configuration. The photoconductor 10A may receive a rotational driving force from a driving source such as a motor provided on one end of the photoconductor 10A, either on the photoconductor unit 10 side or on the main body 2 of the copier 1. Accordingly, the photoconductor 10A may rotate in a direction indicated by an arrow shown in FIG. 1 at a steady and constant speed.

Around the photoconductor 10A, elements are disposed in the following order in direction indicated by the arrow, which is an order of a developing device 12, a transfer device 13, a photoconductor cleaning device 18, a discharging device, not shown, and a charging device 14. Within a range corresponding to one rotation of the photoconductor 10A in the counterclockwise direction, there are a developing position, a transferring position, a cleaning position, a discharging position, and a charging position from upstream to downstream positions for each of the above-described devices, which are the developing device 12, the transfer device 13, the photoconductor cleaning device 18, the charging device, and the charging device 14.

Between the charging position and the developing position, there is a latent image forming position. An exposing device 47 is provided at a position somewhat spaced apart from and diagonally downward from the photoconductor 10A. At the latent image forming position, the exposing device 47 may emit a given laser beam to irradiate the photoconductor 10A so as to form an invisible latent image thereon according to image data. In synchronization with the rotation of the photoconductor 10A in the counterclockwise direction, the above-described image forming components and the exposing device 47 may perform interlinked operations so as to execute a sequence of an image forming process in cooperation with each other.

The developing device 12 has an appropriate, generally known configuration including a developing roller for generating a toner brush by causing toner particles to stand erect on the surface of the developing device 12 in a radial direction. The developing device 12 may cause the toner particles at the tips of the toner brush to adhere onto the latent image formed on a given position on the surface of the photoconductor 10A, as the latent image moves in a circumferential direction of the photoconductor 10A and pass through the developing position in accordance with the rotation of the photoconductor 10A. Accordingly, the invisible latent image may be turned into a visible and monochrome toner image.

The transfer device 13 includes two supporting rollers 15 and 16 spaced apart from each other in a substantially vertical direction and a transfer belt 17, which is an endless belt stretched around the supporting rollers 15 and 16. The transfer device 13 may transfer the toner image from the circumferential surface of the photoconductor 10A onto the sheet S, and convey the sheet S onto which an unfixed toner image is transferred to the downstream side of the sheet conveying path R1. Specifically, a portion of the lower supporting roller 16 where the transfer belt 17 may be stretched around is pressed against a substantially diagonally downward right portion of the photoconductor 10A, and the transferring position corresponds to a position at which the surface of the photoconductor 10A and the transfer belt 17 contact to each other. The upper supporting roller 15 is disposed in front of the inlet of the fixing device 11.

The photoconductor cleaning device 18 may include either one or both of a blade, not shown, and a rotating brush, not shown. The blade may have a blade edge at the tip thereof that abuts against the cleaning position on the photoconductor 10A while maintaining a given pressure level. The rotating brush may contact the cleaning position and be caused to rotate following the rotation of the photoconductor 10A. The photoconductor cleaning device 18 may remove toner or foreign materials remaining on the surface of the photoconductor 10A after the transfer operation.

The discharge device is primarily configured with a lamp that can emit a light beam of a given light intensity. This lamp may irradiate a light beam used for the discharging onto the discharging position to neutralize the charged surface of the photoconductor 10A passing by the discharging position. Accordingly, the discharge device can initialize the surface potential of the photoconductor 10A that had passed by the transferring portion.

The fixing device 11 includes a heating roller 31 with a built-in electrothermal heater serving as a heat source and a pressing roller 32 facing and pressed against the heating roller 31 in a substantially horizontal direction. When the heating roller 31 is rotated by a driving source, not shown, such as a motor, the pressing roller 32 in contact with the heating roller 31 may be caused to rotate following the rotation of the heating roller 31. At the same time, the portion at which the heating roller 31 and the pressing roller 32 contact each other may have a given heating temperature and given pressure so as to function as a nip section for fixing the toner image onto the sheet.

In FIG. 1, the main body 2 of the copier 1 further includes a toner storing container 20, which is a toner bottle storing unused and/or new toner. A toner conveying path, not shown, may extend from the toner storing container 20 to the developing device 12. When the developing device 12 has consumed the toner provided therein and there is a toner shortage, the newly replenished toner may be supplied from the toner storing container 20 into the developing device 12.

The sheet feeding device 3 is provided beneath the image forming apparatus main body 2, so that the sheet size can be chosen automatically or according to a user's manual input. The sheet feeding device 3 includes plural sheet feeding cassettes 51 serving as sheet storing units arranged therein in multiple stages. Each of the sheet feeding cassettes 51 can be individually pulled outside of the sheet feeding device 3 so as to be replenished with an appropriate number of sheets corresponding to that individual sheet feeding cassette 51. Different types of sheets S that are of various sheet sizes and oriented in vertical or horizontal directions with respect to the sheet conveying direction are stacked and/or stored in the sheet feeding cassettes 51.

The image scanning device 4 includes a main body 4A thereof serving as a framework of the image scanning device 4. On top of the main body 4A, an exposure glass 57 is disposed across a given range. A scanning unit may be housed inside the main body 4A of the image scanning device 4 for optically scanning an original image by scanning the given range of the exposure glass 57. The scanning unit primarily includes at least a first moving member 53, a second moving member 54, and image forming lens 55, and a scanning sensor 56 such as a CCD.

The image scanning device 4 includes a platen cover 58 configured to open and close between a closed position covering the exposure glass 57 and an open position. The platen cover 58 is disposed on the top surfaced of the main body 4A of the image scanning device 4. The platen cover 58 has larger length/width sizes than those of the exposure glass 57, and one side thereof is fixed to the top surface of the main body 4A of the image scanning device 4 so as to freely open and close.

On the basis of the above-described configuration, the copier 1 may be operated as described below.

First, in order to make a copy of an original document with the copier 1, a user manually opens the platen cover 58 of the image scanning device 4 from the closed position to the open position, places and sets the original document on the exposure glass 57, and then manually brings the platen cover 58 to the closed position, so that the platen cover 58 can press the original document set on the exposure glass from above. Accordingly, the original document spreads out in a planar manner in close contact with the exposure glass 57 so that the original document face can be scanned accurately, and the original document can be fixed on the exposure glass 57.

As the user presses a start key of an operation panel section, not shown, initially provided in the copier 1, a scanning operation of the image scanning device 4 immediately starts, and a driving mechanism, not shown, causes the first moving member 53 and the second moving member 54 to travel. A light beam from a light source of the first moving member 53 may be emitted toward the original document, and the light beam may be reflected from the original document face and is directed toward the second moving member 54. The light beam may then be reflected by a mirror of the second moving member 54, and the light beam may enter the scanning sensor 56 via the imaging lens 55. As a result, the image of the original document can photoelectrically be converted and scanned by the scanning sensor 56.

When the start key is pressed, the photoconductor 10A of the photoconductor unit 10 starts rotating and an operation starts for forming a toner image on the photoconductor 10A based on the scanned original image. Specifically, as the photoconductor 10A rotates, a given position on the circumferential surface of the photoconductor 10A may sequentially pass by the respective positions between the charging device 14, the exposing device 47, the developing device 12, the transfer device 13, the photoconductor cleaning device 18, and the discharging device. Accordingly, the given position on the photoconductor 10A may be charged to a given charged status, a latent image may be generated thereon, and the latent image may be turned into a visible toner image. The toner image may then be transferred onto the sheet S, residual toner may be removed from the photoconductor 10A, and the charged status may be cancelled. Thus, one cycle of operations may be completed in the above-described order of the developing device 12, the transfer device 13, the photoconductor cleaning device 18, the charging device, and the charging device 14. This cycle is continued until the toner image is created in an area of a given size on the circumferential surface of the photoconductor 10A in the rotational direction, according to the size of the image to be formed.

When the start key is pressed, one sheet S is extracted from the sheet feeding cassette 51 in the sheet feeding device 3 corresponding to the sheet feeding stage storing the type of sheet S selected automatically or manually, and the extracted sheet S may be conveyed to the sheet conveying path R1 via a given sheet conveying path by the sheet conveying device 5 attached to the corresponding sheet feeding stage. This sheet S is conveyed in a substantially vertically upward direction through the sheet conveying path R1 in the main body 2 of the copier 1 by conveying rollers, and may temporarily be stopped when the leading edge of the sheet S abuts against a pair of registration rollers 21.

In a case in which a manual sheet feeding operation is performed, the sheet S may set on a manual sheet feeding tray 67, and may be rolled out by the rotation of a sheet feeding roller 67A provided for the manual sheet feeding tray 67. When plural sheets S are stacked and set on the manual sheet feeding tray 67, separating rollers 67B and 67C may separate the sheets S one by one. The sheet is conveyed to a manual sheet feeding path R2, is conveyed from the manual sheet feeding path R2 to the sheet conveying path R1, and is then temporarily stopped when the leading edge of the sheet S abuts against the pair of registration rollers 21.

The pair of registration rollers 21 may start rotating at an accurate timing in synchronization with the relative movement of the toner image on the rotating photoconductor 10A so as to send the sheet S that has been temporarily stopped, into the transferring position. As a result, the toner image may be transferred onto the sheet S by the transfer device 13.

The sheet S, onto which an unfixed monochrome toner image is transferred, may then be conveyed to the fixing device 11 by the transfer belt 17 of the transfer device 13 serving as part of the sheet conveying path R1. The sheet S may pass through a nip section of the fixing device 11. The nip section may apply given heat and pressure onto the sheet S so that the image can be fixed onto the sheet S. The sheet S with the fixed image may be guided by a switching claw 34 to the sheet conveying path R1 that extends to the sheet eject tray 9, be ejected onto the sheet eject tray 9 by eject rollers 35, 36, 37, and 38, and be stacked on the sheet eject tray 9. The user can retrieve the sheet S stacked on the sheet eject tray 9 through an opening, which is located between the sheet eject tray 9 and the image scanning device 4 facing the front of the copier 1.

When a double-sided copy mode is selected by a user input, the sheet S with an image fixed on one side thereof may be guided by the switching claw 34 to be conveyed toward a sheet reversing device 42. Plural pairs of rollers 66 and guiding members, not shown, disposed inside the sheet reversing device 42 may convey the sheet S back and forth along a reverse conveying path R3 to reverse the sides of the sheet S. Then, the sheet S may be conveyed from a position in front of the photoconductor unit 10 back to the sheet conveying path R1 through the pair of registration rollers 21. The sheet S may be conveyed upward along the sheet conveying path R1 and guided to the transferring position once again, at which an image is transferred and fixed this time onto the backside of the sheet S. Finally, the sheet S may be ejected onto the sheet eject tray 9 by the eject rollers 35, 36, 37, and 38.

Figure 2:
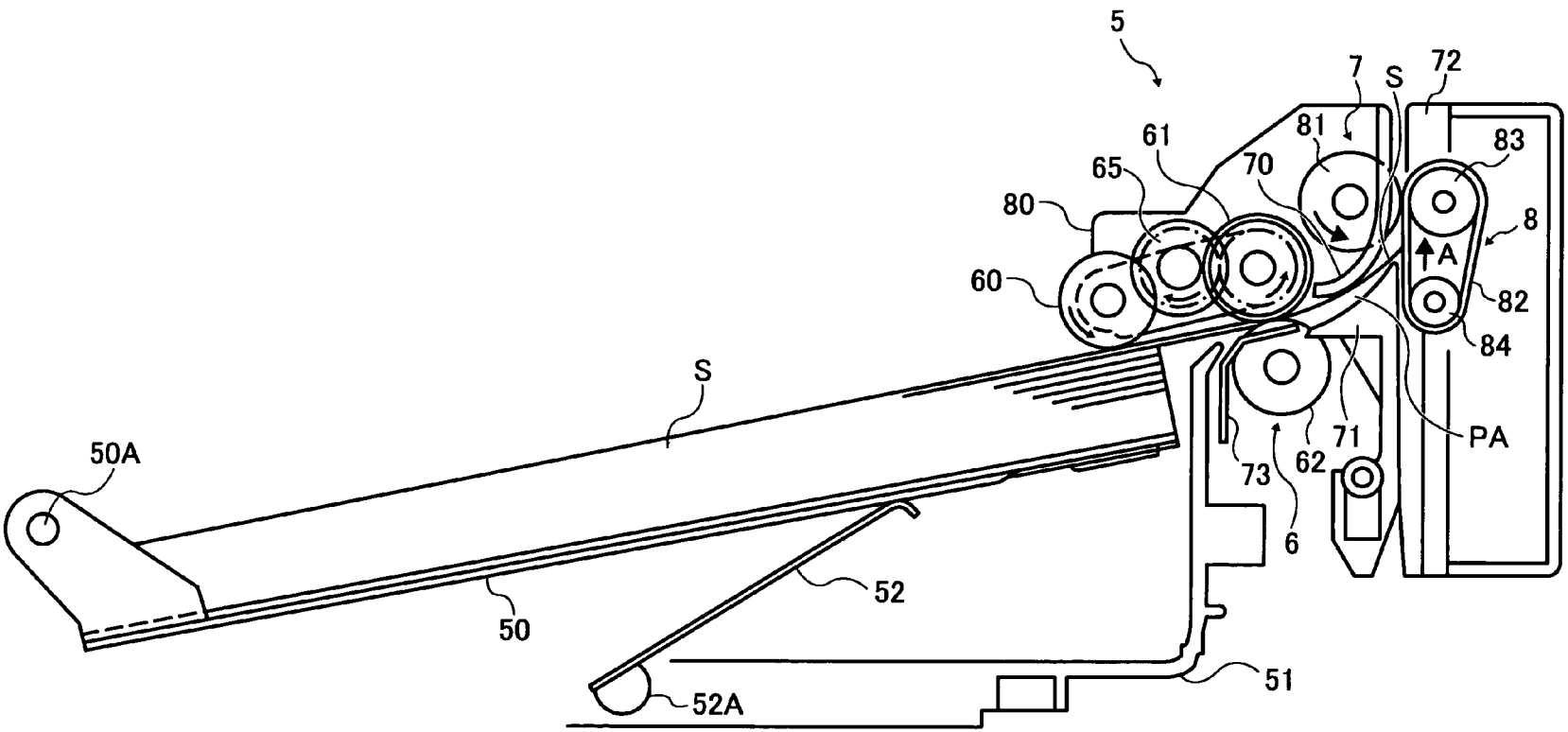
FIG. 2 is an enlarged cross-sectional view of a sheet conveying device, according to an example embodiment of the present invention, of the image forming apparatus of FIG. 1.
Figure 3:
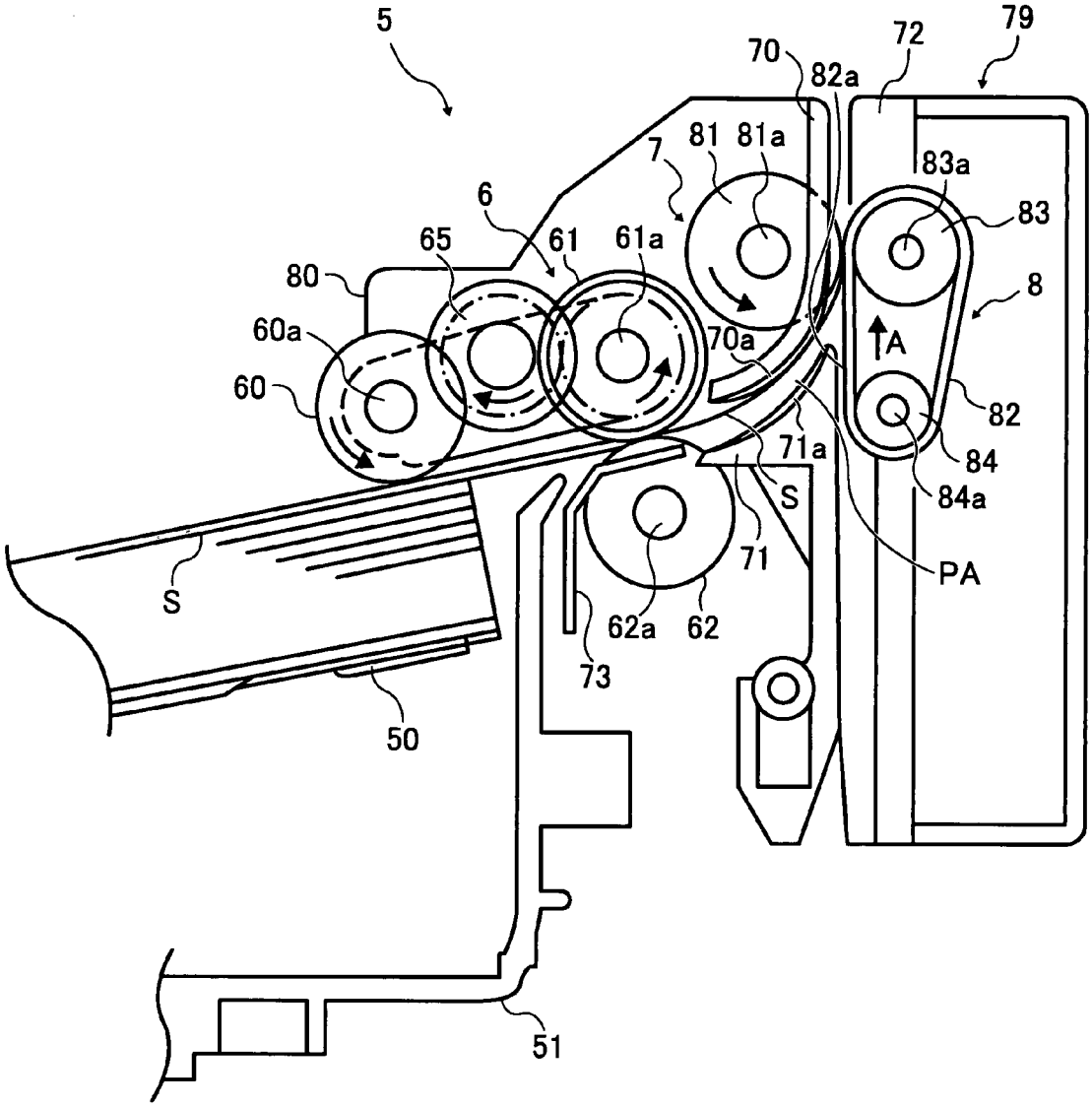
FIG. 3 is an enlarged cross-sectional view of the sheet conveying device of FIG. 2.

Referring to FIGS. 2 and 3, detailed configuration and functions of the sheet conveying device 5 are described.

As shown in FIGS. 2 and 3, the sheet conveying device 5 according to an example embodiment of the present invention extracts one sheet S from the stack of sheets S stacked and stored in the sheet feeding cassette 51 of a given stage (in this example, the lower stage) in the sheet feeding device 3 shown in FIG. 1, changes the sheet conveying direction of the extracted sheet S, and conveys the sheet S substantially vertical upward to the image forming apparatus main body 2.

The sheet conveying device 5 primarily includes a first conveying unit 6 for conveying the sheet S, a second conveying unit 7 disposed on a downstream side of the first conveying unit 6 in the sheet conveying direction for conveying the sheet S received from the first conveying unit 6 in a sheet conveying direction different from the sheet conveying direction of the first conveying unit 6, and a first conveying path PA provided between the first conveying unit 6 and the second conveying unit 7.

In the sheet conveying device 5, both the first conveying unit 6 and the second conveying unit 7 serve as holding and conveying unit to hold and convey the sheet S with a pair of rotating conveying members.

Specifically, the first conveying unit 6 includes two rotating conveying members disposed facing each other, namely a feed roller 61 and a reverse roller 62, and serve as a first pair of rotating and conveying members.

The second conveying unit 7 includes two rotating conveying members disposed facing each other, namely a grip roller 81 and a conveyor belt 82 stretched around a roller-type pulley 83 and a roller-type pulley 84, and serve as a second pair of rotating and conveying members.

At least one of the first conveying unit 6 and the second conveying unit 7 includes a belt conveying unit 8 serving as a moving and guiding unit provided with the conveyor belt 82 to move and guide (convey) the sheet S toward a holding section or nip section of the second conveying unit 7 while keeping the leading edge of the sheet S in contact with the conveyor belt 82. A conveying surface 82*a*, which is a belt traveling surface on the conveyor belt 82 of the belt conveying unit 8, is disposed along an outer side of the first conveying path PA.

As described above, the sheet conveying direction of the first pair of rotating and conveying members including the feed roller 61 and the reverse roller 62 is different from the sheet conveying direction of the second pair of rotating and conveying members including the grip roller 81 and the conveyor belt 82. Specifically, the sheet conveying direction of the first pair of rotating and conveying members is substantially horizontal and directed to a diagonally upward right position, whereas the sheet conveying direction of the second pair of rotating and conveying members is directed in a substantially vertically upward direction, as viewed in FIGS. 2 and 3. Accordingly, the first conveying path PA provided between the first conveying unit 6 and the second conveying unit 7 includes a curved section with a small radius, which can cause the sheet conveying direction to change abruptly in the first conveying path PA.

A more specific description is given of the sheet conveying directions of the first and second conveying units 6 and 7.

Figure 4:
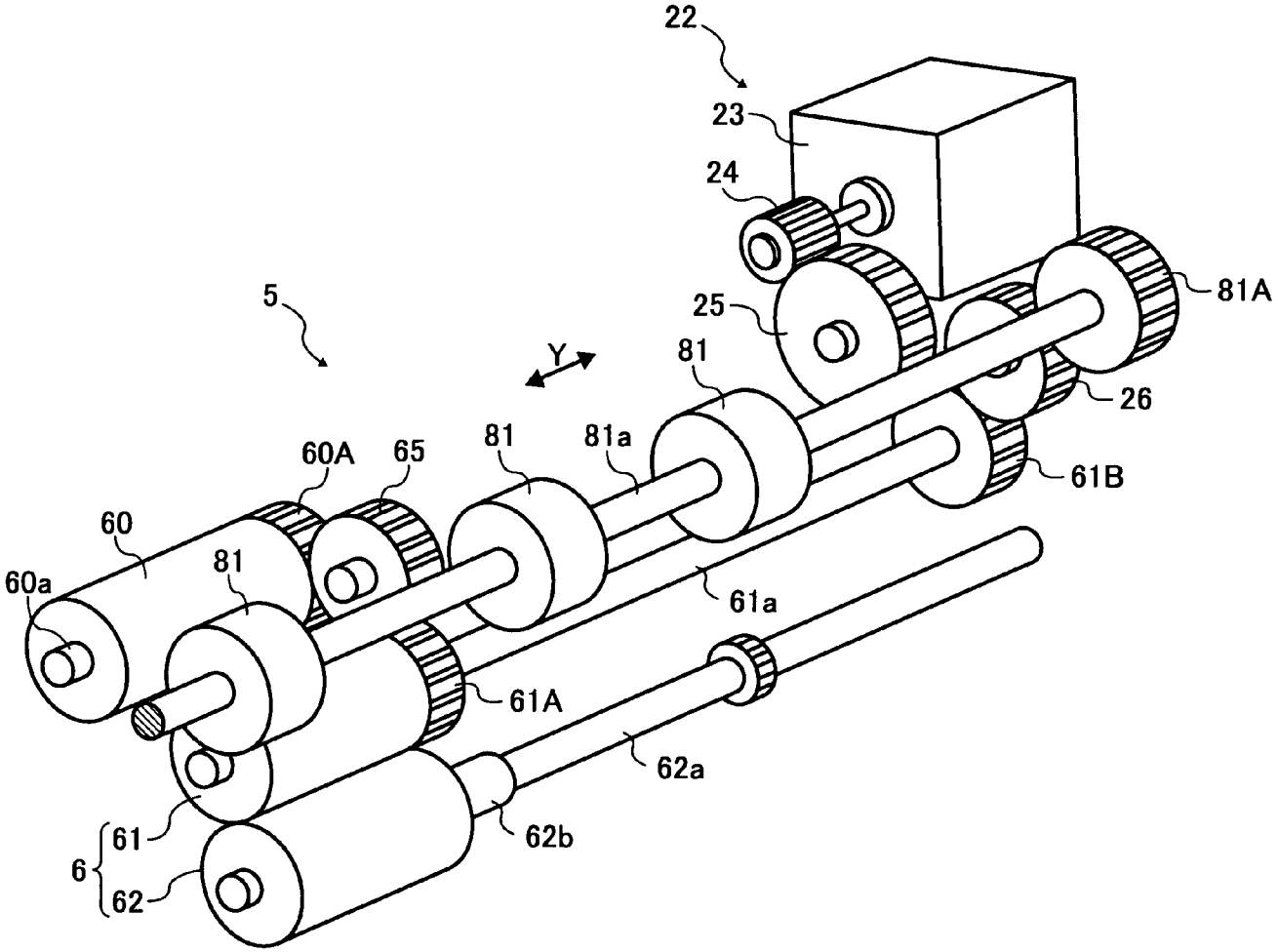
FIG. 4 is a schematic perspective view of a driving mechanism of the sheet conveying device of FIG. 2.

As shown in FIG. 4, the sheet conveying direction orthogonally intersecting the center of the nip section of the first conveying unit 6 is substantially horizontal with respect to a line connecting three points, which are the rotational center of the feed roller 61, the rotational center of reverse roller 62, and the holding section (also referred to as "nip section") of the feed roller 61 and the reverse roller 62.

Similarly, the sheet conveying direction orthogonally intersecting the center of the nip section of the second conveying unit 7 is substantially vertical with respect to a line connecting three points, which are the rotational center of the grip roller 81, the rotational center of the roller-type pulley 83, and the holding section (also referred to as "nip section") of the grip roller 81 and the conveyor belt 82.

That is, in the sheet conveying path PA provided between the first conveying unit 6 and the second conveying unit 7, the sheet conveying direction may change. The sheet conveying path includes two opposite surfaces that define the orientation of the conveyed sheet S in the thickness direction of the sheet S. When the sheet S is sent out from the first conveying unit 6, the leading edge of the sheet S may abut against a conveying guiding surface, which is one of the above-described two surfaces. The conveying guiding surface may move continuously and constantly within a given range, starting at least from the position at which the sheet S abuts against the conveying guiding surface, along the lengthwise direction of the sheet conveying direction, toward the holding section of the second conveying unit 7. This conveying and guiding surface corresponds to the belt traveling surface or the conveying surface 82*a* on the conveyor belt 82 of the belt conveying unit 8. In the example embodiment of the present invention, the area surrounded by an extended line along the sheet conveying direction of the first conveying unit 6 and an extended line along the sheet conveying direction of the second conveying unit 7 may be referred to as an "inner area." The rest of the areas may be referred to as an "outer area", which is an inner side and an outer side refer to sides closer toward the inner area and a side closer toward the outer area, respectively. The conveying surface 82*a* of the conveyor belt 82, which is the planar belt traveling surface used for conveying a sheet, is disposed along the outer edge of the inner area, and substantially intersects the sheet traveling direction.

As shown in FIGS. 3 and 4, the belt conveying unit 8 primarily includes the conveyor belt 82, and the roller-type pulley 83, and the roller-type pulley 84. The pulleys 83 and 84 may be a pair of belt holding and rotating members for rotatably holding the conveyor belt 82.

The roller-type pulley 83 serves as a first belt holding and rotating member. The roller-type pulley 84 is disposed opposite to the holding section or nip section formed between the grip roller 81 and the conveyor belt 82, so as to movably retain and span the conveyor belt 82.

The roller-type pulley 84 serves as a second belt holding and rotating member. The roller-type pulley 84 is disposed opposite to the roller-type pulley 83 and at an upstream side of the sheet conveying direction of the second conveying unit 7. In this example embodiment, the second belt holding and rotating member is disposed in a single unit. However, the second belt holding and rotating member is not limited in a single unit. That is, a plurality of second belt holding and rotating members can be applied to the present invention.

It is imperative that the belt conveying unit 8 be disposed in such a manner that the leading edge of the sheet S conveyed from the first conveying unit 6 abuts against or contacts the conveying surface 82*a*, at portions of the conveying surface 82*a* other than portions at which the conveyor belt 82 is held by the roller-type pulley 83 and the roller-type pulley 84. As shown in FIG. 4, the belt conveying unit 8 is disposed in such a manner that the axial center of the roller-type pulley 84 or a center of a pulley shaft 84*a* is disposed above the bottom edge of the reverse roller 62 and beneath the height of the downstream end of a guide surface 71*a* of a conveying guide member 71. Accordingly, the leading edge of the sheet S may collide with the abdominal portion (i.e., an "effective conveying portion") of the conveyor belt 82, where the conveyor belt 82 constantly and appropriately becomes elastically displaced and/or deformed (when colliding with the sheet S), so that the leading edge of the sheet S does not bounce back. Hence, it is ensured that the leading edge of the sheet S is kept in abutment with the conveying surface 82*a* (also referred to as "belt conveying surface 82*a*") of the conveyor belt 82, so that the effects described below can be achieved.

If the belt conveying unit 8 is disposed in such a manner that the leading edge of the sheet S abuts or contacts the conveyor belt 82 at the portions at which the conveyor belt 82 is held by or in contact with the roller-type pulley 83 and the roller-type pulley 84, the following problem may arise. That is, the hardness of the portions at which the conveyor belt 82 is held by the roller-type pulley 83 and the roller-type pulley 84 are generally greater than the abdominal portion of the conveyor belt 82, and thus the positions do not become elastically displaced and/or deformed as much as the abdominal portion. Hence, this arrangement is disadvantageous as the sheet S bounces back from the conveyor belt 82 because the conveyor belt 82 may not be constantly and appropriately become elastically displaced and/or deformed when the leading edge of the sheet S abuts against the portions at which the conveyor belt 82 is held by the roller-type pulleys 83 and 84. The same applies to other example embodiments and modified example embodiments according to the present invention described below (hereinafter, also described as "the same applies to other examples").

Furthermore, as shown in FIG. 4, it is imperative that the belt conveying unit 8 be disposed in such a manner that the leading edge of the sheet S conveyed from the first conveying unit 6 approaches the conveying surface 82*a* at an acute collision angle. By arranging the belt conveying unit 8 in such a manner, the leading edge of the sheet S may constantly abut the abdominal portion of the conveyer belt 82. Accordingly, it is ensured that the leading edge of the sheet S is kept in contact with the conveying surface 82*a*, so that the effects described below can be achieved.

If the belt conveying unit 8 is disposed in such a manner that the leading edge of the sheet S approaches the conveying surface 82*a* at a substantially perpendicular or orthogonal collision angle, the leading edge of the sheet S may abut against the conveying surface 82*a* in an irregular manner. For example, the sheet S may bend in the opposite direction to which the conveyor belt 82 is moving or the sheet S may bound back from the conveyer belt 82. Hence, this arrangement is disadvantageous (the same applies to other examples).

Each of the sheet feeding cassettes 51 in the stages of the sheet feeding device 3 may have a planar shape large enough to store the maximum size of the sheet S used in the copier 1. Each of the sheet feeding cassettes 51 is a substantially flat box with an upper opening and a bottom plate 50 provided at the bottom thereof serves as a sheet stacking unit. The rear end of the bottom plate 50, which is located on the left side as viewed in FIG. 2, is fixed to a horizontal shaft 50A supported by the sheet feeding cassette 51 so that the bottom plate 50 can freely rotate within a given angle range, i.e., so as to pivot back and forth or to oscillate. The free end of the bottom plate 50, which is located on the right side as viewed in FIG. 2, can pivot back and forth about the horizontal shaft 50A inside the sheet feeding cassette 51.

At the bottom of the sheet feeding cassette 51, there is a hollow section of a given shape. A rising arm 52 is provided in the hollow section. The rear end of the rising arm 52 is fixed to a horizontal shaft 52A so that the rising arm 52 can freely rotate within a given angle range, i.e., so as to pivot back and forth, in the hollow section. The horizontal shaft 52A may receive a driving force from a rotational driving source, not shown, causing the horizontal shaft 52A to rotate in arbitrary directions. As the horizontal shaft 52A rotates, the rising arm 52A may be caused to pivot about the horizontal shaft 52A to come to a given tilted position. Accordingly, the free end of the rising arm 52 may push up the bottom plate 52 so that one edge of the topmost face of the sheet S stacked on the bottom plate 50 can be maintained at a given height.

As described above, the sheet feeding cassette 51 stacks or stores the sheets S on the bottom plate 50 and stored therein. Furthermore, the free end of the bottom plate 50 on the right side as shown in FIG. 2 may rise so that the bottom plate 50 may tilt and the sheet S stacked thereon can be pushed up. Therefore, even if the sheets S are fed out one by one and the number of stacked sheet decreases, the topmost surface of the sheets S can be maintained at a given height.

As described above, the sheet feeding cassette 51 can be freely attached to or detached from the main unit of the sheet feeding device 3, namely, the sheet feeding cassette 51 can be inserted in or removed from the main unit of the sheet feeding device 3. Specifically, the sheet feeding cassette 51 can be set at an inserted position in the main unit of the sheet feeding device 3 as shown in FIG. 1 so that the sheet feeding can be performed. The sheet feeding cassette 51 can be pulled out and detached from the main unit of the sheet feeding device 3 toward the front as shown in FIG. 1 to a detached position, so that sheets S can be supplied or sheets S can be replaced with sheets S of a different size.

At least the first conveying unit 6, the second conveying unit 7, and the sheet conveying path formed between the first conveying unit 6 and the second conveying unit 7 may remain in the main unit even when the sheet feeding cassette 51 is pulled out. The copier 1 serving as an image forming apparatus of this example embodiment is an in-body paper eject type (i.e., the sheet eject tray 9 is located within the main body 2 of the copier 1). However, when the belt conveying unit 8 serving as the moving and guiding unit is provided, the curved section of the conveying path of this example embodiment can be kept equal to or less than that employing a general technique. Hence, the width of the image forming apparatus does not need to be increased, so that the advantage of the in-body paper eject type may not be diminished.

A pickup roller 60, which is shown in FIG. 1, is axially rotatably supported by a housing 80 that includes the outer shape of a structure provided on the main unit of the sheet feeding device 3, in such a manner that the pickup roller 60 contacts the topmost face of the sheets S raised to the given height. On an extended line along the direction to which the pickup roller 60 extracts the sheet S, a sheet feed separating mechanism may be provided for separating one sheet S from the stack of sheets S and for feeding out the separated sheet S. In the sheet feed separating mechanism, the feed roller 61 and the reverse roller 62 may contact each other by a given pressure level to form a nip section therebetween.

As illustrated in FIG. 3, the pickup roller 60 can be a known roller that is integrally fixed around a shaft 60*a* that is integrally formed with a cored bar, not shown, and is supported together with the shaft 60*a* so as to freely rotate. Alternatively, a one-way clutch, not shown, can be provided between the shaft 60*a* and the cored bar, and the pickup roller 60 can be supported so as to freely rotate with respect to the shaft 60*a* when the pickup roller 60 is not driven. The circumferential section of the pickup roller 60 including its circumferential surface is made of a soft and highly frictional material such as rubber, which has a high frictional coefficient with respect to the sheet S, so as to easily pick up the sheet S by contacting the sheet S. Furthermore, in order to increase the frictional resistance, substantially sawtooth-shaped projections can be formed over the entire circumferential surface of the pickup roller 60.

There are various sheet feeding methods for separating a sheet S from a stack of sheets S to prevent multi-feeding of sheets, i.e., prevent plural sheets from being sent out at once. In this example embodiment, the FRR sheet feeding method, which is a return separating method, is employed. Specifically, when two or more sheets S are picked up by the pickup roller 60, one sheet in contact with the feed roller 61 may be separated from the other sheet in contact with the reverse roller 62. The feed roller 61 may continue to send the sheet S in contact therewith in the sheet conveying direction while the reverse roller 62 returns the other sheet in the opposite direction to the sheet conveying direction, back to the original position on the stack of sheets. Furthermore, the reverse roller 62 may be disposed not to obstruct the sheet conveying operation performed by the feed roller 61.

More specifically, the sheet feed separating mechanism employing the FRR sheet feeding method as a sheet separating mechanism includes the feed roller 61 that is rotated in the forward direction of the sheet conveying direction and the reverse roller 62 that is rotated in the reverse direction by receiving a rotational driving force in the reverse direction via a torque limiter 62*b*, see FIG. 4. The feed roller 61 may contact the top face of the topmost sheet S fed out from the bottom plate 50, while the reverse roller 62 contacts the bottom face of at least one sheet S under the feed roller 61.

The feed roller 61 can be a roller that is integrally fixed around a shaft 61*a* that is integrally formed with a cored bar, not shown, and is supported together with the shaft 61*a* so as to freely rotate. Alternatively, the feed roller 61 can be supported in a similar manner to the pickup roller 60.

Similarly to the pickup roller 60, the circumferential section of the feed roller 61, including its circumferential surface, is made of a soft and highly frictional material such as rubber, which has a high frictional coefficient with respect to the sheet S, so as to easily convey the sheet S in the sheet conveying direction by contacting the sheet S. Furthermore, in order to increase the frictional resistance, substantially sawtooth-shaped projections can be formed over the entire circumferential surface of the feed roller 61.

The reverse roller 62 is integrally formed with a cored bar, not shown, and is supported together with a reverse roller driving shaft 62*a* by the housing 80 so as to freely rotate by receiving a rotational driving force via the torque limiter 62*b* (see FIG. 4).

In the FRR separating method, the reverse roller 62 may receive a low level of torque in a direction opposite to that of the rotational direction of the feed roller 61 via the torque limiter 62*b*. Therefore, when the reverse roller 62 is held in contact with the feed roller 61, or when one sheet S enters in between the feed roller 61 and the reverse roller 62, the reverse roller 62 may rotate following the rotation of the feed roller 61. That is, the function of the torque limiter 62*b* may cause the reverse roller 62 to slip on the reverse roller driving shaft 62*a*, so that the reverse roller 62 can rotate in a forward direction in the sheet feeding direction, similarly to the feed roller 61. Conversely, when the reverse roller 62 is separated from the feed roller 61 or when two or more sheets S enter in between the feed roller 61 and the reverse roller 62, the reverse roller 62 may rotate in the opposite direction. Therefore, when more than one sheet S enters in between the feed roller 61 and the reverse roller 62, the reverse roller 62 may return the sheet S other than the topmost sheet S in contact with the feed roller 61, i.e., the sheets S in contact with the reverse roller 62, toward the upstream side of the sheet conveying direction. Accordingly, it is possible to prevent multi-feeding of sheets S or feeding more than one sheet S at once.

Therefore, the conveying force applied from the reverse roller 62 to the sheet S in contact therewith is large enough in the reverse direction for returning the sheet S to its original position on the stack of sheets S. However, this conveying force is sufficiently smaller than the conveying force applied from the feed roller 61 to the sheet S for conveying the sheet S in the forward direction, so as not to obstruct the feed roller 61 from conveying the sheet S in the forward direction. Due to the above-described configuration, the conveying force applied from the feed roller 61 to the sheet S can be reduced by the opposite conveying force applied from the reverse roller 62 to the sheet S.

In FIGS. 2 and 3, the sheet conveying device 5 further includes an idler gear 65 that is joined to a driving shaft that outputs a rotational driving force from a driving source provided in the main unit of the sheet feeding device 3. The idler gear 65 may distribute and transmit a rotational driving force supplied from the sheet feeding device 3 through the engagement of gears or through a belt to the pickup roller 60 and the feed roller 61 to rotate then at given speeds.

At a diagonally upper position of the feed roller 61, the grip roller 81 is provided as the other rotating and conveying member of the second pair of rotating and conveying members including the second conveying unit 7. The grip roller 81 is rotatably supported by the housing 80 via a rotational driving shaft 81*a* integrally provided with the grip roller 81. Similarly to the feed roller 61, the circumferential section of the grip roller 81 including its circumferential surface is made of a soft and highly frictional material such as rubber, which has a high frictional coefficient with respect to the sheet S, so as to easily convey the sheet S in the sheet conveying direction by contacting the sheet S.

The pulley 83 is provided in the vicinity of the grip roller 81. The pulley 83 is axially rotatably supported by the housing 80 so as to contact the circumferential surface of the grip roller 81 via the conveyor belt 82, facing the grip roller 81 in a horizontal direction.

The pulley 83 is integrally formed with a pulley shaft 83*a*, and is rotatably supported together with the pulley shaft 83*a* by the housing 80. The pulley 84 is disposed at a diagonally downward left position of the pulley 83, and is axially rotatably supported by the housing 80. The pulley 84 is integrally formed with a pulley shaft 84*a*, and is rotatably supported together with the pulley shaft 84*a* by the housing 80. The pulleys 83 and 84 serve as the belt holding and rotating members for rotatably holding the conveyor belt 82.

The arrangement of the belt conveying unit 8 is not limited to the above-described descriptions. The belt conveying unit 8 can be arranged as follows. In FIG. 3, the sheet conveying device 5 further includes an opening and closing guide 79 that opens and closes with respect to the housing 80. The opening and closing guide 79 is part of the main unit of the sheet conveying device 5. The opening and closing guide 79 is integrally mounted to a unit with a conveying guide member 72, which will be described later, and the belt conveying unit 8. The opening and closing guide 79 may open and close by pivoting about a fulcrum shaft hinge, not shown, below the housing 80 so that the conveyor belt 82 can be separated from the grip roller 81, making it easier for a user to resolve a paper jam in the first conveying path PA or the vertical conveying path extending substantially upward.

The pulley 83, the pulley 84, and their respective pulley shafts 83*a*, 84*a*, are rotatably supported by the opening and closing guide 79 when the sheet conveying device 5 is provided with the opening and closing guide 79.

The conveyor belt 82 is an endless belt stretched around the pulleys 83 and 84, as described above. The axes of the pulleys 83 and 84 are spaced apart by a given distance. The linear belt traveling surface or the conveying surface 82*a* of the conveyor belt 82 between the pulleys 83 and 84 is disposed at a position to ensure that the linear belt traveling surface thereof is contacted by the leading edge of the sheet S sent out from the first conveying unit 6. As described above, the circumferential surface of the conveyor belt 82 stretched around the circumferential surface of the pulley 83 may directly contact the circumferential surface of the grip roller 81 at a given pressure level. The portion at which the conveyor belt 82 contacts the grip roller 81 corresponds to the holding section or nip section. More specifically, a pressuring member, not shown, (e.g., springs 92 shown in FIG. 20 described below) may be attached to a bearing member or supporting member, not shown, (e.g., belt supporting members 86 shown in FIG. 18 described below) for supporting the pulley shaft 83*a*. This forcing unit may press the conveyor belt 82 against the grip roller 81.

The conveyor belt 82 is made of an elastic material such as rubber. The frictional coefficient of the surface of the conveyor belt 82 may be specified a given value with respect to the conveyed sheets S. The frictional coefficient is defined by characteristics of the material of the conveyor belt 82 itself or by treating the surface with an appropriate process. Specifically, the frictional coefficient may be specified to ensure that the surface of the conveyor belt 82 serving as the conveying surface 82*a* may transmit a conveying and propelling force to the face of the sheet S in contact with the conveyor belt 82, without allowing the sheet face to slip along the surface of the conveyor belt 82.

The belt width of the conveyor belt 82 in a sheet width direction perpendicular or orthogonal to the sheet conveying direction may be at least substantially equal to the width of a maximum size sheet to be conveyed. That is, the belt width of the conveyor belt 82 may substantially be equal to or wider than the width of a maximum size sheet to be conveyed. The sizes in the sheet width direction or axial lengthwise direction of the pulleys 83 and 84 around which the conveyor belt 82 is stretched and the grip roller 81 facing and contacting the conveyor belt 82 are equal to or larger than the above-described belt width of the conveyor belt 82. Hence, it is ensured that the entire width of the sheet S sent out from the first conveying unit 6 contacts the conveyor belt 82, so that the contact area therebetween can be increased. Accordingly, it is possible to increase the conveying and propelling force for conveying the sheet S in conveying direction. The conveying and propelling force may constantly be transmitted to the sheet S from the conveyor belt 82 moving in the sheet conveying direction.

A rotational driving source, not shown, such as an electric motor provided specifically for rotating the grip roller 81 is connected to the rotational driving shaft 81*a* of the grip roller 81 via a driving force transmitting unit, not shown, such as a gear or a belt. The grip roller 81 may be rotated by receiving a rotational driving force of a given rotational speed from the rotational driving source via the driving force transmitting unit. Accordingly, the grip roller 81 serves as a driving roller, while the conveyor belt 82 in contact with the grip roller 81 may serve as a subordinate belt that is caused to move following the rotation of the grip roller 81 serving as the driving roller, and the pulley 83 supporting the contact portion between the conveyor belt 82 and the grip roller 81 from inside the belt may serve as a subordinate roller that is caused to rotated via the subordinate belt or the conveyor belt 82. As a matter of course, the pulley 84 may also serve as a subordinate roller that is caused to rotate via the subordinate belt or the conveyor belt 82.

Figure 5:
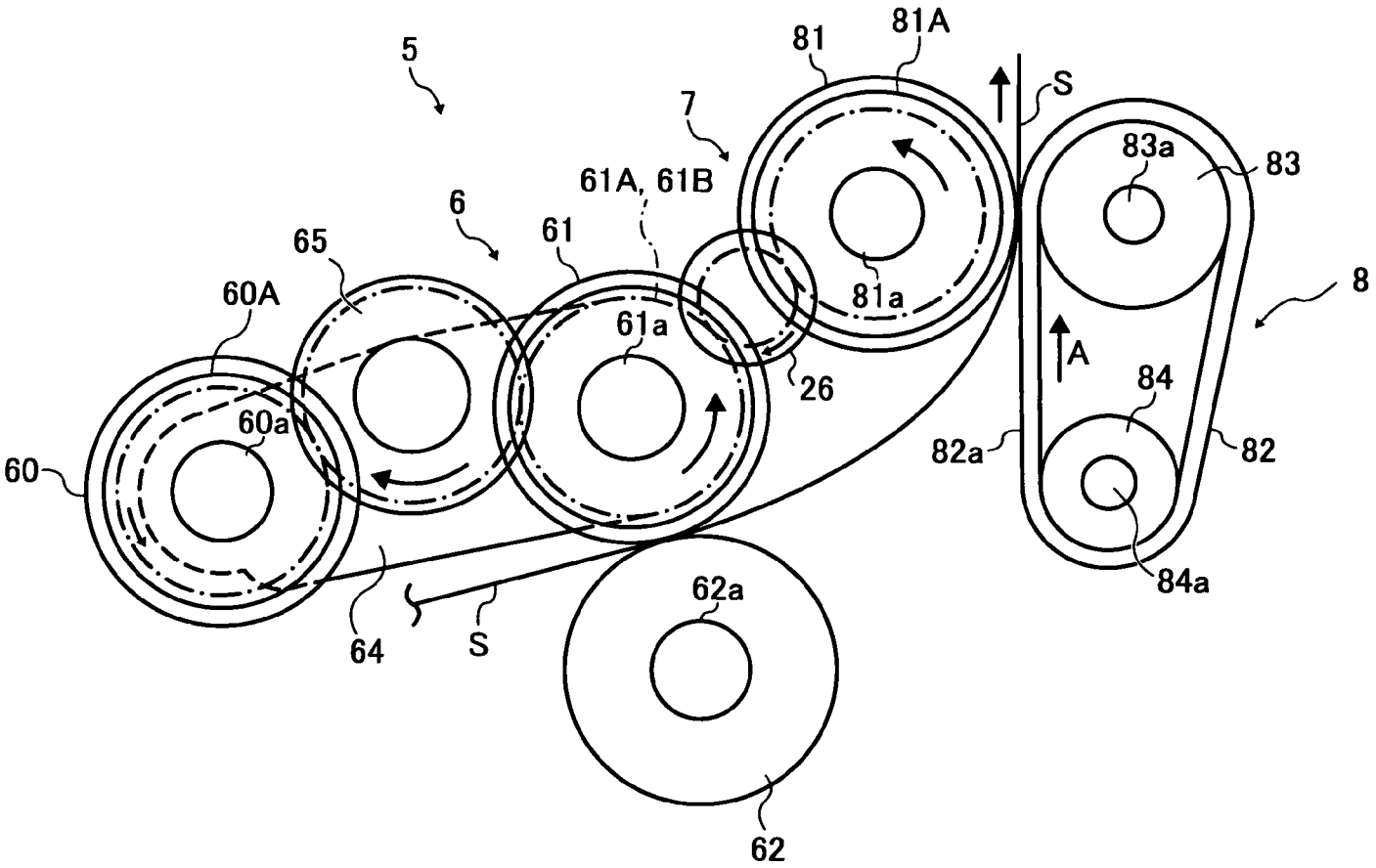
FIG. 5 is a schematic front view of relevant parts of the driving mechanism of FIG. 4.

As shown in FIGS. 4 and 5, the sheet conveying device 5 further includes a driving mechanism 22 that drives the grip roller 81. The driving mechanism 22 primarily includes a sheet feeding motor 23, a motor gear 24, an idler gear 25, a feed roller driving gear 61B, an idler gear 26, a grip roller driving gear 81A, a feed roller gear 61A, an idler gear 65, and a pickup roller gear 60A.

The sheet feeding motor 23 is a stepping motor serving as the only driving source or driving unit.

The motor gear 24 is fixed on an output shaft of the sheet feeding motor 23.

The idler gear 25 is engaged with the motor gear 24.

The feed roller driving gear 61B is engaged with the idler gear 25 and fixed to one end of the shaft 61*a* of the feed roller 61.

The idler gear 26 is engaged with the feed roller driving gear 61B.

The grip roller driving gear 81A is engaged with the idler gear 26 and fixed to one end of the rotational driving shaft 81*a* of the grip rollers 81.

The feed roller gear 61A is fixed to the other end of the shaft 61*a* near the feed roller 61.

The idler gear 65 is engaged with the feed roller gear 61A.

The pickup roller gear 60A in engagement with the idler gear 65 and fixed to the other end of the shaft 60*a* near the pickup roller 60.

The sheet feeding motor 23 is fixed to the housing 80. The idler gears 25, 26, and 65 are rotatably supported by the housing 80.

As described above, the sheet conveying device 5 according this example embodiment can be compact and space-saving by making the first conveying path PA have a curved section of a relatively small curvature radius as later described in reference to FIGS. 5 and 6. The sheet feeding motor 23 is the only driving source provided for driving both the first conveying unit 6 and the second conveying unit 7, which also contributes in reducing the size of the device.

The reverse roller 62 may be driven by a different system including, for example, a solenoid for releasing pressure from the feed roller 61.

As shown in FIG. 4, the sheet conveying device 5 further includes the torque limiter 62*b*.

In the example shown in FIGS. 1 through 5, the rotating and driving relationship between the pickup roller 60 and the feed roller 61 is described only briefly. In reality, as shown in an enlarged view of FIG. 5, the respective shafts 60*a* and 61*a* of the pickup roller 60 and the feed roller 61, respectively, may be connected by a pickup arm member 64. Accordingly, for the pickup action, a combination of a solenoid, not shown, and a spring, not shown, causes the pickup roller 60 to pivot or move about the shaft 61*a* of the feed roller 61 via the pickup arm member 64.

In the actual driving mechanism 22, there are many driving force transmitting members such as gears and timing belts disposed between the sheet feeding motor 23 and the feed roller 61. However, the example of the driving mechanism 22 is shown only schematically in FIGS. 4 and 5 for the sake of clearly indicating that the grip rollers 81 serve as rotating and conveying driving members.

In addition, the conveyor belt 82 of the belt conveying unit 8 directly contacts the grip roller 81 serving a rotating and conveying driving member that is rotated by the driving mechanism 22, so that the conveyor belt 82 can rotate following the rotation of the grip roller 81. Variations in the linear velocity of the conveyor belt 82 can be further reduced by driving the grip roller 81, compared to the case in which the conveyor belt 82 is driven. Therefore, the following advantages can be achieved by arranging the conveyor belt 82 along the outer side of the turning or curved section of the first conveying path PA. The conveyor belt 82 may rotate toward the holding section of the second conveying unit 7. That is, it is possible to enhance sheet conveying properties for conveying relatively rigid sheets such as cardboard at the turning section of the first conveying path PA. Furthermore, by causing the conveyor belt 82 to rotate following the rotation of the grip roller 81 that faces and directly contacts the conveyor belt 82, the sheet S can be conveyed at a steady linear velocity beyond the second conveying unit 7.

These advantages and effects are easily understandable by considering the following technique.

If the grip roller 81 is driven, the linear velocity of the grip roller 81 may be determined by the outside diameter of the grip roller 81 and the rotational speed. Conversely, in order to drive the conveyor belt 82, it is usually necessary to drive the roller-type pulley 83 (belt driving roller, main pulley) provided inside the conveyor belt 82.

In this case, the linear velocity of the conveyor belt 82 is determined not only by the outside diameter and the rotational speed of the pulley 83 provided inside the conveyor belt 82. The linear velocity may also be affected by variations in the thickness of the conveyor belt 82 caused by variations in components, change in the thickness of the conveyor belt 82 caused by attrition, or slipping actions between the conveyor belt 82 and the pulley 83. Therefore, variations in the linear velocity of the conveyor belt 82 can be further reduced by driving the grip roller 81 rather than driving the conveyor belt 82.

If the effects of the above-described example embodiment are not particularly desired, the driving system for driving the grip roller 81 can be removed from the driving mechanism 22 to make the grip roller 81 serve as the subordinate side, and the conveyor belt 82 can be driven with a driving mechanism, not shown.

As shown in FIGS. 2 and 3, a conveying guiding member 70 is positioned in the inner area of the sheet conveying device 5, including a curved guide surface 70*a* swelling in a substantially downward direction with which the sheet S comes in contact. The conveying guide member 71 is positioned in the outer area of the sheet conveying device 5, including the guide surface 71*a* curved in a caved-in or concave shape in accordance with the conveying guiding member 70. Furthermore, the conveying guide member 71 is spaced apart with a given gap from the guide surface 70*a* of the conveying guiding member 70. The conveying guiding members 70 and 71 are both fixed to the housing 80. Accordingly, the first conveying path PA is formed between the first conveying unit 6 and the second conveying unit 7, by arranging the guide surface 70*a* of the conveying guide member 70, the guide surface 71*a* of the conveying guide member 71 facing the conveying guiding member 70, and the conveying guiding surface 82*a* of the conveyor belt 82 as described above.

As shown in FIGS. 2 and 3, the conveying guide member 72 is positioned along the outer side of the vertical conveying path extending substantially upward from the second conveying unit 7. A conveying guide member 73 may provide a sheet conveying path from the sheet feeding cassette 51 to the holding section or nip section between the feed roller 61 and the reverse roller 62, and provide an inlet for guiding the sheet S into the nip section. Accordingly, the vertical conveying path communicating with or connected to the sheet conveying path R1 is formed by the vertical conveying guide surface of the conveying guide member 72 and the guide surface 70*a* of the conveying guiding member 70. The curved surface or guide surface 70*a* of the conveying guiding member 70 may swell in a substantially downward direction (toward the conveying guide member 71 provided on the outer side), beneath a line connecting the nip sections of the first conveying unit 6 and the second conveying unit 7. The degree of swelling is defined so that the sheet S can moderately bend to ensure that the leading edge of the sheet S reaches the conveying surface 82*a*.

As shown in FIG. 1, the configuration of the upper stage of the sheet feeding device 3 is the same as that of a known technique. The difference from the lower stage described above is that a sheet conveying device 5' is employed instead of the sheet conveying device 5. The sheet conveying device 5' is different from the sheet conveying device 5 in that the sheet conveying device 5 employs a second conveying unit 7' instead of the second conveying unit 7. The second conveying unit 7' is different from the second conveying unit 7 in that the second pair of rotating and conveying members only includes the grip roller 81 and a subordinate roller that is caused to rotate following the rotation of the grip roller 81, which is practically the same size and shape as the pulley 83. The sheet feeding cassette 51 of the upper stage and the sheet conveying device 5' can be used for sheets S of a relatively low rigidity such as plain paper and not for sheets S of a relatively high rigidity such as cardboard or envelopes.

Next, a description is given of a sheet feeding operation of feeding a sheet S from a given stage in the sheet feeding device 3 and a conveying operation of conveying the sheet S of the sheet conveying device 5 that starts in conjunction with the sheet feeding operation.

As shown in FIG. 2, the sheets S stacked on the bottom plate 50 may be raised by the pivoting and rising movement of the rising arm 52 so that the topmost face can be located at a given height. First, the pickup roller 60 rotates to extract the topmost sheet S, and sends the topmost sheet S to the sheet feed separating mechanism including the feed roller 61 and the reverse roller 62. In the sheet feed separating mechanism, the feed roller 61 and the reverse roller 62 may cooperate with each other to separate only the topmost sheet from the others. The separated sheet S may be conveyed to the downstream side of the sheet conveying path. As shown in FIG. 2, the leading edge of the sheet S may be guided and moved as the conveyor belt 82 travels in the direction indicated by the arrow while being kept in contact with the belt conveying surface 82*a*. When the leading edge of the sheet S reaches the nip section between the grip roller 81 and the conveyor belt 82, the grip roller 81 and the conveyor belt 82 may hold the sheet S and convey the sheet S further vertically upward, and finally send out the sheet S in a vertical manner.

More specifically, the leading edge of the sheet S is held by the nip section of the feed roller 61 and the reverse roller 62, sent out from the nip section, and then reaches the belt conveying surface 82*a* of the conveyor belt 82.

As shown in FIGS. 2, 3, 5 and 6, as the conveying surface 82*a* may move in the sheet conveying direction by the movement of the conveyor belt 82 in the direction indicated by an arrow "A", the sheet S may gradually bend starting from the leading edge thereof. As the sheet S bends further, the contact area between the belt conveying surface 82*a* and the face of the sheet S may become larger. Hence, even if the sheet S is a highly rigid sheet, a sufficient amount of conveying and propelling force can be applied from the belt conveying surface 82*a* to the face of the sheet S face in order to convey the sheet S in the sheet conveying direction. When conveyance resistance is generated while the highly rigid sheet S is being conveyed and considerably bent, the conveying and propelling force applied to the sheet S by the first conveying unit 6 alone may be insufficient for conveying the sheet S. This insufficiency can be thoroughly compensated for by the conveying and propelling force applied to the sheet S from the belt conveying unit 8. Thus, it is possible to prevent conveyance failures of the sheet S at least between the first conveying unit 6 and the second conveying unit 7 so that the leading edge of the sheet S can reach the nip section of the second conveying unit 7.

The conveying surface 82*a* of the conveyor belt 82 may continuously extend t6 the nip section of the second conveying unit 7, thus ensuring that the leading edge of the sheet S in contact with the conveying surface 82*a* smoothly and constantly reaches the holding section or nip section. More specifically, a highly rigid sheet S being conveyed by the first conveying unit 6 may be caused to bend moderately so that the leading edge of the sheet S can surely contact the belt conveying surface 82*a*. The belt conveying surface 82*a* may apply an active conveying and guiding effect to the leading edge of the sheet S in contact thereto. Accordingly, the sheet S may receive a second conveying and propelling force from the belt conveying surface 82*a* for moving in the sheet conveying direction. Subsequently, the sheet S may be caused to bend even further so as to reach the holding section of the second conveying unit 7.

After the leading edge of the sheet S has reached the second conveying unit 7, the sheet S is held and conveyed by both the first conveying unit 6 and the second conveying unit 7. Thus, a sufficient amount of conveying force may be applied to the sheet S from both the first conveying unit 6 and the second conveying unit 7. Therefore, it is possible to continue to convey the highly rigid sheet S in a smooth manner. After the trailing edge of the sheet S has been separated from the first conveying unit 6, the sheet S can no longer receive a conveying force from the first conveying unit 6. However, this loss may be compensated for by the conveying and propelling force from the belt conveying surface 82*a* applied once again to the sheet S, depending on how the sheet S is contacting the belt conveying surface 82*a* between the holding section of the second conveying unit 7 and the trailing edge.

Furthermore, the sheet S may gradually become less bent. Therefore, it is possible to continue to convey the sheet S even after the trailing edge of the sheet S has been separated from the first conveying unit 6. Accordingly, in the sheet conveying device 5, it is ensured that the sheet S from the first conveying unit 6 is steadily sent to the second conveying unit 7 and then to the downstream sheet conveying path, regardless of the rigidity of the sheet S.

As described above, the belt conveying unit 8 is disposed along the outer side of the first conveying path PA formed between the first conveying unit 6 and the second conveying unit 7. The belt conveying unit 8 may serve as the moving and guiding unit for moving and guiding the sheet S toward the second conveying unit 7 while keeping the leading edge of the sheet S in contact with the belt.

In this example embodiment, the belt conveying unit 8 serving as the moving and guiding unit may also have a function of changing, with the conveyor belt 82, the conveying direction of the sheet S into a direction toward the holding section or nip section of the second holding unit 7.

Figure 6:
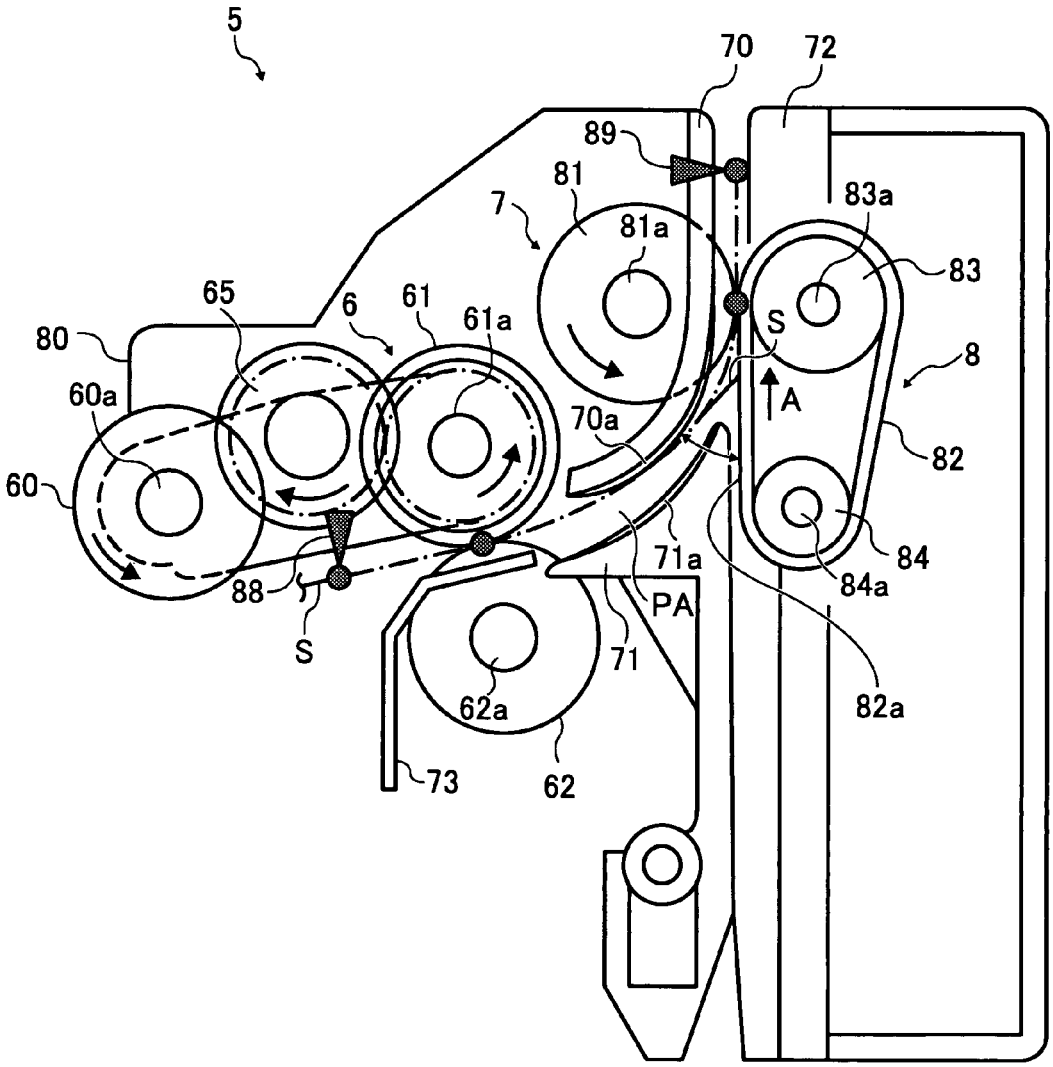
FIG. 6 is an enlarged cross-sectional view of relevant parts, with one conveying path, of the sheet conveying device of FIG. 2.
Figure 7:
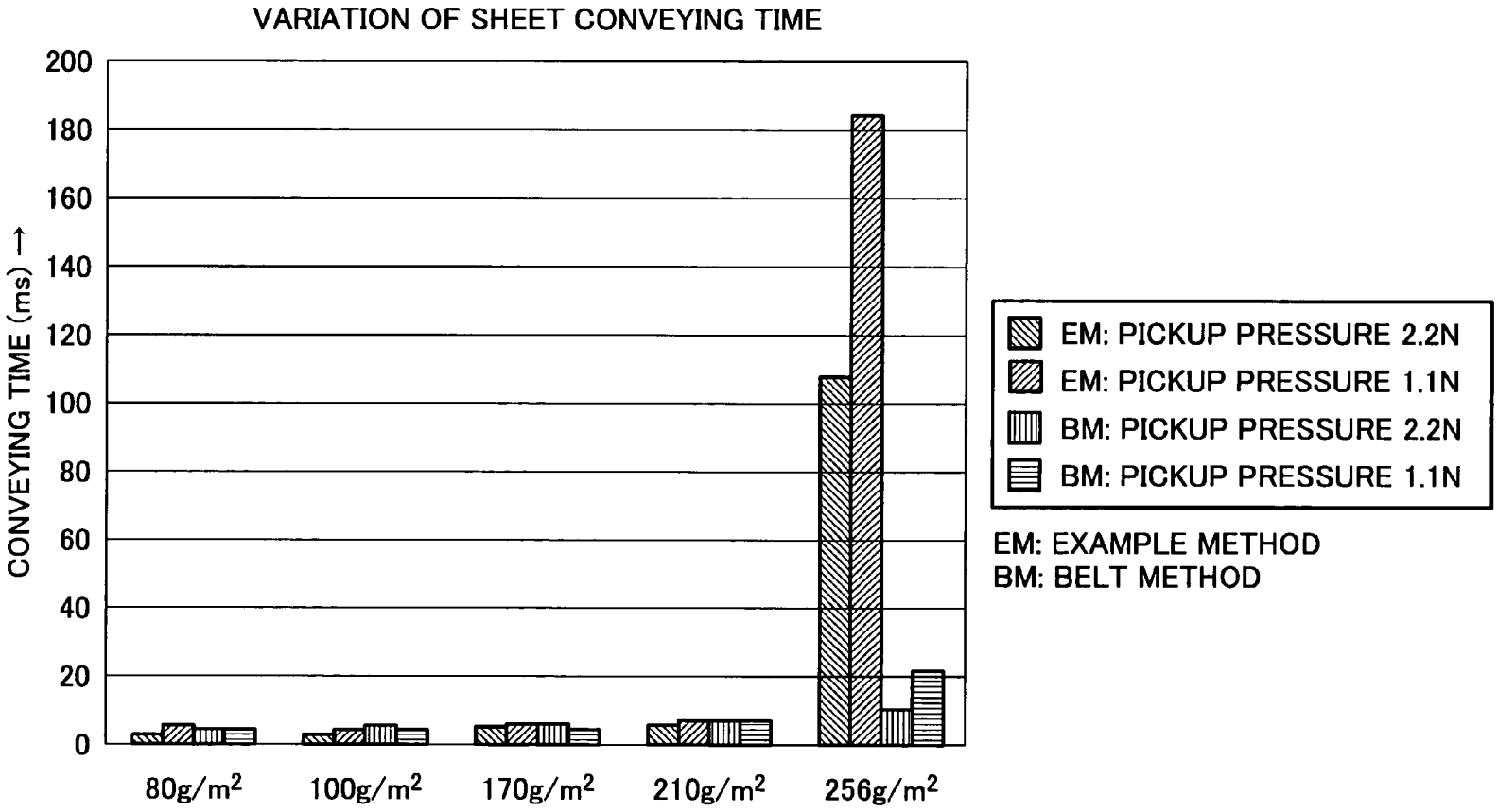
FIG. 7 is a graph showing test results indicating the variation in conveying time with the sheet conveying device of FIG. 2.

Next, referring to FIGS. 6 and 7, results of a comparative test on this example embodiment of the present invention is described.

A comparative test was conducted to compare the sheet conveying or passing properties of a copier according to the example embodiment to which the present invention is applied (indicated as "BELT METHOD" in Table 1) and a copier according to a known method (indicated as "EXAMPLE METHOD" in Table 1).

Among the components of "imagio Neo453" manufactured by RICOH, only a sheet feeding device was modified to be used for the "BELT METHOD" of this comparative test. The modified sheet feeding device used for the "BELT METHOD" basically has the same configurations and specifications as that of the sheet conveying device 5 of the sheet feeding device 3 shown in FIGS. 1 through 5.

For the "EXAMPLE METHOD", "imagio Neo453" manufactured by RICOH including a sheet feeding device with a known sheet conveying device was used. Specifically, the known sheet conveying device corresponds to the sheet conveying device 5' of the sheet feeding device 3 shown in FIG. 1. That is, the sheet conveying device for "EXAMPLE METHOD" is different from the sheet conveying device for "BELT METHOD" according to the above-described example embodiment in reference to FIGS. 1 through 5, and includes the roller-type pulley 83 to be the only rotating conveying member facing and contacting the grip roller 81 and does not include the conveyor belt 82 and the roller-type pulley 84.

Details of the belt conveying unit 8 and peripheral components used for this comparative test in the belt method are described below (components commonly applied to the example method can be included as well):

Material of conveyor belt 82: ethylene propylene rubber (EPDM);

Hardness of conveyor belt 82: JIS K6253 A type 40 degrees;

Frictional coefficient of conveyor belt 82 with respect to sheet: 2.6;

Thickness of conveyor belt 82: 1.5 mm;

Diameter of pulley 83: 13 mm;

Diameter of pulley 84: 7 mm;

Gap or distance between pulleys 83 and 84: 13 mm (distance between axes of pulley shafts 83*a* and 84*a*);

Extension factor of conveyor belt 82: 7%; and

Diameter of rollers 60, 61, 62, and 81: all 20 mm.

As the basic test conditions, the weight of a sheet (meter basis weight) was employed to represent the stiffness (rigidity) of the sheet. Six types of sheets with different weights were passed through the above copies from sheet feeding trays corresponding to the same stages under an environment of normal temperature (23 degree Celsius, relative humidity 50%). Other test conditions described below with reference to FIG. 6 were also applied, to test differences in conveying time between the different types of sheets. The test results indicating the differences in conveying time are shown in FIG. 7, and Table 1 indicates a summary of the sheet passing properties based on the test results shown in FIG. 5.

In reference to FIG. 6, a sheet feeding sensor 88 detects the leading edge of the sheet S picked up by the pickup roller 60, and a vertical conveyance sensor 89 detects the leading edge of the sheet S conveyed by the second conveying unit 7 for "BELT METHOD" or the pair of the grip roller 81 and the roller-type pulley 83 for "EXAMPLE METHOD". The sheet feeding sensor 88 and the vertical conveyance sensor 89 are both reflection type photo-sensors.

The conveying path length (sheet conveying distance) between the positions at which the sheet feeding sensor 88 and the vertical conveyance sensor 89 are disposed is 57 mm for both in the belt method and the example method. The conveying path length between the position at which the sheet feeding sensor 88 is disposed and the nip section between the feed roller 61 and the reverse roller 62 is 10 mm. The conveying path length between the nip section between the feed roller 61 and the reverse roller 62 and the nip section of the second conveying unit 7 for "BELT METHOD" or between the nip section between the feed roller 61 and the reverse roller 62 and the nip section between the grip roller 81 and the roller-type pulley 83 for "EXAMPLE METHOD" is 38 mm for both methods. And, the conveying path length between the nip section of the second conveying unit 7 for "BELT METHOD" and the position where the vertical conveyance sensor 89 is disposed or between the nip section between the grip roller 81 and the roller-type pulley 83 for "EXAMPLE METHOD" and the position where the vertical conveyance sensor 89 is disposed to 9 mm for both methods. Accordingly, the total conveying path length is 57 mm for both methods.

The curvature radius at the center of the curved sheet conveying path or first conveying path PA between the first conveying unit 6 and the second conveying unit 7 of the sheet conveying device 5 is 20 mm for both the belt method and the example method.

For both the belt method and the example method, tests were conducted for two different values of a parameter including the pickup pressure or sheet feeding pressure of the pickup roller 60, namely 1.1N and 2.2N. The linear speed of both the feed roller 61 on the driving side and the grip roller 81 on the driving side was 154 mm/s. The time required for the leading edge of the sheet S to be conveyed from the sheet feeding sensor 88 to the vertical conveyance sensor 89, corresponding to 57 mm of the conveying path, was measured for five different types of paper with an oscilloscope. Results indicating differences between the conveyance times between different types of paper are shown in a graph of FIG. 7.

The test results in FIG. 7 show that in the example method, if the sheet is 256 g/m$^2$ basis weight or more, the conveyance time considerably changes or becomes long, and the sheet is caused to slip considerably. Meanwhile, in the belt method to which the present invention is applied, even if the sheet is 256 g/m$^2$ basis weight or more, the conveyance time changes only scarcely or does not become as long as the example method, and the sheet is caused to slip only scarcely. Furthermore, if the pickup pressure is reduced, the conveying force decreases. However, in the belt method to which the present invention is applied, the conveying force may not be affected as much even if the pickup pressure is reduced. This means that the pickup pressure can be made smaller by employing the belt method to which the present invention is applied, and therefore, the power of the driving motor can be reduced. As a result, the apparatus can be made compact.

Table 1 summarizes the sheet passing properties based on the test results shown in FIG. 7.

In Table 1, "meter basis weight" corresponds to the weight (grams) of a sheet per one square meter. In general, a sheet with a small meter basis weight is "light paper" or "thin paper", and a sheet with a large meter basis weight is "heavy paper" or "thick paper."

In the first test results shown in Table 1, "GOOD" indicates that "sheet passing property is good."Specifically, "GOOD" means that the leading edge of the sheet S reached the vertical conveyance sensor 89 within a given time after the sheet feeding sensor 88 had turned on and detected the leading edge of the sheet S. Conversely, "POOR" indicates that "sheet passing property is unacceptable." Specifically, "POOR" means that the leading edge of the sheet S did not reach the vertical conveyance sensor 89 within a given time after the sheet feeding sensor 88 had turned on and detected the leading edge of the sheet S.

TABLE 1

| METER BASIS WEIGHT | EXAMPLE METHOD | BELT METHOD |
|---|---|---|
| 80 g/m$^2$ | GOOD | GOOD |
| 100 g/m$^2$ | GOOD | GOOD |
| 170 g/m$^2$ | GOOD | GOOD |
| 210 g/m$^2$ | GOOD | GOOD |
| 256 g/m$^2$ | POOR | GOOD |
| 300 g/m$^2$ | POOR | GOOD |

GOOD: sheet passing good; and
POOR: sheet passing unacceptable.

In the first test results shown in Table 1, if the paper type is 256 g/m$^2$ basis weight or more, the results were "POOR" in the example method, whereas all of the results were "GOOD" in the belt method according to the above-described example embodiment to which the present invention is applied shown in FIGS. 1 through 5.

By comparing the sheet passing and conveying properties observed in the test, the inventors have found that, in the example method, if the paper type is 256 g/m$^2$ basis weight or more, the sheet may be too stiff to bend along the curved sheet conveying path. Hence, the leading edge of the sheet S may be disadvantageously crushed against the roller-type pulley 83 that faces and contacts the grip roller 81 (see FIGS. 1 through 5).

Furthermore, tests were conducted with sheets of 256 g/m$^2$ basis weight or more with coated surfaces and uncoated surfaces to observe whether it makes a difference in sheet passing and conveying properties. However, no particular results distinguishable from those of the first test shown in FIG. 1 were obtained.

The conclusions described below can be made from the tests results observed in the above-described example embodiment. That is, when a highly rigid sheet that is 256 g/m$^2$ basis weight or more is conveyed from the first conveying unit 6 to the conveying surface 82*a* of the belt conveying unit 8 via the first conveying path PA, the following configuration can be achieved. Specifically, because the highly rigid sheet is capable of being conveyed in a rectilinear manner, various guiding members including the first conveying path PA can be made to have simplified shapes so as to reduce the conveyance load resistance, or the various guiding members can be completely omitted.

Therefore, in the sheet conveying device dedicated for conveying the sheet S with a relatively high rigidity, the essential components are the first conveying unit 6, the second conveying unit 7, and the belt conveying unit 8 (moving and guiding unit) for guiding the sheet to the second conveying unit 7 while keeping the leading edge of the sheet S in contact with the belt conveying unit 8. The belt conveying unit 8 is disposed along the outer side of the first conveying path PA (in this case, guiding members are unnecessary) formed between the first conveying unit 6 and the second conveying unit 7.

For the above-described reasons, the various guiding members forming the first conveying path PA are necessary for conveying a sheet S with a relatively low rigidity, such as plain paper (PPC). As such a PPC sheet S cannot be conveyed in a rectilinear manner compared to the case of a highly rigid sheet S such as cardboard, the various guiding members of the first conveying path PA are necessary to compensate for this disadvantage in guiding the sheet S to the conveying surface 82*a* of the belt conveying unit 8. That is, as the rigidity of the sheet S becomes lower, the sheet S moves in a less rectilinear manner. Therefore, to assist the sheet S to move in a rectilinear manner, guiding surfaces of the various guiding members in the first conveying path PA may need to have appropriate shapes so as to ensure that the leading edge of the sheet S abuts against the abdominal portion of the conveying surface 82*a* of the conveyor belt 82.

This means that the higher the rigidity of the sheet S (more meter basis weight) becomes, the more flexible the design of the shapes and positions of the various guide members including the sheet conveying path with a curved section of a relatively small curvature radius can be obtained.

The material of the conveyor belt 82 is not limited to that of the above-described comparative test. That is, the material can be, for example, chloroprene rubber, urethane rubber, or silicon rubber. The hardness of the rubber of the conveyor belt 82 can be JIS K6253 A type in a range from 40 degrees to 60 degrees (JIS: Japan Industrial Standard).

According to the results of the above-described comparative test, the sheet conveying device 5 shown in FIGS. 1 through 6 and the copier 1 including the sheet conveying device 5 can provide a configuration thereof that is compact, space-saving, simple, low-cost, and capable of conveying various sheet types. The basic configuration can be made by adding the belt conveying unit 8 provided with a conveyor belt stretched around rollers including one of the second conveying unit 7, and a driving source dedicated to the belt conveying unit 8 can be omitted. Therefore, it is possible to realize a sheet conveying device or the sheet conveying device 5 in an image forming apparatus or the copier 1 that has a simple configuration that is thus low-cost.

In the configuration provided for a known sheet conveying device, a conveyance failure may occur when a highly rigid type of sheet is conveyed. The failure can be caused by a large conveyance resistance generated as the sheet contacts the conveying guiding member 70, or by a conveyance load in the first conveying path PA between the first conveying unit 6 and the second conveying unit 7. However, the sheet conveying device 5 according to this example embodiment of the present invention can convey highly rigid sheets without failures, and can thus convey various sheet types.

Specifically, the known configuration merely provides a fixed member for guiding a sheet, and thus does not eliminate the sheet difference between the conveyed sheet, which is a mobile object, and the fixed guiding member. As a result, a conveyance resistance is constantly generated.

On the contrary, in the sheet conveying device 5 and the copier 1 according to this example embodiment of the present invention, the conveyance resistance can be substantially completely eliminated. In addition, the sheet can be guided by actively applying a conveying and propelling force to move the sheet in the downstream direction or the conveying force of the second conveying unit 7 may be applied to the sheet in addition to the conveying force of the first conveying unit 6 so as to counter the conveyance load in the first conveying path PA between the first conveying unit 6 and the second conveying unit 7 and move the sheet in the downstream direction.

In the sheet conveying device 5, the frictional resistance between the sheet S and the conveyor belt 82 may not obstruct the sheet S from being conveyed. Further, the frictional resistance may function as a negative resistance to apply a conveying and propelling force to the sheet S. That is, the frictional resistance may not obstruct the sheet S from being conveyed, but may be converted into an advantageous negative resistance to apply a conveying and propelling force to the sheet S.

Furthermore, in the conveying direction of the sheet S, as the leading edge of the sheet S abuts against the moving surface or conveying surface of the conveyor belt 82 and is then conveyed forward by the conveyor belt 82, the leading edge of the sheet S gradually may overlap the moving surface of the conveyor belt 82, even though there may be differences according to the rigidity of the sheet type. As a result, the area of the sheet in contact with the moving surface of the belt gradually can increase. Thus, the resistance between the sheet and the moving surface of the conveyor belt 82 may increase as the contact area increases. Therefore, an even larger conveying and propelling force for moving the sheet S in the conveying direction can be applied from the conveyor belt 82 to the sheet S. Further, the conveyor belt 82 can change the direction of the sheet S in a direction toward the nip section between the grip roller 81 and the conveyor belt 82. This configuration can ensure a steady increase of the conveying and propelling force transmitted from the moving surface or conveying surface of the conveyor belt 82 to the sheet surface.

Therefore, even if the sheet S is highly rigid, it is possible to overcome this rigidity and appropriately deform or bend the sheet S in its thickness direction, and thereby ensuring that the sheet S is steadily conveyed toward the holding section of the second conveying unit 7 in the downstream direction. In this manner, it is possible to address the factors of major conveyance failures caused by the fact that the sheet S is highly rigid. Therefore, it is ensured that the sheet S can be steadily conveyed after the leading edge of the sheet S reaches the holding section of the second conveying unit 7. As a result, the sheet conveying device 5 can convey various types of sheets and achieve excellent sheet conveyance properties.

Figure 8:
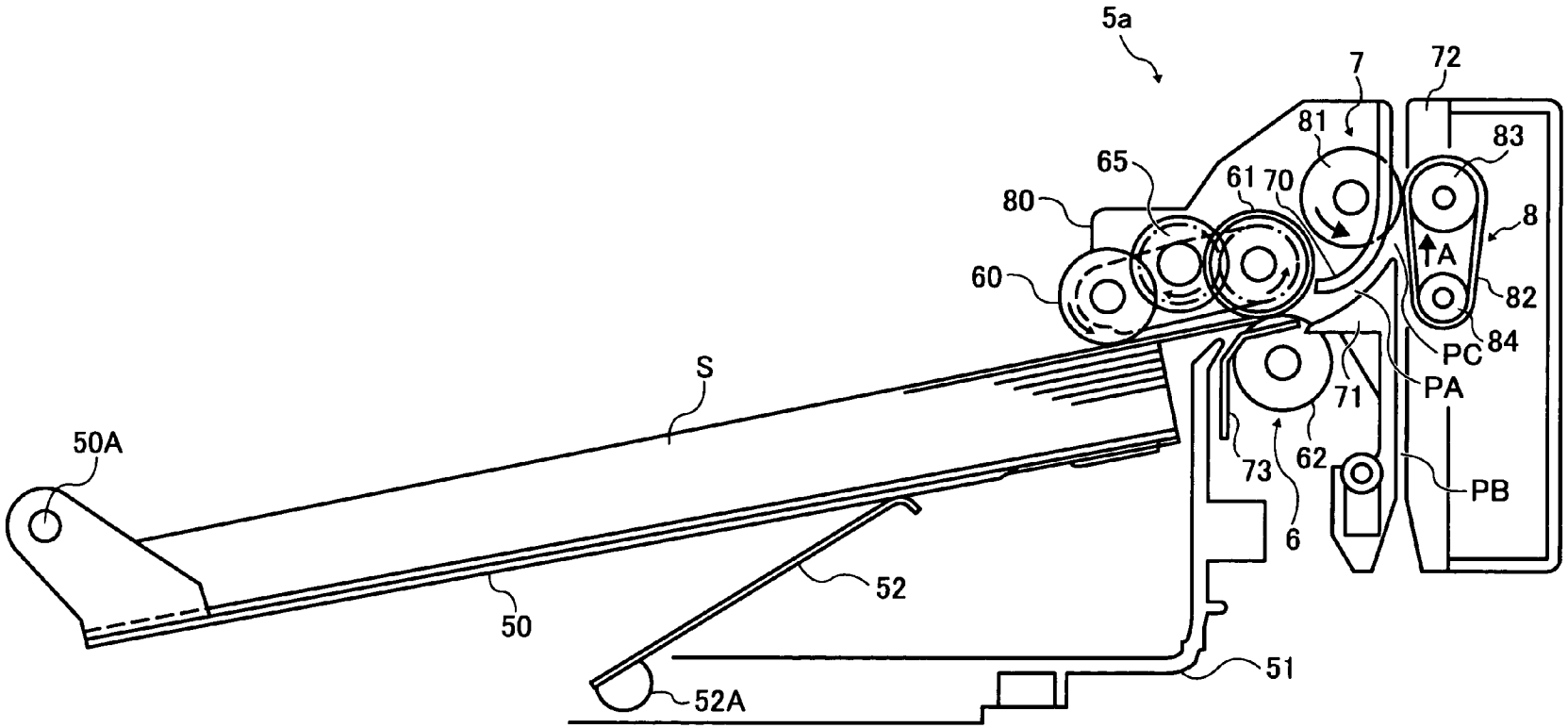
FIG. 8 is a cross-sectional view of another sheet conveying device according to an example embodiment of the present invention.
Figure 9:
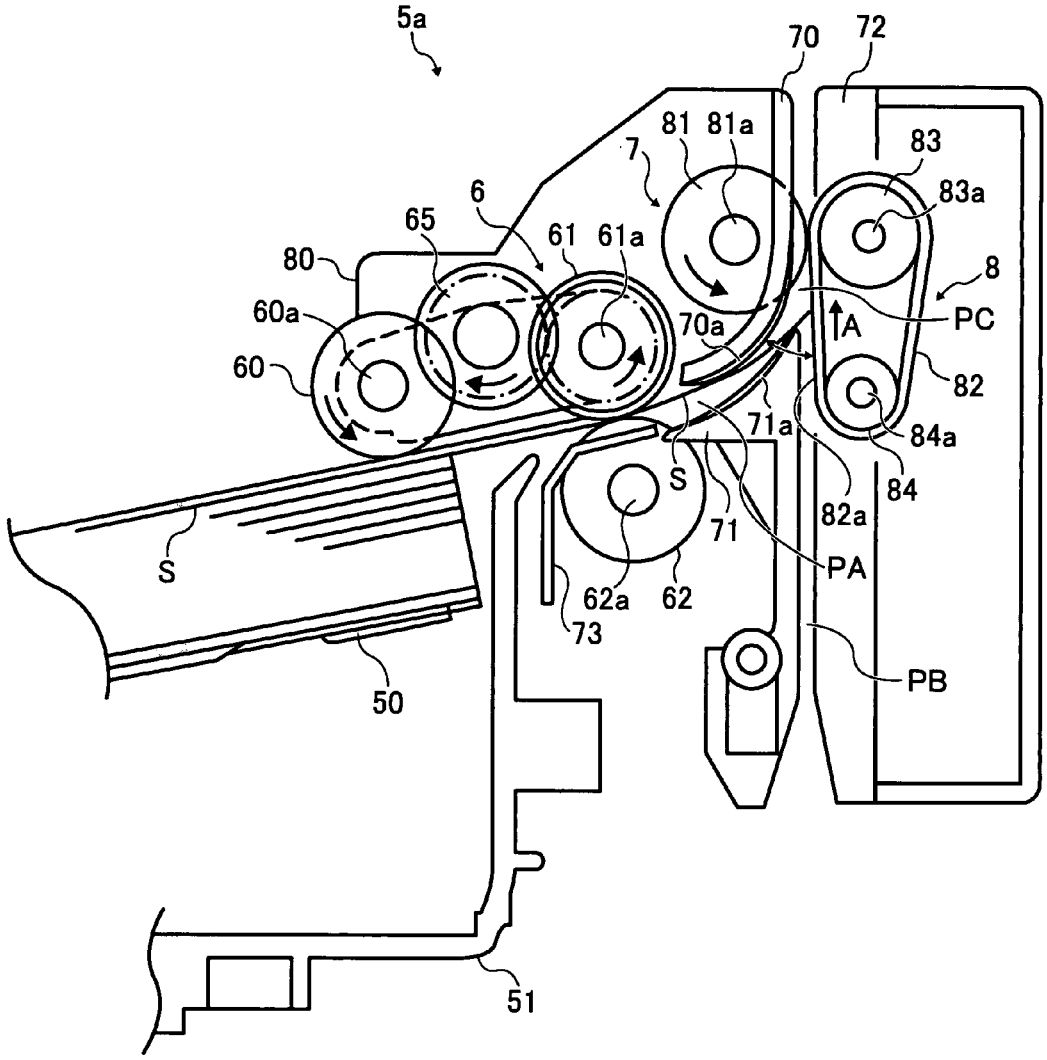
FIG. 9 is an enlarged cross-sectional view showing one state of the sheet conveying device of FIG. 8.
Figure 10:
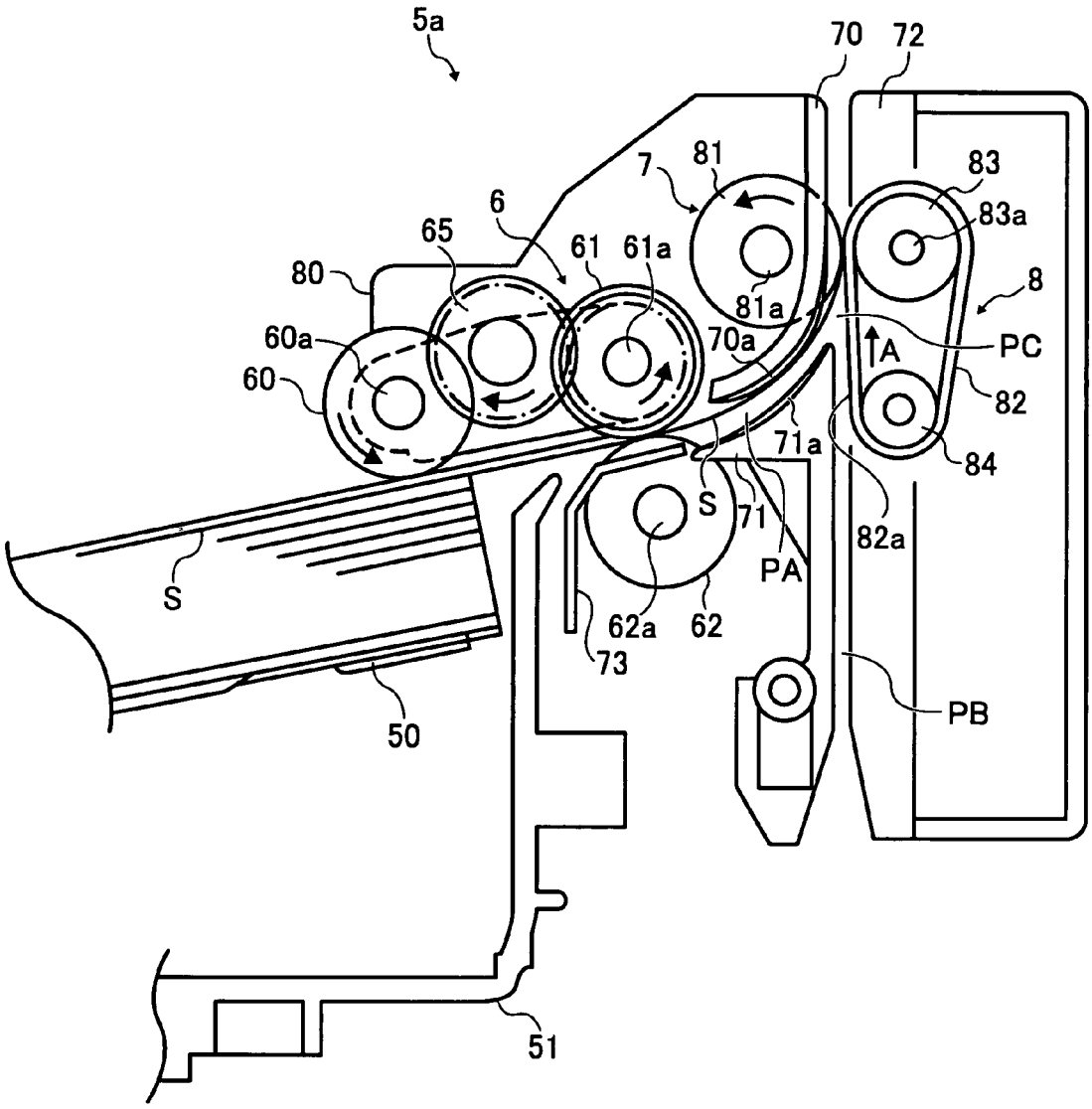
FIG. 10 is an enlarged cross-sectional view showing another state of the sheet conveying device of FIG. 8.

Referring to FIGS. 8 through 10, schematic configuration and functions of a sheet conveying device 5*a* according to an example embodiment of the present invention is described.

Elements and members corresponding to those of the sheet conveying device 5 shown in FIGS. 1 through 6 are denoted by the same reference numerals and descriptions thereof are omitted or summarized. Although not particularly mentioned, configurations of the sheet conveying device, etc., and operations that are not particularly described in this example embodiment are the same as those of the sheet conveying device 5 of the example embodiment previously described with reference to FIGS. 1 through 6.

The main differences between the sheet conveying device shown in FIGS. 1 through 6 according to the previously described example embodiment and the sheet conveying device 5*a* shown in FIGS. 8 through 10 according to this example embodiment are as follows.

In addition to the first conveying path PA serving as a first sheet conveying path formed between the first conveying unit 6 and the second conveying unit 7, a second conveying path PB serving as a second sheet conveying path is provided. The second conveying path PB, which is different and separate from the first conveying path PA, may extend from an upstream position of the second conveying unit 7 to the second conveying unit 7. The first conveying path PA and the second conveying path PB may merge at an upstream side of the second conveying unit 7, thereby forming a common conveying path PC. The belt conveying unit 8, which is one of the members of the second conveying unit 7, is disposed along the outer side of the first conveying path PA and the second conveying path PB. Apart from these differences, the sheet conveying device 5*a* according to this example embodiment, described in reference to FIGS. 8 through 10, is the same as the sheet conveying device 5 according to the previously described example embodiment, in reference to FIGS. 1 through 6.

That is, the pulley 84 around which the conveyor belt 82 is stretched in the belt conveying unit 8. The pulley 84 is one member of the pair of roller-type pulleys 83 and 84, axially rotatably supported by the housing 80, and disposed beneath the pulley 83 with a space therebetween. Therefore, it can be ensured that the leading edge of the sheet S conveyed by the first conveying unit 6 into the first conveying path PA abuts against the conveying surface 82*a* of the conveyor belt 82, and that the sheet S conveyed along the second conveying path PB by a conveying unit, not shown, is not obstructed from reaching the second conveying unit 7.

Next, conveying operations of the sheet conveying device 5*a* according to this example embodiment are described.

The sheet S is extracted and conveyed from a stack of sheets stacked horizontally in the sheet feeding cassette 51. Therefore, the sheet conveying direction in the sheet feed separating mechanism of the first conveying unit 6 is a substantially horizontal direction. Subsequently, the sheet S is conveyed upward an image forming section of the main body 2 of the copier 1 positioned above. Therefore, the sheet S may need to be conveyed in a substantially vertical and upward direction, which is orthogonal or perpendicular to the substantially horizontal direction.

Thus, as shown in FIG. 9, after the sheets S have been separated one by one in the sheet feed separating mechanism, the sheet S may bend moderately while being conveyed to reduce the conveyance resistance, and then the leading edge of the sheet S may abut against the conveyor belt 82.

The conveyor belt 82 may move in a substantially vertically upward direction or substantially directly upward direction as indicated by an arrow "A" in FIGS. 8, 9, and 10. The leading edge of the sheet S abutting the conveyor belt 82 may be conveyed to the holding section or nip section between the grip roller 81 and the conveyor belt 82, and then be conveyed to the downstream side in the substantially directly upward direction by the grip roller 81 and the conveyor belt 82 while being held therebetween. As described above, a conveying and propelling force may be transmitted from the conveyor belt 82 to the sheet S for moving the sheet S in the conveying direction. Moreover, the conveyor belt 82 may change the direction of the sheet S toward the nip section between the grip roller 81 and the conveyor belt 82. Accordingly, even a highly rigid sheet S can be steadily conveyed without causing conveyance failures.

With the above-described configuration and conveying operations, the sheet conveying device 5*a* provided with the common conveying path PC shown in FIGS. 8 through 10 can provide the same effects as those of the sheet conveying device 5 shown in FIGS. 1 through 6. That is, a highly rigid sheet such as cardboard sheet can be steadily conveyed, and thereby achieving excellent sheet conveyance properties. Moreover, the sheet conveying device 5*a* of this example embodiment may have plural conveying paths, at least the first conveying path PA and the second conveying path PB, so as to be applied to a wider range of machine types.

Figure 11:
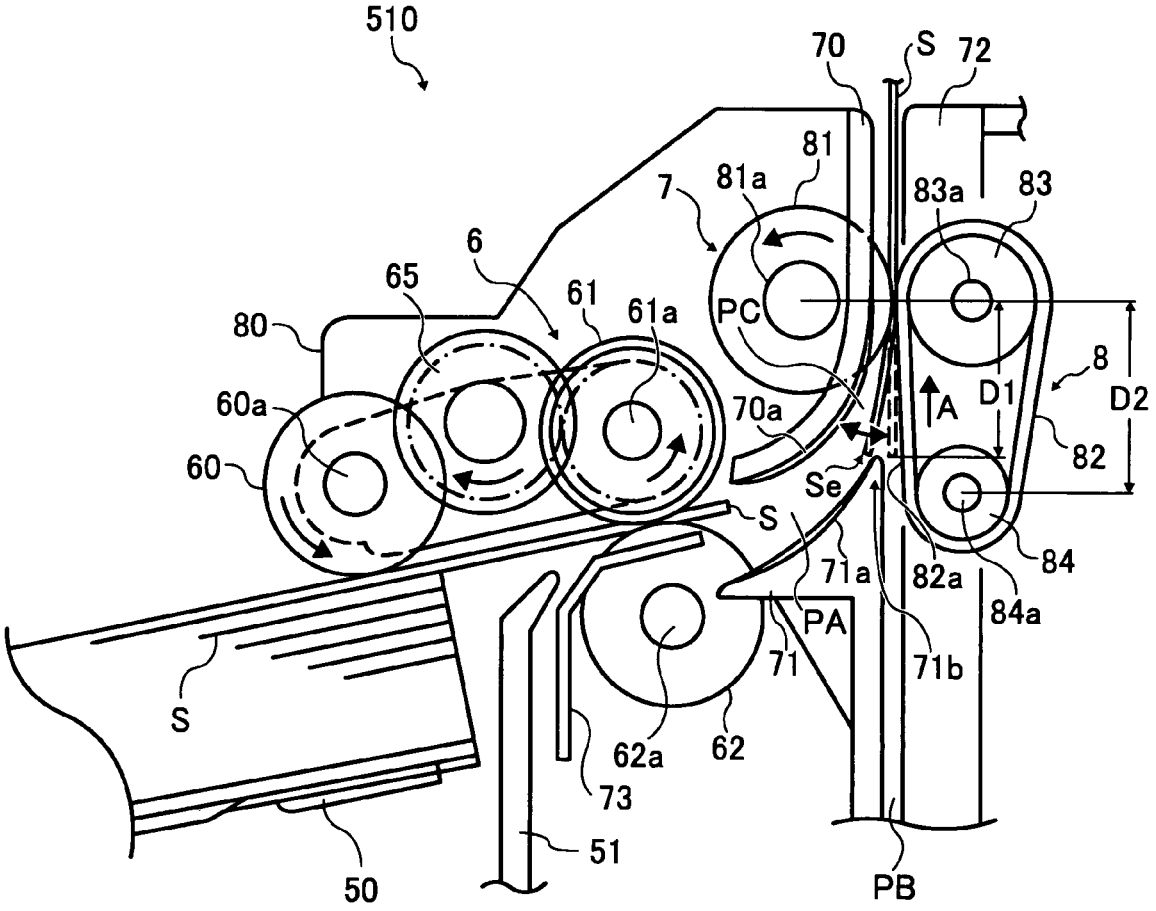
FIG. 11 is a cross-sectional view of another sheet conveying device according to an example embodiment of the present invention.

Referring to FIG. 11, a sheet conveying device 510 according to an example embodiment of the present invention is described.

The sheet conveying device 510 according to an example embodiment shown in FIG. 11 has similar structure and functions to the sheet conveying device 5 according to the above-described example embodiment, in reference to FIGS. 8 through 10. Except, the sheet conveying device 510 according to this example embodiment clearly describes relative positions of the conveying guide member 71 and the elements and members of the belt conveying unit 8 as follows.

In this example embodiment, the conveying guide member 71 is disposed at the outer side of the most downstream side of the first conveying path PA and disposed in the vicinity of the conveyor belt 82 of the common conveying path PC to which the first conveying path PA and the second conveying path PB merge. The conveying guide member 71 serves as a guide member that guides a sheet S to the conveyor belt 82.

To make the relative positions of the conveying guide member 71 and the components of the belt conveying unit 8 easily understandable, the conveying guide member 71 is illustrated or shown in FIGS. 8 through 10 at a lower position so as to make the first conveying path greater. Similar to the driving mechanism 22 previously shown in FIGS. 4 and 5, in this example embodiment, the grip roller 81 serves as the driving side, and the belt conveying unit 8 or the conveyor belt 82 and the pulleys 83 and 84 serve as the subordinate side (the same applies to the following example embodiments and modified example embodiments).

The most remarkable characteristic of the sheet conveying device 510 according to this example embodiment of the present invention is that the center of the pulley shaft 84*a* of the pulley 84 serving as a second belt holding and rotating member is disposed at an upstream side, which is lower part in FIG. 11, from a downstream end 71*b* of the conveying guide member 71 in the sheet conveying direction of the second conveying unit 7. The downstream end 71*b* of the conveying guide member 71 is a top portion having an angular or chevron shape. Hereinafter, the downstream end 71*b* is also referred to as "sheet guide outlet."

That is, the pulley 84 on the subordinate side is disposed at a position that satisfies "D1<D2", where "D1" represents a distance from the sheet guide outlet or downstream end 71*b* to the center of the pulley shaft 83*a* of the pulley 83 of the sheet conveying device 510 and "D2" represents a distance from the center of the pulley shaft 83*a* of the pulley 83 to the center of the pulley shaft 84*a* of the pulley 84 of the sheet conveying device 510.

The sheet conveying device 510 according to this example embodiment of the present invention has the same configuration and functions as those of the sheet conveying device 5 according to the previously described example embodiment, in reference to FIGS. 8 through 10, except for the above-described differences.

The conveyor belt 82 may be stretched around the pulley 83 that is rotatably supported by the pulley shaft 83*b* and the pulley 84 that is rotatably supported by the pulley shaft 84*b*, and be biased and pressed by (compression) springs, not shown, serving as elastic biasing members via a bearing, not shown, to a direction to contact with the grip roller 81 (see FIGS. 8 through 10). Therefore, a given holding pressure may be generated at the holding section or nip section of the second conveying unit 7 so as to convey the sheet S. (The same is applied to the following example embodiments and modified example embodiments.)

Therefore, with the above-described sheet conveying operation of the second conveying unit 7, when a trailing edge Se of the sheet S passes by the downstream end 71*b* of the conveying guide member 71, the trailing edge Se of the sheet S collides with the conveying surface 82*a* of the conveyor belt 82. Specifically, the trailing edge Se of the sheet S collides with the abdominal portion or tensioned portion between the pulleys 83 and 84 of the conveyor belt 82, as indicated by a dashed line shown in FIG. 11.

As shown in FIG. 11, the downstream end 71*b* of the conveying guide member 71 and the surface of the conveyor belt 82 facing the downstream end 71*b* are not disposed at the same level. In other words, there is a gap or distance between the downstream end 71*b* and the conveyor belt 82. Therefore, when the trailing edge Se of the sheet S passes by the downstream end 71*b* of the conveying guide member 71, the trailing edge Se of the sheet S may collide against the surface of the conveyor belt 82. Depending on the level of rigidity of the sheet S, an elastic restoring force of the rigid sheet S such as cardboard sheet may cause sudden and unexpected flipping noise. At this time, in this example embodiment, by arranging the pulley 84 at the upstream side from the downstream end 71*b* of the conveying guide member 71 in the sheet conveying direction of the second conveying unit 7, the trailing edge Se of the sheet S collides with the abdominal portion between the pulleys 83 and 84 of the conveyor belt 82. At this time, the elastic displacement and/or deformation caused by the collision can be absorbed to reduce the impact caused when the trailing edge Se of the sheet S collides with the abdominal portion between the pulleys 83 and 84, and thereby reducing the flipping noises.

In this example embodiment, the sheet conveying device 510 may further cause the conveyor belt 82 of the belt conveying unit 8 to include an elastic member having a relatively low rigidity, in addition to the above-described configuration shown in FIG. 11.

A preferable example of an elastic member having a relatively low rigidity is an elastic member made of ethylene propylene rubber (EPDM) with a rigidity of JIS A in a range from approximately 30 degrees to approximately 80 degrees so as to absorb and reduce the impact caused when the trailing edge Se of the sheet S collides against the conveyor belt 82. The ethylene propylene rubber (EPDM) is formed without using a base material. Typically, a belt is typically formed by attaching rubber onto a base material such as a cloth made by weaving threads. Accordingly, it is preferable to use the conveyor belt 82 including the above-described elastic member, so as to absorb and reduce the impact caused when the trailing edge Se of the sheet S collides with the conveyor belt 82 and obtain an appropriate rate of extension and contraction. The conveyor belt 82 can also be formed of urethane rubber (U), sponge rubber, etc.

By using the conveyor belt 82 including the elastic member having a relatively low rigidity as described above, the absorption of the impact caused by elastic displacement and/or deformation of the above-described conveyor belt 82 may be enhanced, and thereby reducing flipping noises. The same effect in reduction of flipping noises by using the conveyor belt 82 employing the above-described low rigid rubber can be obtained when the pulley 84 is disposed at a more downstream side of the second conveying unit 7 in the sheet conveying direction, than the position thereof shown in FIG. 11 and the trailing edge Se of the sheet S collides with or taps against the holding section of the conveyor belt 82 extended by the pulley 84. In this case, the conveyor belt 82 serves as a vibration-proofing material to absorb the impact caused by the collision with the trailing edge Se of the sheet S, and thereby reducing the flipping noises.

In this example embodiment, the sheet conveying device 510 may further cause the pulleys 83 and 84 of the belt conveying unit 8 to include an elastic member having a relatively low rigidity, in addition to the above-described configuration and the conveyor belt 82 including the above-described elastic member having a relatively low rigidity.

A preferable example of an elastic member having a relatively low rigidity for the pulleys 83 and 84 is an elastic member made of ethylene propylene rubber (EPDM) with a rigidity of JIS A in a range from approximately 30 degrees to approximately 80 degrees so as to absorb and reduce the impact caused when the trailing edge Se of the sheet S collides against the conveyor belt 82. The pulleys 83 and 84 can also be formed of urethane rubber (U), and an elastic member such as urethane resin, sponge rubber, etc.

Accordingly, the pulleys 83 and 84 that employ the above-described elastic member having a relatively low rigidity can absorb the impact caused when the trailing edge Se of the sheet S collides with or taps against the conveyor belt 82. This can further reduce the flipping noises.

Figure 12A:
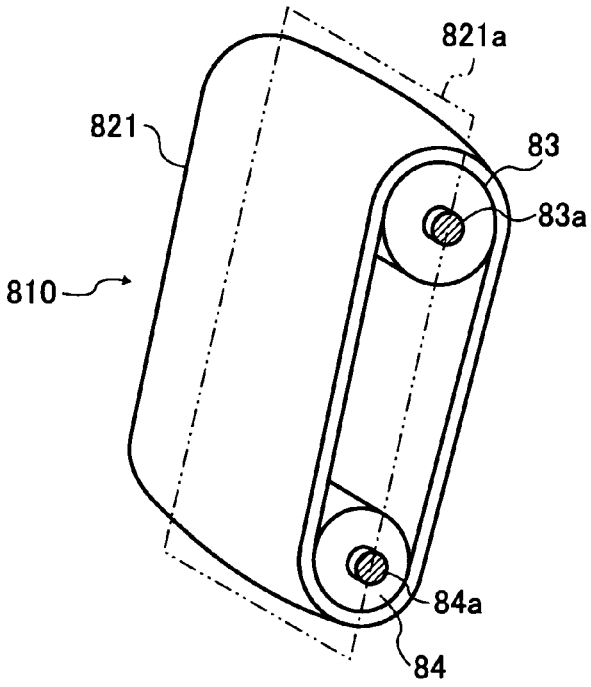
FIG. 12A is a perspective view of a modified example of a belt conveying unit of the sheet conveying device of FIG. 11.
Figure 12B:
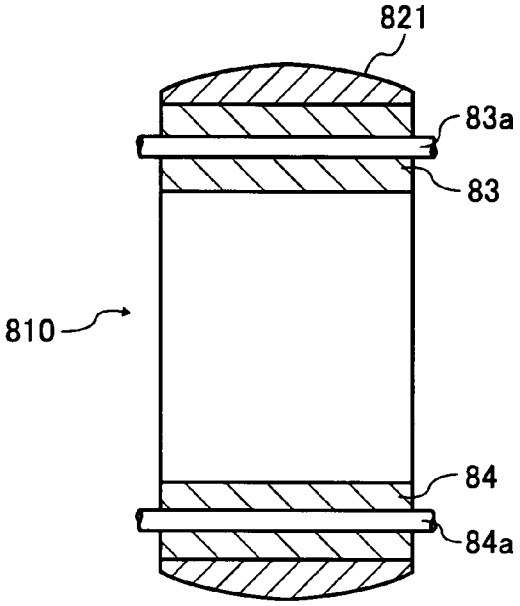
FIG. 12B is an enlarged cross-sectional view of the belt conveying unit of FIG. 12A.

Referring to FIGS. 12A and 12B, a specific structure of a belt conveying unit 810 according to a modified example embodiment of the present invention is described. The belt conveying unit 810 is modified based on the belt conveying unit 8 of the sheet conveying device 510 according to the previously described example embodiment of the present invention.

As shown FIGS. 12A and 12B, the belt conveying unit 810 of the sheet conveying device 510 includes a conveyor belt 821 instead of the conveyor belt 82 used in the belt conveying unit 8. The conveyor belt 821 basically has a same configuration and function as the conveyor belt 82 of the sheet conveying device 510 according to the example embodiment of the present invention, in reference to FIG. 11. Except, the conveyor belt 821 is bow-shaped, having an outwardly convex portion at the center thereof in the belt width direction that is the direction perpendicular to the sheet conveying direction of the second conveying unit 7, as shown in FIGS. 12A and 12B.

According to the modified example embodiment, when the trailing edge Se of a sheet S collides with or taps against the conveyor belt 821, the conveyor belt 821 having a bow-shaped center portion in the belt width direction can cause the center part of the trailing edge Se of a sheet S to firstly contact the bow-shaped center portion of a conveying surface 821*a* of the conveyor belt 821, and then the other parts of the trailing edge Se of the sheet S to gradually contact the other portions of the conveying surface 821*a* of the conveyor belt 821 in a manner that the contact area spreads from the center toward the end portions thereof. Thus, the above-described configuration of the conveyor belt 821 can avoid the phenomenon that the trailing edge Se of the sheet S contacts the center part and the other parts of the conveying surface 821*a* of the conveyor belt 821 at the same time or with no time difference. Accordingly, the conveyor belt 821 having the above-described configuration can reduce more flipping noises, compared with the conveyor belt 82 of the sheet conveying device 510.

Figure 13A:
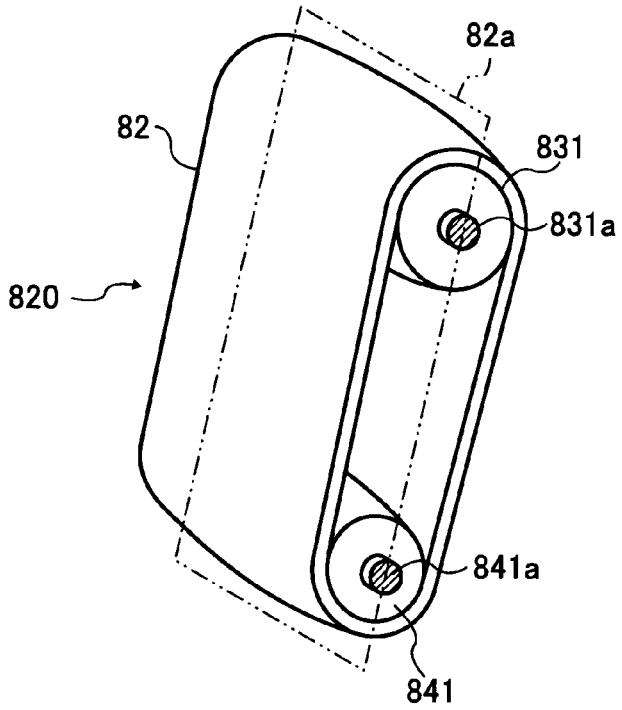
FIG. 13A is a perspective view of another modified example of the belt conveying unit of the sheet conveying device of FIG. 11.
Figure 13B:
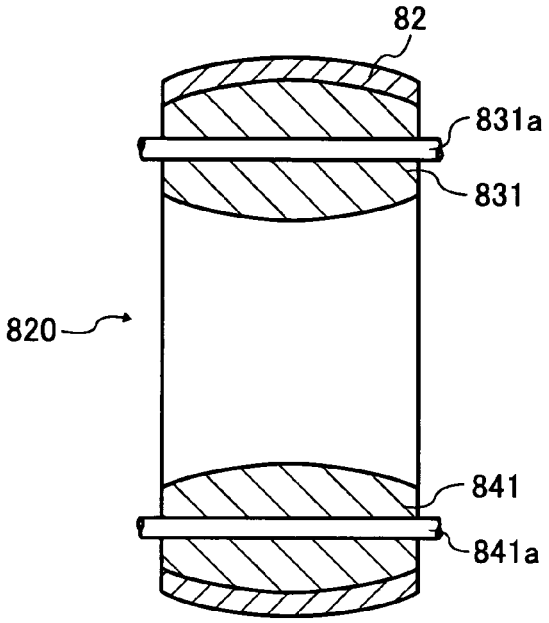
FIG. 13B is an enlarged cross-sectional view of the belt conveying unit of FIG. 13A.

Referring to FIGS. 13A and 13B, a specific structure of a belt conveying unit 820 according to another modified example embodiment of the present invention is described. The belt conveying unit 820 is also modified based on the belt conveying unit 8 of the sheet conveying device 510 according to the previously described example embodiment of the present invention.

As shown FIGS. 13A and 13B, the belt conveying unit 820 of the sheet conveying device 510 includes pulleys 831 and 841 instead of the pulleys 83 and 84 used in the belt conveying unit 8. The pulleys 831 and 841 basically have same configurations and functions as the pulleys 83 and 84, respectively, of the sheet conveying device 510 according to the example embodiment of the present invention, in reference to FIG. 11. Except, each of the pulleys 831 and 841 is bow-shaped, having an outwardly convex portion at the center thereof in the belt width direction that is the direction perpendicular to the sheet conveying direction of the second conveying unit 7, as shown in FIGS. 13A and 13B. The pulleys 831 and 841 further include pulley shafts 831*a* and 841*a*, respectively, which has same configurations as the pulley shafts 83*a* and 84*a*.

According to this modified example embodiment, when the pulleys 831 and 841 are provided with a bow-shaped center portion in the belt width direction, the center of the conveyor belt 82 that is movably supported by the pulleys 831 and 841 may also be pushed up to form a bow-shaped center portion in the belt width direction. Therefore, when the trailing edge Se of a sheet S collides with or taps against the conveyor belt 82, the pulleys 831 and 841 each having a bow-shaped center portion in the belt width direction can cause the center part of the trailing edge Se of a sheet S to firstly contact the bow-shaped center portion of the conveying surface 82*a* of the conveyor belt 82, and then the other parts of the trailing edge Se of the sheet S to gradually contact the other portions of the conveying surface 82*a* in a manner that the contact area spreads from the center toward the end portions thereof. Thus, the above-described configuration of the pulleys 831 and 841 can avoid the phenomenon that the trailing edge Se of the sheet S contacts the center part and the other parts of the conveying surface 821*a* of the conveyor belt 821 at the same time or with no time difference. Accordingly, the pulleys 831 and 841 having the above-described configuration can reduce more flipping noises, compared with the pulleys 83 and 84 of the sheet conveying device 510.

The above-described example embodiment employing the conveyor belt 82 and the pulleys 83 and 84 including elastic member with a relatively low hardness, the two modified example embodiments, one employing the conveyor belt 821 and the other employing the pulleys 831 and 841 are applied to the sheet conveying device 510. However, the above-described example embodiment and modified example embodiments are not limited to be applied to the sheet conveying device 510. Specifically, the above-described example embodiment and modified example embodiments are applicable to the sheet conveying device 5*a* that includes the common conveying path PC having the first conveying path PA and the second conveying path PB shown in FIGS. 8 through 10 as well as the sheet conveying device 5 that includes only the first conveying path PA shown in FIGS. 1 through 5. Hereinafter, the same may be applied to the other example embodiments.

Figure 14:
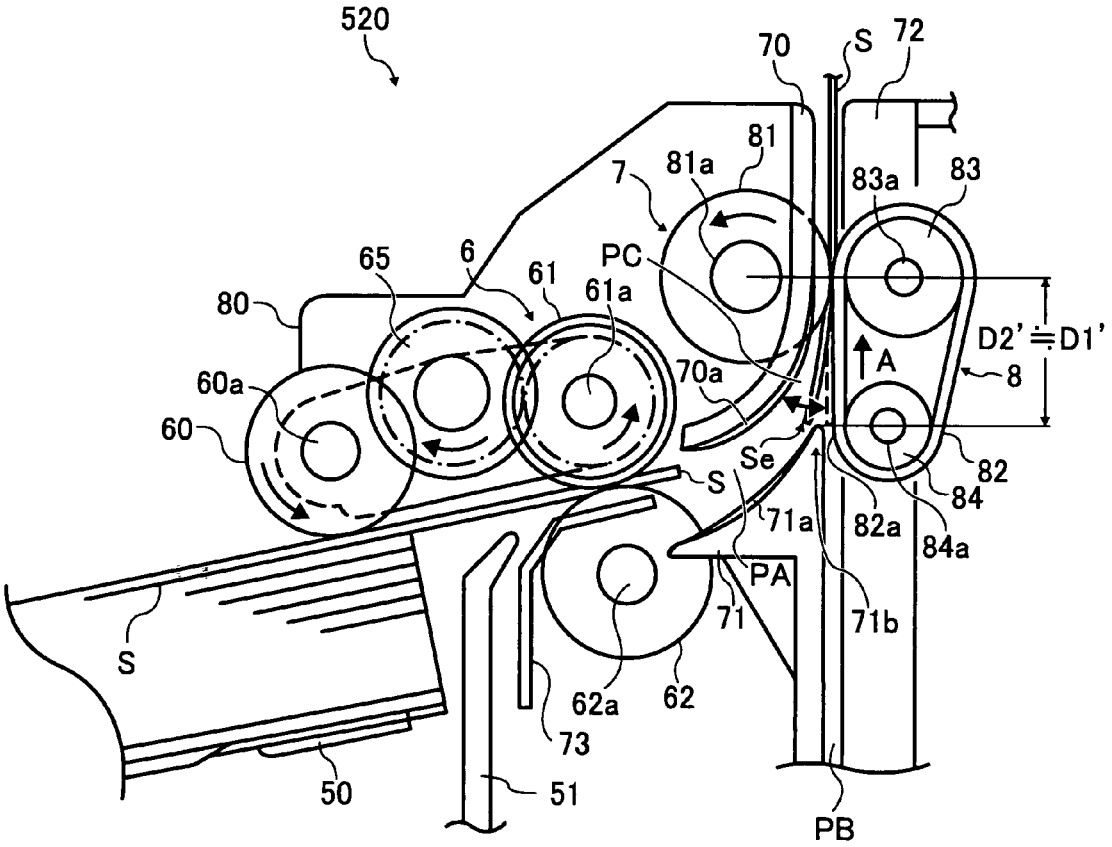
FIG. 14 is a cross-sectional view of another sheet conveying device according to an example embodiment of the present invention.

Referring to FIG. 14, a schematic configuration of a sheet conveying device 520 according to an example embodiment of the present invention is described.

The sheet conveying device 520 according to this example embodiment shown in FIG. 14 has a similar structure and functions to the sheet conveying device 510 according to the previously described example embodiment shown in FIG. 11. Except, the sheet conveying device 520 according to this example embodiment clearly describes relative positions of the conveying guide member 71 and the elements and members of the belt conveying unit 8 as follows.

The most remarkable characteristic of the sheet conveying device 520 according to this example embodiment of the present invention is that the center of the pulley shaft 84*a* of the pulley 84 that serves as a second belt holding and rotating member is disposed at a substantially or nearly equal position to a downstream end 71*b* of the conveying guide member 71 in the sheet conveying direction of the second conveying unit 7. That is, the pulley 84 on the subordinate side may be disposed at a position that satisfies "D1'≈D2' (D1' is nearly equal to D2')", where "D1'" represents a distance from the sheet guide outlet or downstream end 71*b* to the center of the pulley shaft 83*a* of the pulley 83 of the sheet conveying device 520 and "D2'" represents a distance from the center of the pulley shaft 83*a* of the pulley 83 to the center of the pulley shaft 84*a* of the pulley 84 of the sheet conveying device 520.

Therefore, with the above-described sheet conveying operation of the second conveying unit 7, when a trailing edge Se of the sheet S passes by the downstream end 71*b* of the conveying guide member 71, the trailing edge Se of the sheet S can collide with the conveying surface 82*a* of the conveyor belt 82. Specifically, the trailing edge Se of the sheet S can collide with a portion of the conveyor belt 82 corresponding to a portion held by the pulley 84, as indicated by a dashed line shown in FIG. 14.

In order not to generate flipping noises, it is imperative that the sheet conveying device 520 according to this example embodiment have the same configuration as the sheet conveying device 510 according to the previously described example embodiment, be arranged to employ the conveyor belt 82 including an elastic member having a relatively low hardness, be arranged to employ the pulleys 83 and 84 including elastic members having a relatively low hardness, and/or be arranged arbitrarily in combination with the previously described modified example embodiments. Except the above-described structure, the sheet conveying device 520 according to this example embodiment of the present invention has the same configuration as the sheet conveying device 5 according to the previously described example embodiment, with reference to FIGS. 8 through 10.

The following description shows effects according to the difference between the sheet conveying device 510 according to the previously described example embodiment with reference to FIG. 11 and the sheet conveying device 520 according to this example embodiment with reference to FIG. 14. The difference between these two example embodiments is a position of the pulley 84 (or the pulley 841).

In the sheet conveying device 520 according to this example embodiment shown in FIG. 14, the pulley 84 is disposed in the vicinity of the exit of the conveying guide member 71. Therefore, the trailing edge Se of the sheet S may collide with or abut against the conveyor belt 82 at a position near a supporting section at which the pulley 84 supports the conveyor belt 82. That is, the trailing edge Se of the sheet S may not collide with the abdominal portion, i.e., the effective conveying portion of the conveyor belt 82. Therefore, this structure is not preferable to absorb that the shock caused by the elastic displacement and/or deformation of the conveyor belt 82.

However, when the hardness of elastic member of the conveyor belt 82 and/or the pulley 84 is arbitrarily decreased, an appropriate elastic displacement and/or deformation of the conveyor belt 82 and/or the pulley 84 may be obtained, and thereby reducing flipping noises.

It is also effective to employ an outwardly convex or protruding shape such as the bow-shape of the conveyor belt 821 in the belt width direction as shown in the modified example embodiment of the previously described example embodiment with reference to FIGS. 12A and 12B or by employing an outwardly convex or protruding shape such as the bow-shape of the pulley 841 in the belt width direction as shown in the modified example embodiment of the previously described example embodiment with reference to FIGS. 13A and 13B. This can provide a given time difference when the center portion and the other portions of the trailing edge Se of the sheet S collide with or abut against the conveyor belt 82, thereby reducing the flipping noises.

Figure 15A:
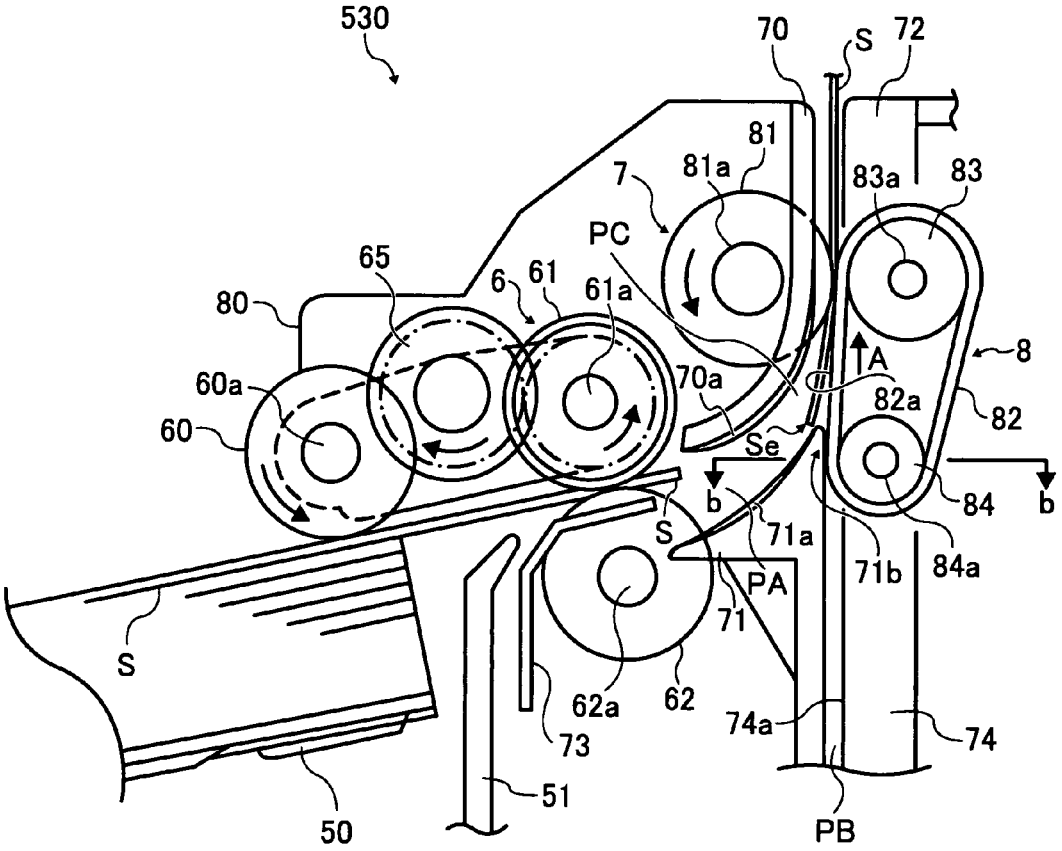
FIG. 15A is a cross-sectional view of another sheet conveying device according to an example embodiment of the present invention.
Figure 15B:
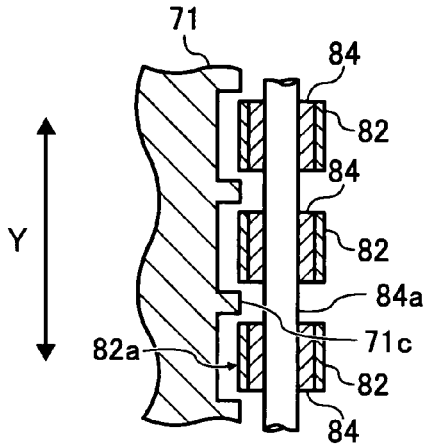
FIG. 15B is a cross-sectional view of the sheet conveying device taken along the line b-b of FIG. 15A.

Referring to FIGS. 15A and 15B, a schematic configuration of a sheet conveying device 530 according to an example embodiment of the present invention is described.

FIG. 15A is a cross sectional view of the sheet conveying device 530. FIG. 15B is a cross-sectional view of the sheet conveying device 530, taken along the line b-b of FIG. 15A.

The sheet conveying device 530 according to this example embodiment shown in FIGS. 15A and 15B has similar structure and functions to the sheet conveying device 510 according to the previously described example embodiment shown in FIG. 11. Except, the sheet conveying device 530 according to this example embodiment provides the pulley 84 between the downstream end 71*b* of the conveying guide member 71 and the conveying surface 82*a* of the conveyor belt 82 of the belt conveying unit 8. This structure is not to create a distance or gap therebetween in the sheet conveying direction of the first conveying unit 6 or the feed roller 61, and not to obstruct the travel of the conveyor belt 82 of the belt conveying unit 8.

Further, the conveying belts 82 of the sheet conveying device 530 can include plural conveyor belts 82, and each of the plural conveyor belts 82 may include same components as those provided to the conveyor belt 82.

The conveyor belts 82 of the sheet conveying device 530 are disposed at given intervals and set in at least a range substantially equal to a maximum size sheet to be conveyed. That is, the conveyor belts 82 of the sheet conveying device 530 have each given width and are disposed and set at given intervals in a range equal to or greater than a maximum size sheet to be conveyed.

Further, the pulleys 83 and 84 extending or stretching a corresponding one of the conveyor belts 82 and the grip rollers 81 facing and contacting the corresponding one of the conveyor belts 82 are disposed and set with each given width in a shish-kebab-like structure in a sheet width direction "Y" across a range equal to or greater than the above-described set range of the conveyor belts 82.

As shown in FIG. 15B, which is taken FIG. 15A along the line b-b and viewed from the top of the sheet conveying device 530, the conveying guide member 71 according to this example embodiment is provided with combtooth-shaped concaves with given intervals along the sheet width direction "Y". That is, the conveying guide member 71 includes protruding parts and receding parts at given intervals, extending along the sheet width direction "Y". This structure can avoid interference with the conveyor belt 82 disposed with given intervals along the sheet width direction "Y". Each conveyor belt 82 is disposed facing or opposite to a corresponding combtooth-shaped concave or receding part of the conveying guide member 71.

Further, the conveying surface 82*a* of each conveyor belt 82 and a guide surface 71*c* with an outwardly convex or protruding part of each conveying guide member 71 are disposed to be located on a substantially identical planar level to each other, so as to avoid creating a substantial distance or gap therebetween.

FIG. 15B shows a set of components of the above-described combtooth-shaped concaves or receding parts of the three conveying guide members 71, the conveyor belts 82, and the pulleys 84, which are disposed in the vicinity of the center portion of the sheet conveying device 530 along the sheet width direction "Y". The sheet conveying device 530 includes one or more sets of components same as the above-described set disposed with given intervals over the range equal to or greater than the maximum size of the sheet S to be conveyed.

As shown in FIG. 15A, the sheet conveying device 530 further includes a conveying guide member 74 in the outer area on the upstream side in the sheet conveying direction of the conveyor belt 82. The sheet conveying direction of the sheet conveying device 530 in FIG. 15A is indicated by arrow "A".

The conveying guide member 74 includes a guide surface 74*a* that may form the second conveying path PB. The conveying guide member 74 may guide the sheet S to the second conveying path PB via a space between the conveying surface 82*a* of the conveyor belt 82 and the conveying guide member 71.

As described above, according to this example embodiment of the present invention, the conveyor belt 82 of the belt conveying unit 8 may be disposed in such a manner that there is no distance between the conveying surface 82*a* of the conveyor belt 82 and the downstream end 71*b* of the conveying guide member 71. With the above-described structure, the shock or impact caused when the trailing edge Se of the sheet S collides with or taps against the conveyor belt 82 may be reduced, and thereby reducing the flipping noises.

Referring to FIGS. 16 through 23, a schematic configuration of a sheet conveying device 540 according to an example embodiment of the present invention is described.

Figure 16:
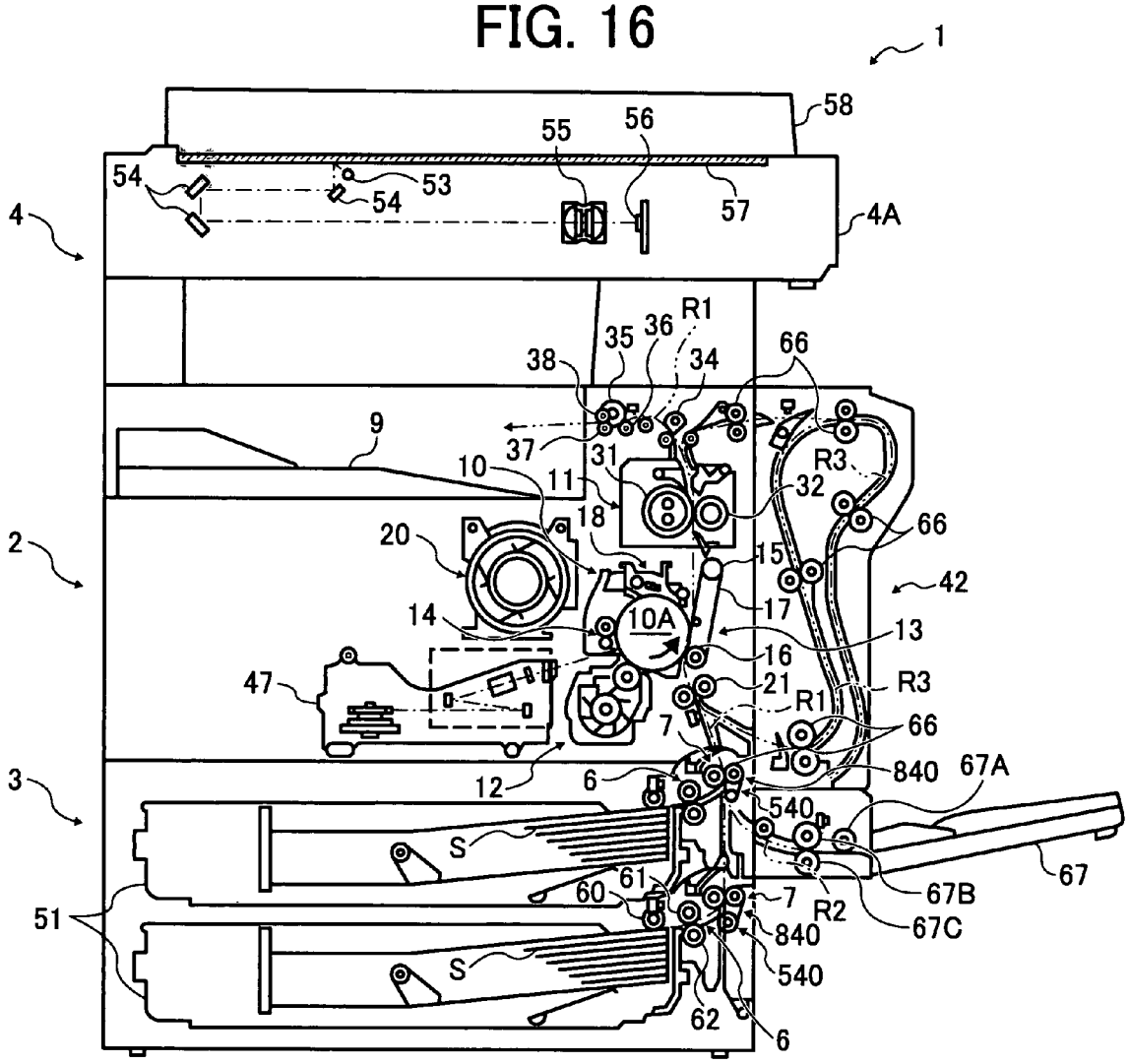
FIG. 16 is an elevation view of a schematic entire configuration of the image forming apparatus including a sheet conveying device according to an example embodiment of the present invention.

The sheet conveying device 540 according to an example embodiment shown in FIG. 16 is primarily different from the sheet conveying device 510 according to the previously described example embodiment in reference to FIG. 11 in the following points and subsequently described characteristics.

Specifically, the sheet conveying device 540 includes an upper stage sheet conveying device and a lower stage sheet conveying device of the sheet feeding device 3 shown in FIG. 16. The structures of the upper and lower stage sheet conveying devices are substantially equal to each other.

In addition, the sheet conveying device 540 includes a configuration different from the previously described configuration in which the belt width of the conveyor belt 82 is equal to or greater than a maximum size paper to be conveyed and in which the pulley 83, the pulley 84, and the grip roller 81 that are sequentially disposed along the sheet width direction "Y" have each width size that is equal to or greater than the belt width of the conveyor belt 82. Specifically, the sheet conveying device 540 includes the configuration in which the conveyor belts 82 of a belt conveying unit 840 are disposed along the sheet width direction "Y" with given intervals so that the conveyor belts 82 may contact parts of the leading edge section (including the leading edge, the face at the leading edge, and the corners and edges at the leading edge) disposed along the sheet width direction "Y" of the sheet S.

More specifically, each belt width of the conveyor belts 82 and 821 respectively corresponding to the sheet conveying devices 5, 5*a*, 510, and 520 in the sheet width direction Y shown in FIGS. 1 through 14 is at least substantially equal to the width of a maximum size sheet to be conveyed. That is, the conveyor belts 82 and 821 are sequentially set and ensured to have the belt width thereof substantially equal to or wider than the width of a maximum size sheet to be conveyed. Similarly, the pulleys 83, 831, 84, and 841 around which a corresponding one of the conveyor belts 82 and 821 is stretched and the grip roller 81 facing and contacting a corresponding one of the conveyor belts 82 and 821 are sequentially formed in such a manner that the sizes in the sheet width direction Y, which is a longitudinal or axial direction, of the pulleys 83, 831, 84, and 841 and the grip roller 81 are equal to or larger than the above-described belt width of the conveyor belts 82 and 821.

Further, the conveyor belts 82 of the sheet conveying device 530 shown in FIGS. 15A and 15B are disposed and set at given intervals in at least a range substantially equal to a maximum size sheet to be conveyed. That is, the conveyor belts 82 of the sheet conveying device 530 have each given width and are disposed and set at given intervals in a range equal to or greater than the width of a maximum size sheet to be conveyed.

Similarly, the pulleys 83 and 84 extending or stretching a corresponding one of the conveyor belts 82 and the grip rollers 81 facing and contacting a corresponding one of the conveyor belts 82 are disposed and set with each given width in a shish-kebab-like structure in a sheet width direction "Y" across the range equal to or greater than the above-described set range of the conveyor belts 82.

With the above-described structure, it is ensured that the entire or given partial width of the sheet S sent out from the first conveying unit 6 may constantly contact a corresponding one of the conveyor belt 82 or 821, so that the contact area therebetween can be increased as large as possible. Accordingly, it is possible to increase, as great as possible, the conveying and propelling force for conveying the sheet S in the conveying direction. Therefore, the conveying and propelling force may constantly be transmitted to the sheet S from a corresponding one of the conveyor belts 82 and 821 moving in the sheet conveying direction.

Compared to the above-described structure, the sheet conveying device 540 according to this example embodiment includes the following configuration.

The belt conveying unit 840 of the sheet conveying device 540 is primarily different from the belt conveying units 8, 810, and 820 of the sheet conveying devices 5, 5*a*, 510, 520, and 530 shown in FIGS. 1 through 15 in the following points and subsequently described characteristics.

That is, the material of the conveyor belt 82 may be specified as described below.

Instead of having one of the pulleys 83 and 831 that have a long length extending in the longitudinal or axial direction and are fixed to the pulley shaft 83*a*, the three pulleys 83 may rotatably be supported by the pulley shaft 83*b*. The pulleys 83 and 84 may formed of a resin material such as polyacetal resin. The belt supporting members 86 may be provided to rotatably support the pulleys 83 and 84. Instead of the pulley shaft 84*a* with a long length continuously extending in its longitudinal or axial direction, there are three metal pulley shafts 84*b* with short lengths in their axial directions provided for the belt conveying unit 840.

Figure 18:
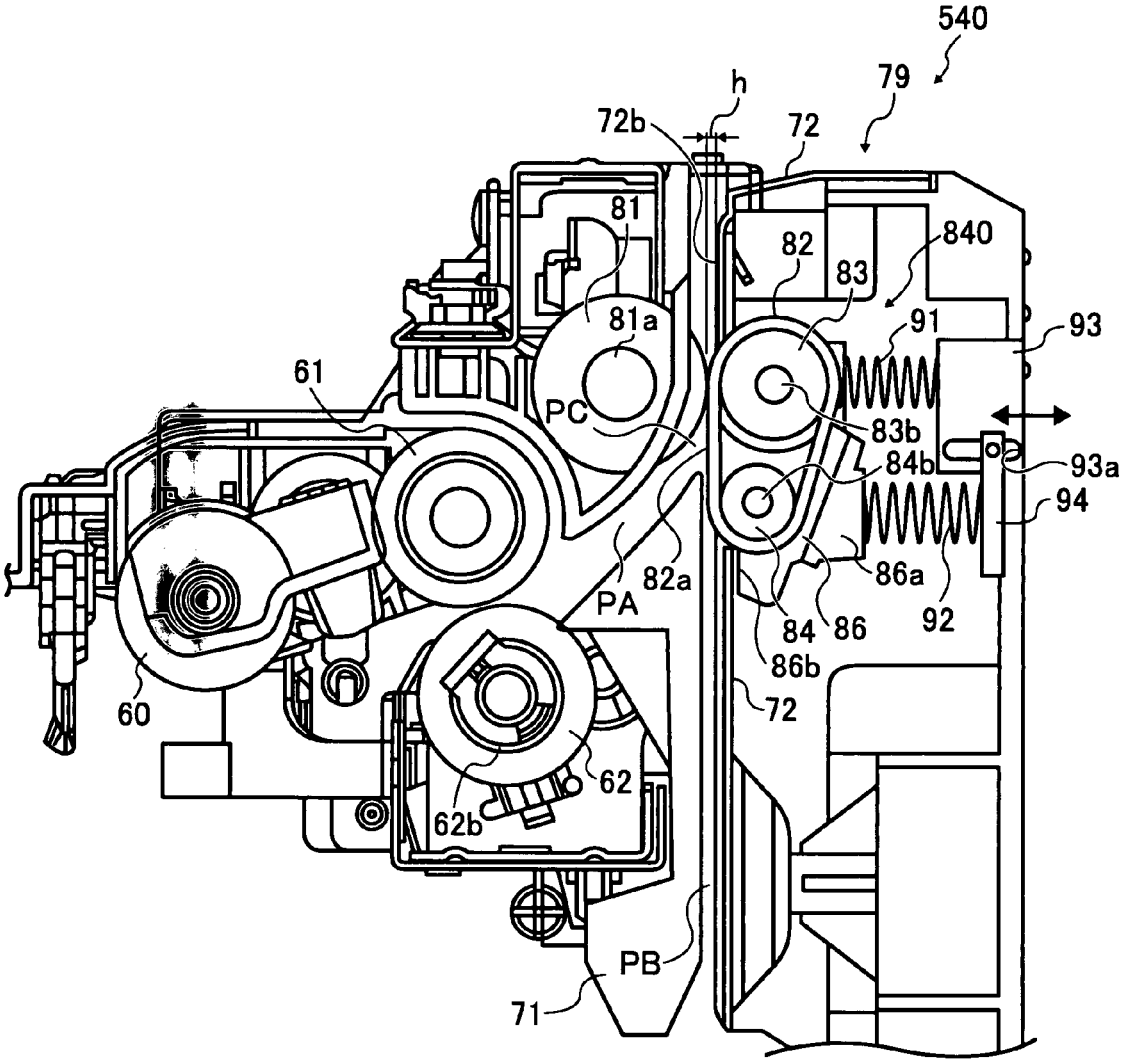
FIG. 18 is a cross-sectional view of relevant parts around the sheet conveying of FIG. 16.

As shown in FIG. 18, the grip roller 81 and the conveyor belt 82 may contact with each other on a line connecting the center of the rotational driving shaft 81*a* of the grip roller 81 and the center of the pulley shaft 83*b*, similarly to the example shown in FIG. 4. The holding section or nip section may be formed at the portion including this contact point. The pulleys 83 and 84 can be formed of a resin material such as polyacetal resin that has good lubricity, abrasion resistance, and durability, and are thus light-weight.

Figure 17:
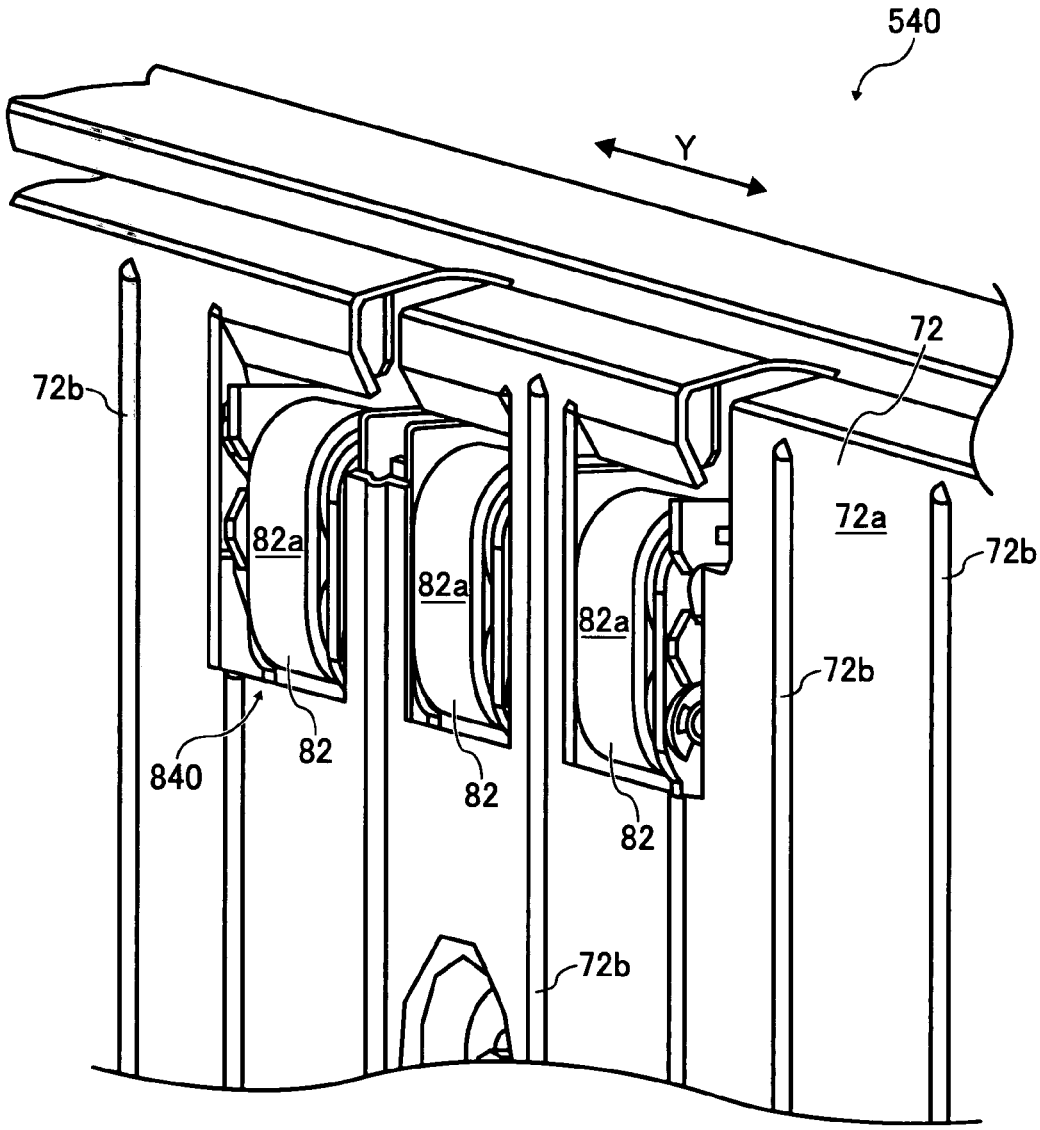
FIG. 17 is a perspective view of relevant parts around belt conveying units and a conveying guiding member of the sheet conveying device of FIG. 16.
Figure 19:
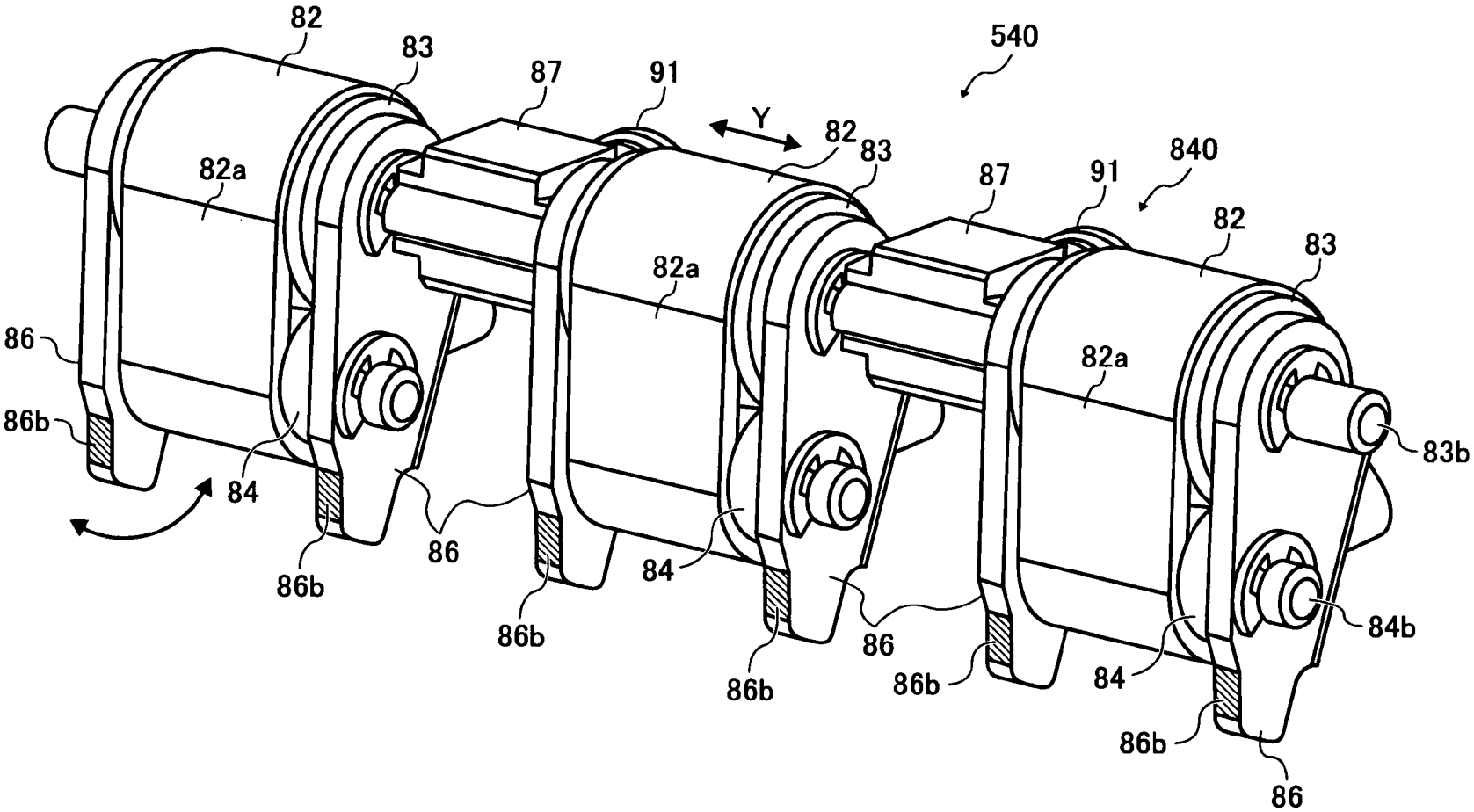
FIG. 19 is a perspective view around the belt conveying units of the sheet conveying device of FIG. 16.
Figure 20:
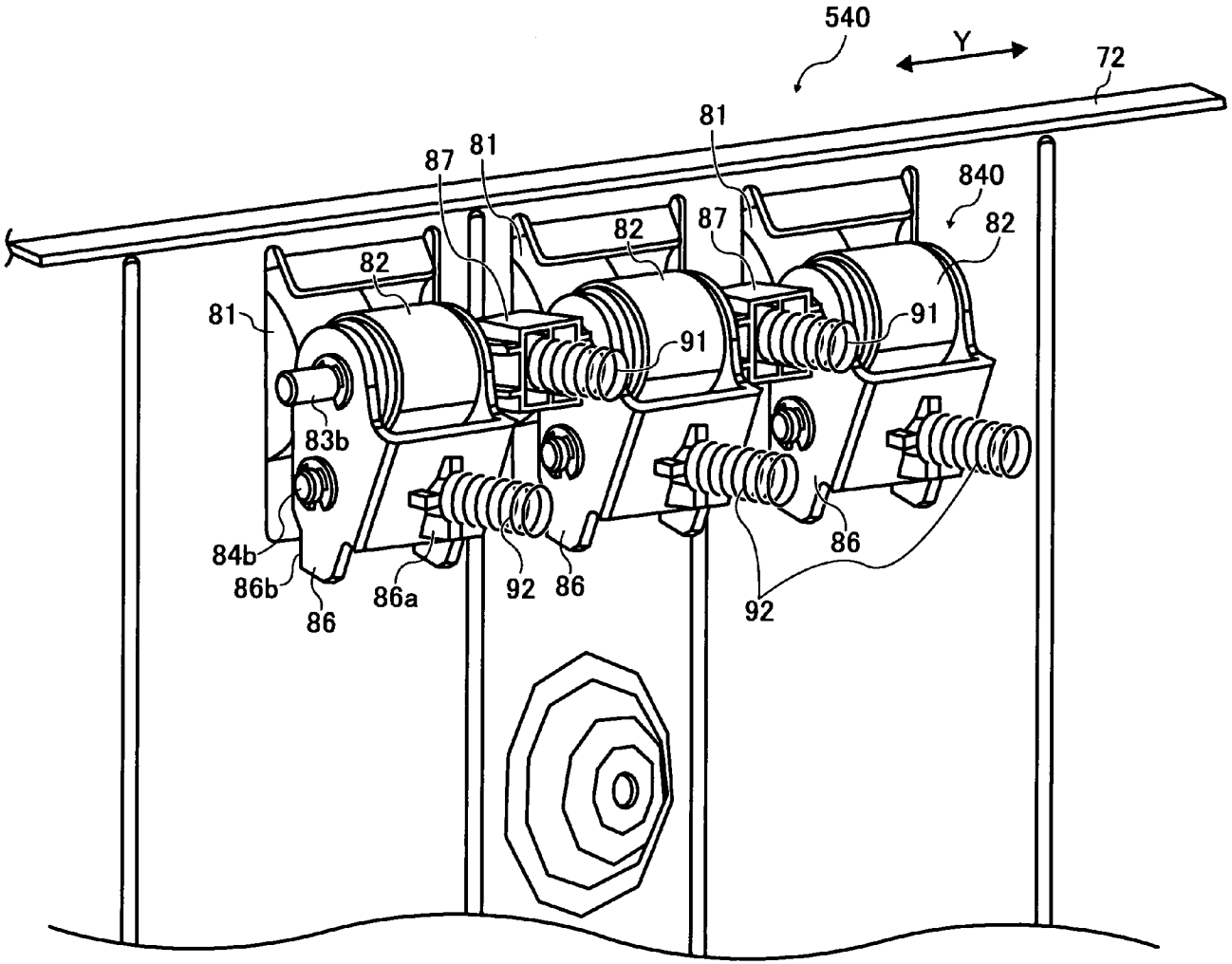
FIG. 20 is another perspective view around the belt conveying units of the sheet conveying device of FIG. 16.

As shown in FIGS. 17, 19, and 20, the three conveyor belts 82 may be disposed in such a manner that one of the three conveyor belts 82 is disposed at a substantially center portion along the sheet width direction "Y" and the other two of the three conveyor belts 82 are disposed at respective right and left portions along the sheet width direction "Y" with given equal intervals away from the conveyor belt 82 disposed at the substantially center portion.

The conveyor belts 82 provided at three positions have the same configurations except for their spring loads as described below. Therefore, the configuration of one of the conveyor belts 82 is described as a representative example.

The conveyor belt 82 is an elastic member made of, for example, ethylene propylene rubber (EPDM), without using a base material. (A belt is generally formed by attaching rubber onto a base material such as a cloth made by weaving threads.) The conveyor belt 82 can also be made of urethane rubber (U).

The conveyor belt 82 may be stretched around the pulley 83 rotatably supported by the pulley shaft 83*b* and the pulley 84 rotatably supported by the pulley shaft 84*b* with a given tension determined by the relative positions of the pulleys 83 and 84 attached to the belt supporting member 86 via the pulley shafts 83*b* and 84*b*.

The pulley shafts 83*b* and 84*b* may be fixed and supported by the belt supporting member 86 in such a manner that a fixed distance is maintained between their axes. Furthermore, the pulley shafts 83*b* and 84*b* may be fixed and supported by the belt supporting member 86 in such a manner that the conveyor belt 82 has a longer circumference when stretched around the pulleys 83 and 84 compared to when the conveyor belt 82 is by itself (in a non-stretched state). Accordingly, the conveyor belt 82 may elastically be stretched so that the conveyor belt 82 can have a longer circumference when the belt conveying unit 840 is assembled in the belt supporting member 86, compared to when the conveyor belt 82 is by itself (in a non-stretched state).

Two bearings 87 (see FIGS. 19 and 20) are provided on the pulley shaft 83*b* held by the three belt supporting members 86. Springs 91 that serve as biasing and elastic members may apply forces on the pulley shaft 83*b* via the bearings 87 to press the conveyor belt 82 against the grip roller 81, which provides a given holding section or nip section. Thus, a conveying force for conveying a sheet S can be generated. As described above, the pulley shafts 83*b* and 84*b* may be fixed by the belt supporting members 86 in such a manner that a fixed distance is maintained between their axes, and the pulley shaft 84*b* can pivot back and forth about the pulley shaft 83*b*.

Each of the belt supporting members 86 is a single component made of a resin material such as polyacetal resin, and is thus light-weight. On the back wall of each of the belt supporting members 86, a spring stage 86*a* (see FIG. 20) is disposed integrally with the belt supporting member 86 for latching one end of a spring 92. In the vicinity of the portions at which the pulley shafts 83*b* and 84*b* protrude out from the belt supporting members 86, retaining rings, not shown, are provided to stop the pulley shafts 83*b* and 84*b* from slipping out.

As shown in FIG. 18, the springs (pressuring springs or compression springs) 92 are provided between the spring stages 86*a* of the belt supporting members 86 and spring bearing members 93. The springs 92 may serve as pressuring members for pressing and biasing the backsides of the belt supporting members 86 in such a direction that the conveyor belts 82 constantly press contact with the grip rollers 81 toward the first conveying path PA shown in FIG. 18.

As indicated by the hatched portions shown in FIG. 19, positioning sections 86*b* are integrally formed at the bottom of the belt supporting member 86 for positioning the conveyor belt 82 at a given position. The positions of the conveyor belts 82 are determined as the positioning sections 86*b* contact the conveying guide member 72.

Figure 21:
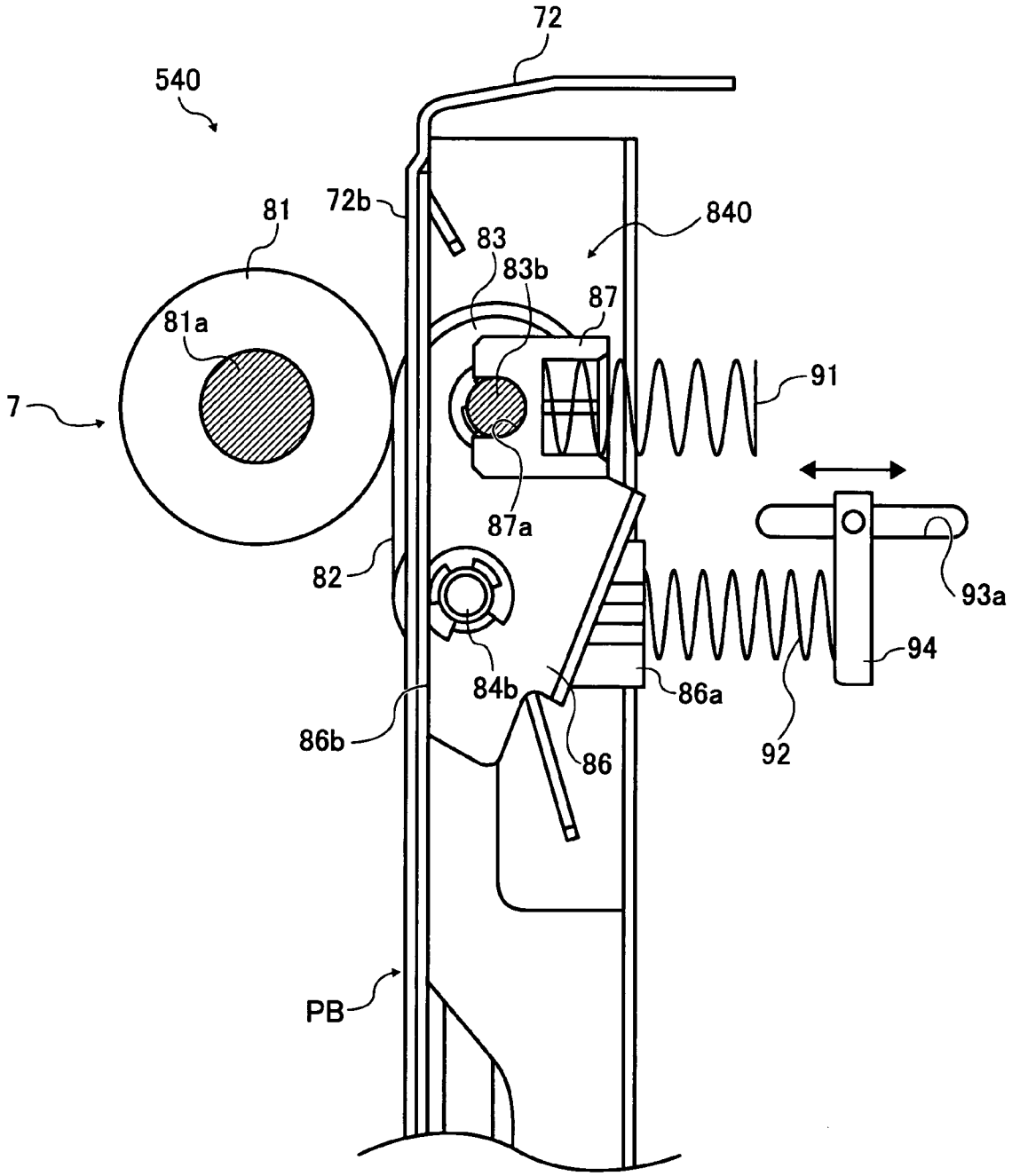
FIG. 21 is a cross-sectional view of relevant parts around a second conveying unit of the sheet conveying device of FIG. 16.

Further, as shown in FIGS. 18 and 21, the positioning sections 86*b* may be made to contact the conveying guide member 72 by the biasing or pressing force of the springs 92. Therefore, the conveyor belts 82 may be provided at given positions so as to ensure a belt protruding height "h" from a conveying guide rib 72*b* that is formed the sheet conveying device 540 by protruding toward the inside of the sheet conveying device 540 from a conveying guide rib 72*b* of the conveying guide member 72.

As shown in detail in FIG. 21, each of the bearings 87 has a U-shaped groove 87*a*, and the pulley shaft 83*b* is loosely fit in the U-shaped groove 87*a*. Accordingly, the pressing force of the spring 91 may press the conveyor belt 82 against the grip roller 81 via the pulley shaft 83*b*. The position of the pulley shaft 83*b* may be fixed as the conveyor belt 82 is pressed against the grip roller 81. The pulley shaft 84*b* may pivot back and forth or rotatably or swingably move about the pulley shaft 83*b* in a direction indicated by a bidirectional arrow shown in FIG. 19.

As described with reference to FIGS. 18 and 21, one end of the spring 92 may apply a force on the belt supporting member 86. The other end of the spring 92 may be supported and latched by a spring pressuring stage 94. The spring pressuring stage 94 can move along a slit 93*a* formed in the spring bearing member 93 in the direction of the biasing or pressing force of the spring 92, and can also be fixed at an arbitrary position.

In FIGS. 18 and 21, the spring pressuring stage 94 may be fastened and fixed by a screw. With such a configuration, the springs 92 can be arbitrarily pressed to different lengths so that the spring load serving as the pressuring force, i.e., the pressuring force of the springs 92 can be arbitrarily changed.

In this example embodiment, the two springs 91 have the same spring specifications such as spring load, spring length, shape, etc. Similarly, the three springs 92 have the same spring specifications such as spring load, spring length, shape, etc.

As described above, the conveyor belt 82 of the belt conveying unit 840 according to this example embodiment may be stretched around the pair of roller-type pulleys 83 and 84 with a given tension determined by the relative positions of the pulleys 83 and 84 attached to the belt supporting member 86 via the pulley shafts 83*b* and 84*b*. The conveyor belt 82 may be pressed by the pressing force of the spring 92 against the grip roller 81 that drives the pulley 83. The pulley 83 may be provided in a freely rotatable manner, and be thus caused to rotate following the rotation of the grip roller 81.

Figure 22:
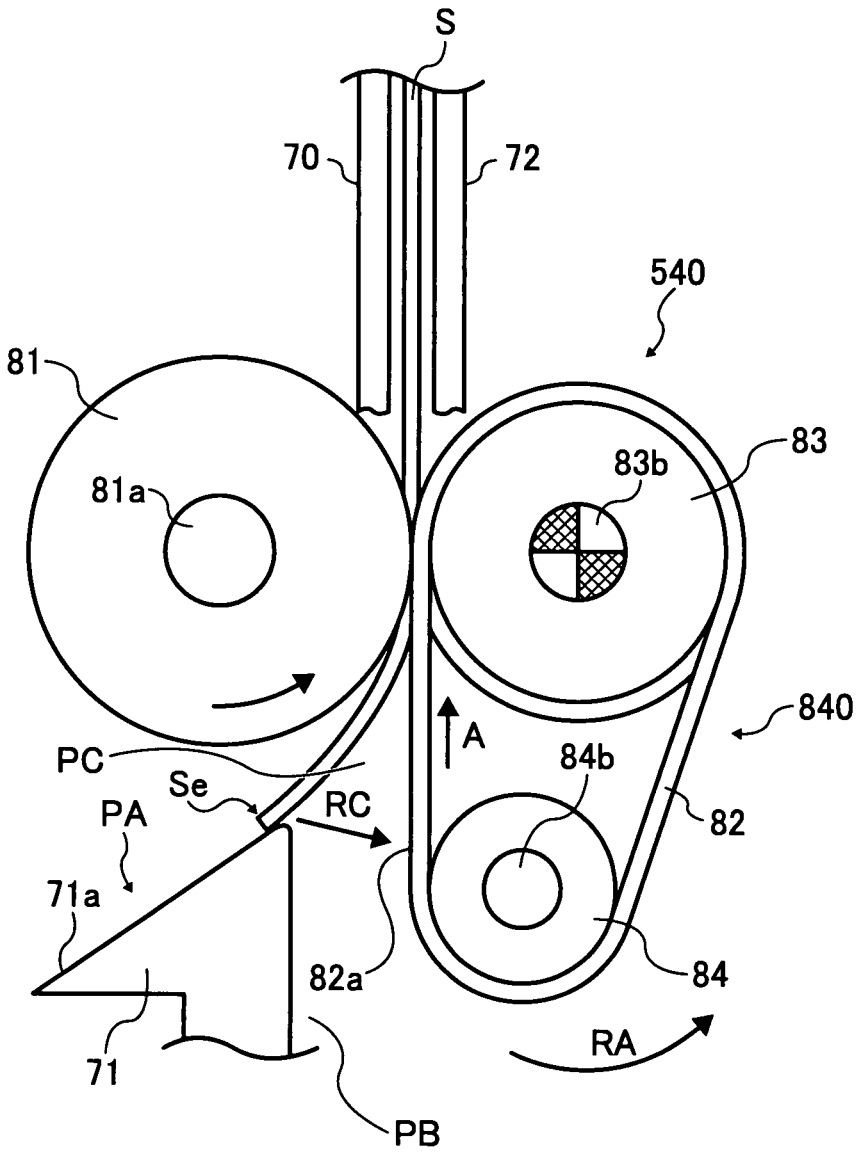
FIG. 22 is an enlarged cross-sectional view of relevant parts around conveying guiding members of the sheet conveying device of FIG. 16.

As shown in FIG. 22, operations in the sheet conveying process of the sheet conveying device 540 according to this example embodiment are described.

In a case in which a rigid sheet S such as cardboard sheet passes the conveying guide member 71 with a small curvature, when the trailing edge Se of the rigid sheet S is released from a restriction force of the conveying guide member 71, the sheet S tends to move in a direction indicated by arrow "RC" due to the large elastic restoring force of the sheet S. At this time, the trailing edge Se of the sheet S collides with or taps against the conveying surface 82*a* of the conveyor belt 82 to cause flipping noises. However, the above-described springs 92 (see FIGS. 18 and 21) may absorb the shock due to its elastic deformation and/or displacement (buffering action). This can reduce or prevent the occurrence of the flipping noise. An arrow "RA" shown in FIG. 22 shows a direction to which the conveyor belt 82 and the pulley 84 pivot or swing.

Figure 23:
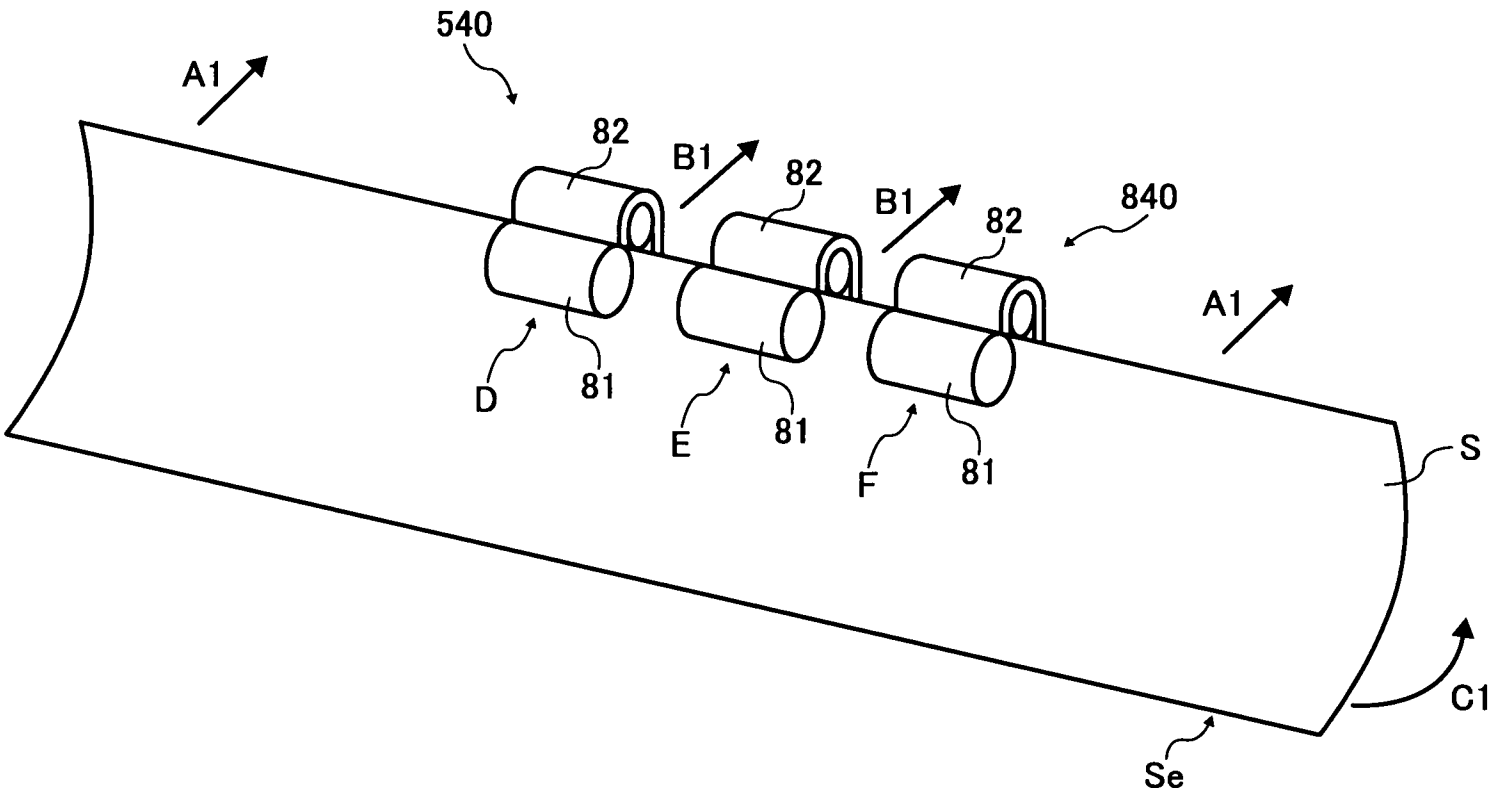
FIG. 23 is a schematic perspective view of relevant parts including plural pulleys of the sheet conveying device of FIG. 16.

Further, as shown in FIG. 23, the conveyor belt 82 is generally disposed at the center portion of the sheet S in the sheet width direction so as to correspond to a small size paper S. However, when the trailing edge Se of the sheet S moves in the direction indicated by arrow "C1", a force indicated by arrow "A1" is generally greater than a force indicated by arrow "B1".

Therefore, the sheet conveying device 540 according to this example embodiment can arrange the fixed length of the spring pressuring stage 94 shown in FIGS. 18 and 21 to reduce the pressuring force or spring loads of the springs 92 in a "D" section and an "F" section. With the above-described structure, the shock can be more absorbed. In this case, it is acceptable when the conveying force for conveying the sheet S is achieved by a sum of "D", "E", and "F".

By performing the above-described operations, the pressure force of the spring 92 can arbitrarily set according to the sheet thickness, i.e., rigidity of sheet, high hardness or low hardness of sheet, etc. Accordingly, even a highly rigid sheet S can be steadily conveyed without causing conveyance failures.

According to this example embodiment, the following advantages and effects can be achieved.

First, the pulley 84 serving as second belt holding and rotating member is disposed to pivot about the pulley 83 serving as first belt holding and rotating member. The pulley 84 may be pressed or biased by the springs 92 serving as biasing or pressing member and elastic member at a given biasing or pressuring force to rotatably or swingably move to the outer side or toward the first conveying path PA. However, the above-described springs 92 (see FIGS. 18 and 21) may absorb the shock due to its elastic deformation and/or displacement (buffering action), which can reduce or prevent the occurrence of the flipping noise. An arrow "RA" shown in FIG. 22 shows a direction to which the conveyor belt 82 and the pulley 84 pivot or swing.

Therefore, even when conveying a sheet S having a relatively high rigidity such as cardboard sheet, the flipping noise generated by the trailing end Se of the sheet S tapping against the conveying surface 82*a* of the conveyor belt 82 may be absorbed by the buffering action of the springs 92 in addition to the elastic deformation and/or displacement of the conveyor belt 82. Accordingly, the sheet conveying device 540 with less noise and the copier 1 including the sheet conveying device 540 can be provided.

Secondly, the sheet conveying device 540 includes the belt supporting members 86, which rotatably supports the pulleys 83 and 84 and includes the positioning sections 86*b* for positioning the conveyor belts 82 at the respective given positions, and the conveying guide member 72, which is disposed in a manner that the conveying surface 82*a* of the conveyor belt 82 faces the outer side of the common conveying path PC. By arranging the positioning sections 86*b* to press contact with the conveying guide member by the pressuring force of the springs 92, the conveyor belts 82 are positioned at the respective given positions protruding inward from a guide surface 72*a* (see FIG. 17) of the conveying guide member 72. Accordingly, the substantial positioning of the conveyor belts 82 can be performed at a lower cost, and the sheet conveying device 540 and the copier 1 including the sheet conveying device 540 can be provided at a lower cost.

In addition, the springs 92 are disposed corresponding to the respective belt supporting members 86, and the pressuring force of each spring 92 can be adjusted. Therefore, the pressuring force applied to the sheet S can be adjusted to an appropriate amount to reduce the flipping noise or sudden noise caused by the movement of the trailing edge Se of a sheet S without changing various types or thickness of sheets. Accordingly, the sheet conveying device 540 with less noise and the copier 1 including the sheet conveying device 540 can be provided.

Further, the belt conveying unit 8 includes at least three conveyor belts 82 in a manner that the pressuring force of the spring 92 corresponding to one disposed at the center of the at least three conveyor belts 82 is set to have a value greater than the other conveyor belts 82. The above-described structure can reduce the flipping noise or sudden noise caused in the vicinity of both end portions of the sheet S, around which a greater force of tapping against the sheet S is applied. Accordingly, the sheet conveying device 540 with less noise and the copier 1 including the sheet conveying device 540 can be provided.

Further, the grip rollers 81 and the conveyor belts 82 of the belt conveying unit 840 are disposed at given intervals to reduce costs, compared with a case in which a long and single belt conveying unit 8 is used.

In addition, the conveyor belt 82 of the belt conveying unit 840 directly contacts the grip roller 81 that is a rotating and conveying member and is rotated by the driving mechanism 22, so that the conveyor belt 82 can rotate following the rotation of the grip roller 81. Variations in the linear velocity of the conveyor belt 82 can be more reduced by driving the grip roller 81, compared to the case in which the conveyor belt 82 is driven. Therefore, the following advantages can be achieved by arranging the conveyor belt 82 along the outer side of the turning or curved section of the common conveying path PC formed between the first conveying path PA and the second conveying path PB. The above-described structure can cause the conveyor belt 82 to rotate toward the holding section of the second conveying unit 7. That is, it is possible to enhance sheet conveying properties for conveying relatively rigid sheets such as cardboard sheet at the turning or curved section of the first conveying path PA. Furthermore, by causing the conveyor belt 82 to rotate following the rotation of the grip roller 81 that faces and directly contacts the conveyor belt 82, the sheet S can be conveyed at a steady linear velocity beyond the second conveying unit 7.

These advantages and effects are easily understandable by considering the following technique.

In a case in which the grip roller 81 is driven, the linear velocity of the grip roller 81 may be determined based on the outside diameter of the grip roller 81 and the rotational speed. Conversely, in a case in which the conveyor belt 82 is driven, it may usually need to drive the roller-type pulley 83 (belt driving roller, main pulley) provided inside the conveyor belt 82.

In this case of driving the conveyor belt 82, the linear velocity of the conveyor belt 82 may be determined not only based on the outside diameter and the rotational speed of the pulley 83 provided inside the conveyor belt 82. That is, the linear velocity is also affected by variations in the thickness of the conveyor belt 82 caused by variations in components, changes in the thickness of the conveyor belt 82 caused by attrition, or slipping actions between the conveyor belt 82 and the pulley 83. Therefore, variations in the linear velocity of the conveyor belt 82 can be more reduced by driving the grip roller 81 rather than driving the conveyor belt 82.

Further, the pulleys 83 and 84 (belt holding and rotating members) may axially be supported by the belt supporting member 86 in such a manner that a fixed distance is maintained between their axes. The pulley shafts 83*b* and 84*b* of the pulleys 83 and 84, respectively, may be disposed in the belt supporting member 86 in such a manner that the conveyor belt 82 including an elastic member has a longer circumference when stretched around the pulleys 83 and 84, compared to a case when the conveyor belt 82 is by itself (in a non-stretched state). This example embodiment is not provided with a tightener, which is a typically used mechanism for applying tension to a belt. Instead, the conveyor belt 82 is elastically stretched between the two pulleys 83 and 84. Therefore, the configuration of the sheet conveying device 540 according to this example embodiment can be simple, space-saving, and cost-saving, compared to a configuration provided with a tightening mechanism such as a tightener.

Accordingly, the configuration of the sheet conveying device 540 that includes enhanced sheet conveying properties for conveying relatively rigid sheets such as cardboard at the turning section of the first conveying path PA can be simple, space-saving, and cost-saving.

As described above, the belt conveying units 8, 810, 820, and 840 of the sheet conveying devices 5, 5*a*, 510, 520, 530, and 540 each serves as a moving and guiding unit for moving and guiding the sheet S toward the nip section or holding section formed with the grip roller 81 while keeping the leading edge or a leading edge section (leading edge section has a broad meaning including the leading edge, the face at the leading edge, and the corners and edges at the leading edge) of the sheet S in contact with one member of the pair of rollers of the second conveying unit 7, and gradually increasing the contact surface with the sheet S according to the rigidity of the sheet S. The moving and guiding unit is not limited to the belt conveying units 8, 810, 820, and 840 as long as it has the above-described effects can be achieved.

Figure 24A:
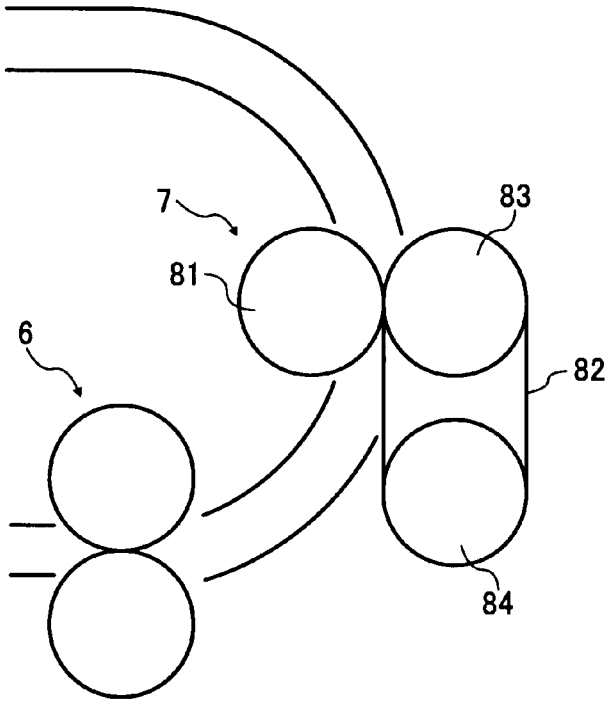
FIG. 24A is a schematic front view of conveying units applicable to the sheet conveying devices of FIGS. 2, 8, 11, 14, 15A, and 16.
Figure 24B:
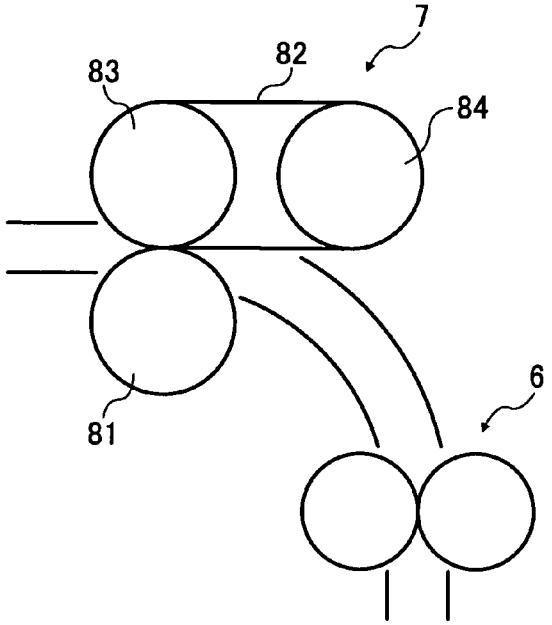
FIG. 24B is a schematic front view of different conveying units applicable to the sheet conveying devices of FIGS. 2, 8, 11, 14, 15A, and 16.

In the above-described example embodiments, and modified example embodiments, the present invention is applied to a sheet conveying device for conveying and feeding a sheet from a sheet storing unit (e.g., sheet feeding cassette 51) provided in the copier 1 serving as an image forming apparatus to the main body 2 of the copier 1, as shown in FIG. 1. However, the present invention is not limited thereto. That is, the present invention is applicable to a sheet conveying device in which the leading edge of a sheet S is ejected substantially upward from the top of the fixing device 11 of the main body 2 of the copier 1, and then ejected from the main body 2 to the sheet eject tray 9 in a substantially horizontal direction (see, for example, FIG. 24B). The present invention is also applicable to a sheet conveying device in which a sheet S placed on the substantially horizontal manual sheet feeding tray 67 provided outside the main body 2 of the copier 1 by a user is guided inside the main body 2 while maintaining its horizontal direction, and then the sheet S changes its direction upward to be conveyed into a vertical conveying path that extends to the image forming section in the main body 2 of the copier 1.

In the above-described example embodiments and modified example embodiments, the sheet may change its direction from a substantially horizontal direction to a vertically upward direction or substantially directly upward direction. However, the present invention is not limited thereto. That is, the sheet can change its direction from a substantially horizontal direction to a vertically downward direction or substantially directly downward direction, or from a vertically downward or upward direction to a substantially horizontal direction (see, for example, FIG. 24A), or from an oblique direction to another oblique direction.

In the above-described example embodiments, and modified example embodiments, both the first conveying unit 6 and the second conveying unit 7 are holding and conveying units. However, depending on the conveying direction of each of the first and second conveying units 6 and 7, if it is only needed to support the bottom face of the conveying object while being conveyed, the first and second conveying units 6 and 7 may not need to have holding and conveying units including holding sections formed by members facing each other.

The members of the first conveying unit 6, the second conveying unit 7, and the pickup roller 60 are not limited to the above. The members can be a substantially extended cylindrical member with a given length in the axial lengthwise direction of the rotational axis, or a short cylindrical member. Furthermore, plural rollers can be disposed along a single rotational shaft with given equal intervals therebetween.

In the conveying paths according to the above-described example embodiments, several guiding members can be provided along the outer side or the inner side in the spaces in which rollers are not disposed so as to form guiding surfaces. As long as such guiding surfaces are symmetrically arranged in an orderly manner with respect to a conveying center line, the guiding surfaces can be band-like guiding surfaces or substantially linear guiding surfaces or a combination thereof.

In the above-described example embodiments, and modified example embodiments, the FRR sheet feeding method can be employed as the sheet feed separating mechanism. However, the present invention is not limited thereto. That is, as long as a sheet can be separated from other plural sheets overlapping each other by friction so as to successfully convey only one sheet, any type of friction separating method can be employed.

For example, a separating claw can be employed, or a friction pad method can be employed in which a friction pad serving as a fixing member is pressed against a feed roller. In this friction pad method, the friction pad serving as a friction member is pressed against the feed roller at an appropriate separating angle and separating pressure level. A sheet may pass through a nip section formed by the feed roller and the friction pad. Accordingly, with the sheet feed separating mechanism employing the friction pad method, even if two overlapping sheets are extracted, the friction pad may generate a resistance that is larger than the resistance caused by the friction in between the overlapping sheets, to the bottom sheet. Therefore, the above-described action of the friction pad can keep or prevent the bottom sheet from moving any further in the sheet conveying direction. Meanwhile, the feed roller may generate, for the top sheet, a conveying force that is larger than the resistance caused by the friction in between the overlapping sheets and the resistance received from the friction pad. As a result, only the top sheet can continue to move into the conveying direction.

The present invention is not limited to the copier 1 having a monochrome printing method. That is, the sheet conveying device according to the present invention is also applicable to a color copier or an image forming apparatus connected to a printer such as a monochrome laser printer, an inkjet printer, or an ink ribbon printer.

The present invention is similarly applicable to a color printer such as a direct transfer type tandem type color image forming apparatus in which images are sequentially transferred and superimposed onto a sheet being conveyed by a transfer member, and a tandem type image forming apparatus in which images are sequentially transferred onto an endless intermediate transfer belt serving as an intermediate transfer member and then transferred onto a sheet at once as a overlaid toner image or a color toner image.

The present invention is also applicable to an image forming apparatus including a single, endless belt type photoconductor.

The present invention is not limited to an image forming apparatus that employs an in-body paper eject type, that is, a sheet eject tray is located within the main body of the image forming apparatus, between an image forming unit and a scanner. Specifically, the present invention is also applicable to an image forming apparatus with a paper eject tray provided on the side of the main body of the image forming apparatus.

The present invention is not limited to a conveying path for conveying a sheet extracted from the sheet feeding device 3 substantially vertically or directly upward toward the top of the main body 2 of the copier 1. That is, the present invention is also applicable to an image forming apparatus in which the conveying path from the sheet feeding device to the sheet eject tray is not substantially vertically or directly upward.

The present invention is also applicable to a sheet conveying device provided in a printing machine including stencil printing machines, for conveying a sheet from a sheet storing unit (sheet feeding tray) or a sheet stacking unit (sheet feeding stage) to a printing machine main unit.

In the above-described copier 1 serving as the image forming apparatus, an original document to be scanned may be manually set. However, the image forming apparatus can be a copier or a printing machine provided with an automatic document feeder or ADF for automatically scanning plural original documents or sheets, and the sheet conveying device according to the present invention can be provided in the ADF.

The image forming apparatus is not limited to a copier. That is, the image forming apparatus can be a facsimile machine, a printer, an inkjet recording device, or an image scanning device, provided with a scanner for scanning an image from an original document, and a multifunction peripheral combining at least two of the above. In any of the above-described apparatuses or devices, an optimum sheet conveying device can be provided for changing the sheet conveying direction in conveying various types of sheets, while saving space in the sheet conveying path.

The present invention is not limited to providing respective sheet conveying devices to plural sheet feeding stages. For example, the present invention is applicable to a case in which the top sheet feeding cassette 51 and the sheet conveying device 5' are removed from the sheet feeding device 3 shown in FIG. 1 so that the sheet feeding device 3 can include a single sheet feeding cassette 51 and a single sheet conveying device 5.

That is, the present invention is applicable to an image scanning device provided with the sheet conveying device according to an example embodiment of the present invention, and to an image forming apparatus provided with the sheet conveying device and/or the image scanning device according to an example embodiment of the present invention. The image forming apparatus according to an example embodiment of the present invention can be any one of a copier, a facsimile machine, a printer, a printing machine, and an inkjet recording device, or a multifunction peripheral combining at least two of the above.

The above-described example embodiments are illustrative, and numerous additional modifications and variations are possible in light of the above teachings. For example, elements and/or features of different illustrative and example embodiments herein may be combined with each other and/or substituted for each other within the scope of this disclosure and appended claims. It is therefore to be understood that within the scope of the appended claims, the disclosure of this patent specification may be practiced otherwise than as specifically described herein.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A sheet conveying device, comprising:

a first conveying unit configured to convey a sheet in a first sheet conveying direction;

a second conveying unit disposed on a downstream side of the first conveying unit in the first sheet conveying direction and configured to convey the sheet conveyed by the first conveying unit in a second sheet conveying direction different from the first sheet conveying direction, at least the second conveying unit of the first and second conveying unit including a holding and conveying unit with a holding section to hold and convey the sheet;

a first sheet conveying path formed between the first conveying unit and the second conveying unit; and a belt conveying unit disposed along an outer side of the first sheet conveying path and configured to include a belt to convey the sheet toward the holding section of the second conveying unit, wherein the belt conveying unit includes:

a first belt holding and rotating member disposed facing the holding section; and a second belt holding and rotating member disposed facing the first belt holding and rotating member and disposed on an upstream side of the second conveying unit in the second sheet conveying direction, and the belt being wound between the first and second belt holding and rotating members, wherein the belt conveying unit further includes a first pressing member configured to apply a force on a first pulley shaft via a bearing member to press the belt conveying unit in such a direction that the belt constantly press contacts with the first belt holding and rotating member toward the first sheet conveying path, and a second pressing member configured to apply a force on a second pulley shaft via a belt supporting member to press the belt conveying unit in such a direction that the belt constantly press contacts with the second belt holding and rotating member toward the first sheet conveying path, and wherein the belt supporting member is rotatably attached to the first pulley shaft and rotatably moves about the first pulley shaft in a perpendicular direction towards the first sheet conveying path.

2. The sheet conveying device according to claim 1, further comprising:

a first guide member disposed in the vicinity of the belt on a downstream side of the first sheet conveying path and configured to guide the conveyed sheet to the belt, the first guide member having a downstream end, wherein a center of a shaft of the second belt holding and rotating member is disposed on an upstream side in the second sheet conveying direction of the second conveying unit from the downstream end of the first guide member.

3. The sheet conveying device according to claim 2, further comprising:

a second sheet conveying path formed from an upstream of the second conveying unit to the second conveying unit and different from the first sheet conveying path; and a third sheet conveying path formed between the first and second sheet conveying paths to merge at an upstream side of the second conveying unit, wherein the center of the shaft of the second belt holding and rotating member is disposed on the upstream side in the second sheet conveying direction of the second conveying unit from the downstream end of the first guide member.

4. The sheet conveying device according to claim 2, wherein the belt conveying unit is disposed so as to eliminate a gap between the downstream end of the first guide member and a conveying surface of the belt.

5. The sheet conveying device according to claim 2, wherein an axial center of the second belt holding and rotating member is disposed beneath a height of a downstream end of the first guide member.

6. The sheet conveying device according to claim 1, wherein the belt includes an elastic member having a relatively low rigidity.

7. The sheet conveying device according to claim 1, wherein at least one of the first and second belt holding and rotating members includes an elastic member having a relatively low rigidity.

8. The sheet conveying device according to claim 1, wherein the belt is bow-shaped, having an outwardly convex portion at a center thereof in a belt width direction perpendicular to the second sheet conveying direction of the second conveying unit.

9. The sheet conveying device according to claim 1, wherein at least one of the first and second belt holding and rotating members is bow-shaped, having an outwardly convex portion at a center thereof in the belt width direction perpendicular to the second sheet conveying direction of the second conveying unit.

10. The sheet conveying device according to claim 1, further comprising:

a second sheet conveying path formed from an upstream end of the second conveying unit to the second conveying unit and different from the first sheet conveying path; and a third sheet conveying path formed between the first and second sheet conveying paths to merge at an upstream side of the second conveying unit, wherein at least one second belt holding and rotating member is disposed to swingably rotate about the first belt holding and rotating member and is pressed at a given force in a direction toward the first sheet conveying path.

11. The sheet conveying device according to claim 1, further comprising:

a belt supporting member configured to rotatably support the first belt holding and rotating member and the second belt holding and rotating member and includes a positioning section to position the belt at a given position; and a second guide member disposed so that the conveying surface of the belt faces an outer side of one of the first and third conveying paths, wherein the second pressing member includes an elastic member and the positioning section of the belt supporting member is pressed against the second guide member by a pressing force of the elastic member so as to position the belt at a given position protruding inward from a guide surface of the second conveying guide member.

12. The sheet conveying device according to claim 11, wherein the belt conveying unit includes multiple the belts, multiple first belt holding and rotating members, multiple second belt holding and rotating members, and multiple belt supporting members, each being disposed along the second sheet conveying direction, the first and second pressing members are disposed corresponding to each of the plurality of the belt supporting members, and the force of the first and second pressing members disposed corresponding to each of the plurality of the belt supporting members is adjustable.

13. The sheet conveying device according to claim 12, wherein the belt conveying unit includes at least three belts, so that the force of at least one of the first and second pressing members corresponding to one disposed at a center of the at least three belts is greater than that of either of the other at least three belts.

14. The sheet conveying device according to claim 1, wherein a leading edge of the sheet conveyed from the first conveying unit abuts against or contacts a conveying surface of the belt conveying unit.

15. The sheet conveying device according to claim 14, wherein the leading edge of the sheet conveyed from the first conveying unit approaches the conveying surface of the belt at an acute collision angle.

16. The sheet conveying device according to claim 14, wherein the leading edge of the sheet abuts against or contacts with an abdominal portion of the conveyor belt, where the conveyor belt constantly and appropriately becomes elastically displaced and/or deformed.

17. The sheet conveying device according to claim 1, further comprising a belt supporting member, wherein each of the first pressing member and the second pressing member is attached to the belt supporting member.

18. The sheet conveying device according to claim 1, wherein a position of a shaft of the first belt holding and rotating member is fixed as the belt is pressed against the holding section of the second conveying unit, and a shaft of the second belt holding and rotating member pivots back and forth about the shaft of the first belt holding and rotating member.

19. An image forming apparatus including a sheet conveying device, the sheet conveying device comprising:

a first conveying unit configured to convey a sheet in a first sheet conveying direction;

a second conveying unit disposed on a downstream side of the first conveying unit in the first sheet conveying direction and configured to convey the sheet conveyed by the first conveying unit in a second sheet conveying direction different from the first sheet conveying direction, at least the second conveying unit of the first and second conveying units including a holding and conveying unit with a holding section to hold and convey the sheet;

a first sheet conveying path formed between the first conveying unit and the second conveying unit; and a belt conveying unit disposed along an outer side of the first sheet conveying path and configured to include a belt to convey the sheet toward the holding section of the second conveying unit, wherein the belt conveying unit includes:

a first belt holding and rotating member disposed facing the holding section; and a second belt holding and rotating member disposed facing the first belt holding and rotating member and disposed on an upstream side of the second conveying unit in the second sheet conveying direction, and the belt being wound around the first and second belt holding and rotating members, wherein the belt conveying unit further includes at least one first pressing member configured apply a force on a first pulley shaft via a bearing member to press the belt conveying unit in such a direction that the belt constantly press contacts with the first belt holding and rotating member toward the first sheet conveying path, and at least one second pressing member configured to apply a force on a second pulley shaft via a belt supporting member to press the belt conveying unit in such a direction that the belt constantly press contacts with the second belt holding and rotating member toward the first sheet conveying path, and wherein the belt supporting member is rotatably attached to the first pulley shaft and rotatably moves about the first pulley shaft in a perpendicular direction towards the first sheet conveying path.

20. The image forming apparatus according to claim 19, wherein the image forming apparatus includes one of a copier, a facsimile machine, a printer, a printing device, an inkjet recording device, and a multifunction peripheral combining at least two of the copier, the facsimile machine, the printer, the printing device, and the inkjet recording device.

21. An image forming apparatus, comprising:

a sheet conveying device, including:

a first conveying unit configured to convey a sheet in a first sheet conveying direction;

a second conveying unit disposed on a downstream side of the first conveying unit in the first sheet conveying direction and configured to convey the sheet conveyed by the first conveying unit in a second sheet conveying direction different from the first sheet conveying direction, wherein the first sheet conveying direction of the first conveying unit is substantially horizontal and directed to a diagonally upward position, and the second sheet conveying direction of the second conveying unit is directed in a substantially vertically upward direction;

at least the second conveying unit of the first and second conveying units including a holding and conveying unit with a holding section to hold and convey the sheet;

a first sheet conveying path formed between the first conveying unit and the second conveying unit; and a belt conveying unit disposed along an outer side of the first sheet conveying path and configured to include a belt to convey the sheet toward the holding section of the second conveying unit, wherein the belt conveying unit includes:

a first belt holding and rotating member disposed facing the holding section; and a second belt holding and rotating member disposed facing the first belt holding and rotating member and disposed on an upstream side of the second conveying unit in the second sheet conveying direction, and the belt being wound between the first and second belt holding and rotating members, wherein the belt conveying unit further includes at least one first pressing member configured to apply a force on a first pulley shaft via a bearing member to press the belt conveying unit in such a direction that the belt constantly press contacts with the first belt holding and rotating member toward the first sheet conveying path, and at least one second pressing member configured to apply a force on a second pulley shaft via a belt supporting member to press the belt conveying unit in such a direction that the belt constantly press contacts with the second belt holding and rotating member toward the first sheet conveying path, and wherein the belt supporting member is rotatably attached to the first pulley shaft and rotatably moves about the first pulley shaft in a perpendicular direction towards the first sheet conveying path.

* * * * *